US011434051B2

(12) United States Patent
Bergida et al.

(10) Patent No.: US 11,434,051 B2
(45) Date of Patent: Sep. 6, 2022

(54) CONTAINER CAP SECURING AND VENTING

(71) Applicant: CELEBRATE EVERYWHERE, LLC, Front Royal, VA (US)

(72) Inventors: John R. Bergida, Front Royal, VA (US); Marvin M. Bergida, Front Royal, VA (US)

(73) Assignee: CELEBRATE EVERYWHERE, LLC, Front Royal, VA (US)

( * ) Notice: Subject to any disclaimer, the term of this patent is extended or adjusted under 35 U.S.C. 154(b) by 205 days.

(21) Appl. No.: 16/593,266

(22) Filed: Oct. 4, 2019

(65) Prior Publication Data

US 2020/0031533 A1 Jan. 30, 2020

Related U.S. Application Data

(62) Division of application No. 14/146,894, filed on Jan. 3, 2014, now Pat. No. 10,472,134.

(60) Provisional application No. 61/749,516, filed on Jan. 7, 2013.

(51) Int. Cl.
*B65D 41/38* (2006.01)
*B65D 51/16* (2006.01)

(52) U.S. Cl.
CPC ..... *B65D 41/385* (2013.01); *B65D 51/16* (2013.01)

(58) Field of Classification Search
CPC .. B65D 51/16; B65D 41/335; B65D 51/1688; B65D 47/32; B65D 41/3423; B65D 41/325; B65D 41/34
USPC ..... 215/252
See application file for complete search history.

(56) References Cited

U.S. PATENT DOCUMENTS

| | | | | |
|---|---|---|---|---|
| 2,456,607 | A * | 12/1948 | Shaffer | B65D 41/0435 215/350 |
| 2,980,276 | A * | 4/1961 | Doria | B65D 41/0435 215/260 |
| 3,047,177 | A | 7/1962 | Poitras et al. | |
| 3,067,900 | A | 12/1962 | Milton | |
| 3,114,467 | A | 12/1963 | Montgomery | |
| 3,174,641 | A | 3/1965 | Kitterman | |
| 3,181,720 | A | 5/1965 | Cassie et al. | |
| 3,189,210 | A | 6/1965 | Heisler | |
| 3,339,772 | A | 9/1967 | Miller | |
| 3,589,983 | A | 6/1971 | Holderith et al. | |

(Continued)

OTHER PUBLICATIONS

Statement Pursuant to 37 CFR 1.56" by John R. Bergida and Marvin M. Bergida.

*Primary Examiner* — Ernesto A Grano
(74) *Attorney, Agent, or Firm* — Buchanan Ingersoll & Rooney PC

(57) ABSTRACT

In consumer-market containers for beverages or other contents under pressure, the cap provides a gas-tight seal by way of two mechanisms that work interdependently. The first is a pressure grip configured to grip the outside wall of the container. The second is twist threads, or some other second attachment structure, that urges the inside of the cap (or, typically, a cap liner disposed thereon) against the rim of the container. Release of pressurized gases when the container is first opened can be by way of release vents in the cap, or via the bottom of the cap through the twist thread area. In the latter case, particular configurations of the pressure grip are relied on to establish the gas escape path.

26 Claims, 41 Drawing Sheets

(56) References Cited

U.S. PATENT DOCUMENTS 3,713,545 A * 1/1973 Lawrence ..... B65D 51/1661 215/260
4,007,851 A * 2/1977 Walker ..... B65D 41/348 215/307
4,076,142 A 2/1978 Naz
4,474,302 A 10/1984 Goldberg et al.
4,948,000 A 8/1990 Grabenkort
4,993,572 A 2/1991 Ochs
5,105,961 A 4/1992 Noren et al.
5,433,331 A 7/1995 Morini
5,662,233 A 9/1997 Reid
5,685,443 A * 11/1997 Taber ..... B65D 41/47 215/252
6,056,136 A * 5/2000 Taber ..... B65D 51/145 215/252
6,202,871 B1 3/2001 Kelly
6,510,957 B2 1/2003 Gilley et al.
6,568,549 B1 5/2003 Miller
7,147,123 B2 * 12/2006 Yamashita ..... B65D 41/045 220/366.1
8,167,161 B2 * 5/2012 Ichimura ..... B65D 41/045 220/303
8,231,019 B2 7/2012 Battegazzore
8,342,344 B2 1/2013 Livingston
2004/0065696 A1 * 4/2004 Fletcher ..... B65D 51/249 222/556
2006/0138073 A1 6/2006 Ooka et al.
2006/0231519 A1 10/2006 Py et al.
2006/0278603 A1 12/2006 Takashima et al.
2007/0138125 A1 6/2007 Granger
2007/0267381 A1 11/2007 Schmidt et al.
2009/0293437 A1 12/2009 Schulz et al.
2010/0065528 A1 3/2010 Hanafusa et al.
2011/0031209 A1 2/2011 Arecco
2011/0068134 A1 3/2011 Yang
2013/0256306 A1 10/2013 Dreyer et al.
2014/0311256 A1 10/2014 Cochran et al.
2015/0251887 A1 9/2015 Glaser et al.
2017/0225851 A1 8/2017 Wada et al.
2018/0251275 A1 * 9/2018 LaPierre ..... B65D 47/32
2018/0273253 A1 * 9/2018 Shahesmaeili ..... B65D 41/04

* cited by examiner

CONTAINER CAP SECURING AND VENTING

CROSS-REFERENCES TO RELATED APPLICATIONS

This application is a Divisional of U.S. application Ser. No. 14/146,894 filed Jan. 3, 2014 and claims the benefit of U.S. Provisional Application No. 61/749,516 filed Jan. 7, 2013, the entire content of each of which is incorporated by reference herein.

BACKGROUND

The present invention relates to containers and their closures and is particularly applicable to consumer-sized containers and their closures for carbonated beverages or other contents under pressure.

The maximum size of the mouth, or opening, of a container with contents under pressure is principally determined by the level of pressure inside the container and the characteristics of the mechanism(s)—such as twist threads—that are used to secure the closure, or "cap," to the container. The force on the cap induced by the pressurized contents may be calculated by the pressure inside the container (measured, for example in pounds-per-square-inch, or "psi") multiplied by the area of the inside of the cap that is exposed to the interior of the container. For a given level of pressure, this "internal force" is thus proportional to the square of the radius of the opening of the container.

As a result of the foregoing, the opening of commercially produced screw-top beer and soda (or "pop") bottles is constrained to be that for which twist threads of a commercially acceptable size and strength will provide enough counteracting "holding force" to hold the cap securely. Twist threads for soda or beer bottles that are commercially practical and acceptable to consumers have a maximum depth (i.e. dimension perpendicular to the container side wall) of approximately 2.5 mm. Such threads provide a certain maximum holding force. Exceeding this maximum would give rise to the possibility that a significant portion of the contents could escape and/or the cap could be dislodged from its position on the container, for any of a number of reasons. For example, the twist threads might slip and become disengaged if, for example, the cap distorted due to increased pressure—and thus increased force on the cap—resulting from the container being left in a warm car or shipping truck. Or there might be at least enough force on the inside of the cap that the sealing between the inside of the cap and the container rim could be breached and a significant portion of the contents could leak from the container. We use the word "significant" here to distinguish from the minute amounts of gas that inevitably may leak from a container over very long periods of time (years or perhaps decades). In a worst-case scenario, the cap could be dislodged, ejected from the container altogether, and sent flying.

In light of the above considerations, the opening of a screw top (typically all-aluminum) beer bottle is limited to an inner diameter of no more than about 30.5 mm. The corresponding cap has an outside diameter of about 38 mm. The pressure inside a typical beer bottle is about 30 psi. This is about 40% less than the psi inside a typical soda bottle, which is approximately 50 psi. As a result the opening of a soda bottle must be smaller than for beer, given the same twist thread capability, so that the internal force can be kept to an acceptable level. Indeed, screw top plastic soda bottles are typically limited to an opening of no more than about 22.5 mm in inner diameter, with a corresponding outside cap diameter of about 28 mm.

These constraints are commercially vexing in that it would desirable if containers for beer, soda and the like could have wider openings. For example, there is a loss of flavor/taste when one drinking a commercially-filled beverage from a relatively small opening. Such loss of flavor/taste could be reduced or eliminated if the container were have a wider opening—at least in part because it allows oxygen into the beverage as the consumer drinks.

One way to deal with this higher level of internal force could be to "beef up" the twist threads. Such twist threads would, however, have to be unacceptably large and/or unsightly for use in a consumer product. Or one might envision cap-securing mechanisms other than twist threads for containers with contents under pressure. Even if such alternatives were devised, the cap-securing mechanism might well have to be in such tight engagement with the container as to make removal extremely difficult for the consumer. Additionally, one would have to be concerned that the container and/or cap might be broken upon the application of a large force in the process of attempting to remove such a tightly secured cap. The result would be the need to "beef-up" the container—using thicker glass or metal, for example—which, disadvantageously, could add to the cost and weight of the container.

Another possibility one might envision is the use of some kind of separate securing mechanism analogous to the wire "cage" securing the cork of a Champagne bottle. Any such separate mechanism would be clumsy and/or inconvenient to remove.

The foregoing are some reasons we believe that industry has not commercialized wider-mouthed containers for carbonated beverages or other contents under pressure.

Consider, also, containers and closures for Champagne or highly carbonated sparkling wines. Here, a common closure is a cork or plastic stopper (usually referred to in either case as a "cork") secured by a wire cage. Removing the wire cage might be somewhat of an annoyance for some. But the major issue here is that of being able to remove the cork without it flying off and/or without having some of the contents come shooting out. This task requires practice, deftness and, usually not a small degree of hand strength and, as such, is an unacceptably daunting task for many consumers.

Another concern in this realm is that the pressurized gas in a container for a beverage or other contents under pressure should not be allowed to forcibly project a twist-off cap (or other removable closure) away from the container at the moment that the cap begins to be removed (e.g. begun to be twisted off)—thereby turning the cap into a potentially dangerous projectile. To this end, it is known in the context of existing containers to implement one or more venting mechanisms to prevent this from happening. One such mechanism provided in plastic containers, for example, is to provide cuts through the twist threads on the bottle neck, thereby providing a path for escaping gases as the cap begins to be twisted off and the seal between the container rim and the cap is broken. Another mechanism, which is used for aluminum beer bottles, for example, is to provide small holes through the outside wall of the cap near its top, with such holes becoming a path for escaping gases once the cap begins to be twisted off. Yet another mechanism, sometimes applied to plastic ribbed corks used for sparkling wine, for example, is to provide vent holes between at least some of the ribs of the ribbing. As the cork begins to be pulled out of the bottle, those holes become exposed, providing a pathway for gas from the interior of the bottle, into the hollow plastic cork and out the vent holes.

These approaches are adequate to eliminate or substantially reduce the problem of the cap being forcibly projected away from the container during the opening process. However, they may, disadvantageously, disperse gases and, potentially, a certain amount of liquid spray, onto the hands of the consumer.

SUMMARY

Our invention is directed to solving one or more of the above problems.

In accordance with the invention, a gas-tight seal for a container is provided by a combination of two cap-securing mechanisms that work interdependently. Specifically, we have recognized that one or more of the above-discussed problems are solved by a container closure that is configured to grip at least one of a) the inside wall of the container and, b) the outside wall of the container, and also engage, or be engaged by, twist threads, or some other second cap-securing structure, that urges the inside of the cap (or, typically, a cap liner disposed thereon) against the rim of the container.

The configuration of the cap to grip the container is illustratively by way of a member referred to herein as the "pressure grip."

The combination of these two cap-securing mechanisms, we have discovered, can achieve the requisite amount of cap-securing, i.e. the requisite holding force, for a pressurized beverage container, even though the cap would not reliably secure, and/or would not be leak-proof, if either of the mechanisms were used on its own. Because the twist threads (or other second cap-securing structure) are providing only a portion of the holding force, they can be of a commercially acceptable size and configuration. In particular, we envision that of the total holding force, at least 10% will be provided by the grip and at least 10% will be provided by the threads or other second cap-securing structure. Indeed, in particular commercially likely embodiments, the pressure grip may provide at least as much of the total holding force as the twist threads, i.e., at least 50%, depending on the internal pressure and the inner diameter of the opening of the container which, in turn, determine the internal force and thus, the required holding force.

(For convenience, this description talks in terms of the holding forces provided by the twist threads and the pressure grip but it will be recognized that the holding forces that hold the cap in place are actually downward and lateral forces (assuming the container is standing with the cap upward) that are exerted ON the container wall and twist threads by the cap in response to the upwardly directed inner force that the pressurized gas applies to the inside top of the cap. Since the twist cap and pressure grip exert forces on the container that are equal in magnitude to the holding forces applied thereto by the container, there is no harm in talking in the terms of it being the twist threads and pressure grip that provide the holding forces.)

A further requirement of any container closure is that the amount of effort required to open the container will be at a level that is commercially acceptable. Advantageously, the level of gripping provided by the pressure grip of our invention can be made quite high and yet the amount of effort required to remove the cap can be within commercially acceptable limits because the twist threads, in addition to helping to hold the cap on, also serve to aid the consumer in overcoming the resistance to removal engendered by the pressure grip. Without the threads, in particular, the pressure grip would have to be tugged on to be removed, which could be awkward and difficult to do.

In embodiments where the pressure grip grips, or binds to, the outside wall of the container, it is referred to herein as an "outer pressure grip." In embodiments where the pressure grip grips, or binds to, the inside wall of the container, it is referred to herein as an "inner pressure grip."

The pressure grip may be in the form of a ring, puck or other shape, depending on whether it is an inside pressure grip or outside pressure grip and depending on such factors as how much of the cap-securing task is desired to be provided by the pressure grip and how much by the twist threads or other second cap-securing structure. The pressure grip may be rigid or flexible and/or may be gas-filled. The pressure grip shape, dimensions, frictional coefficient and other characteristics are selected, as will be readily determinable by one skilled in the art, based on a) the level of force on the cap (as created by such factors as the volume of contents, amount of carbonation or other pressure-producing contents, shape of the container, diameter of the opening, ambient temperature, etc.) and b) the amount of cap-securing provided by the twist threads or other second cap-securing structure. As already noted, the pressure grip provides more of the cap-securing power than the twist threads in particular embodiments.

If the pressure grip is an outer pressure grip, particular embodiments may have a separate cap liner on the inside of the cap that twist threads will push the container rim up against so as to seal the contents within the container. If the pressure grip is an inner pressure grip, the pressure grip in particular embodiments can be configured to incorporate and/or perform the function of the cap-liner.

Particular ones of our embodiments use vent holes and/or thread cuts—as in the prior art discussed above—as a mechanism for releasing the pressurized gases before the cap is fully disengaged from the container. Indeed, in some embodiments the vents are disposed in the cap, as is known in the prior art.

In other embodiments, however, venting is achieved based on the configuration of the pressure grip. For example, in some embodiments the pressure grip may contain vent holes as part of an overall path for the release of pressurized gas to the outside atmosphere—illustratively through the bottom of the cap—when the cap is first begun to be removed. In other embodiments, the pressure grip may have scallops, tubes, channels or some structure other than holes as part of that path.

Our venting arrangements wherein the pressure grip is configured to provide, or allow for, part of the venting, as just described, can be implemented apart from our dual cap-securing mechanism invention. That is, one might choose to implement such venting without the pressure grip providing much, if any, real cap-securing functionality. This might be the case if it were found that—for a given container configuration and/or amount of pressure within the container—the cap could be satisfactorily secured with just twist threads, for example. The pressure grip would, in such a case, not be a pressure grip, per se, but only a vehicle for venting.

BRIEF DESCRIPTION OF DRAWING FIGURES

DETAILED DESCRIPTION

Figure 1:
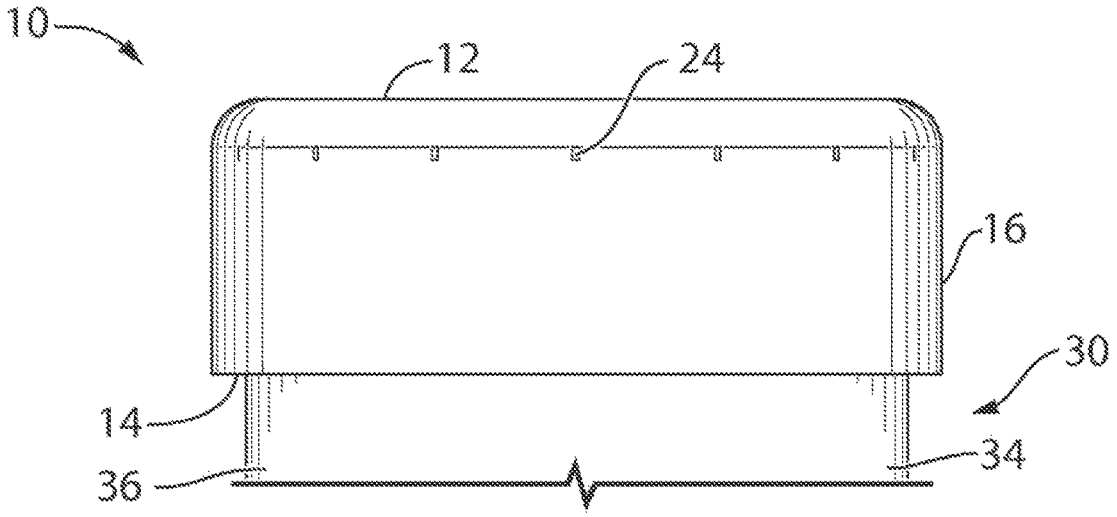
FIG. 1 is a perspective view of a first embodiment of a cap and container embodying the principles of the invention wherein the cap is affixed to the container.
Figure 2:
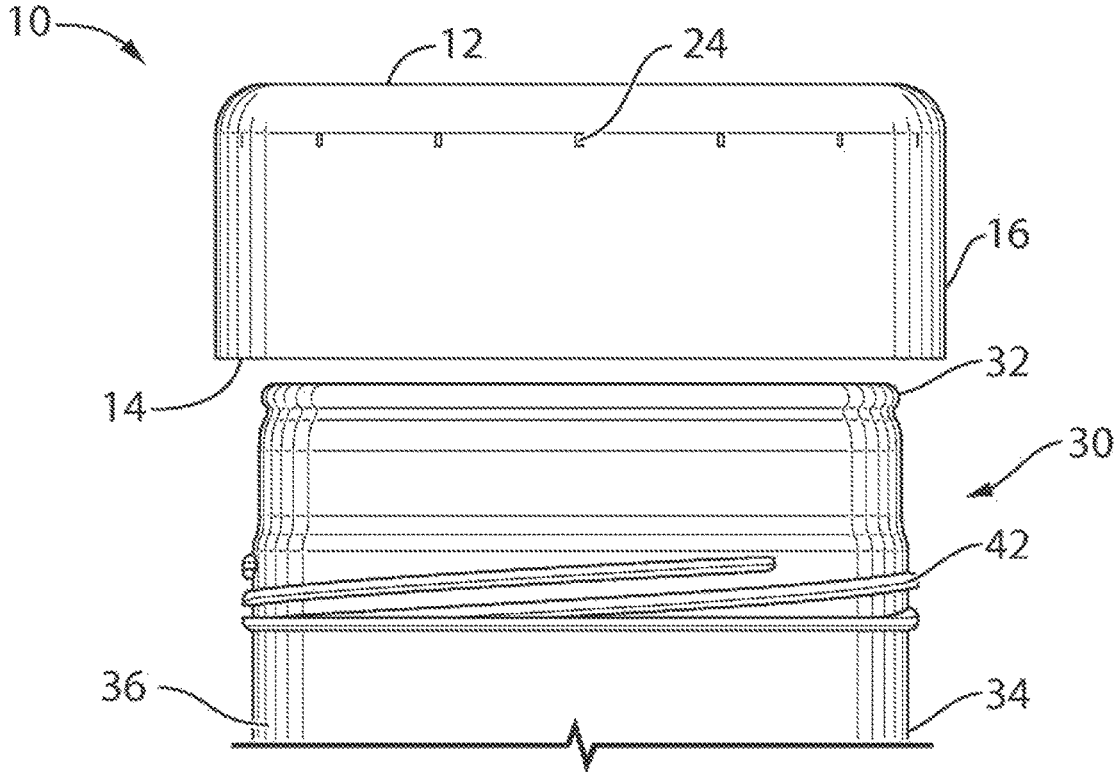
FIG. 2 is a perspective view of the cap and container of the first embodiment wherein the cap has been removed from the container.
Figure 3:
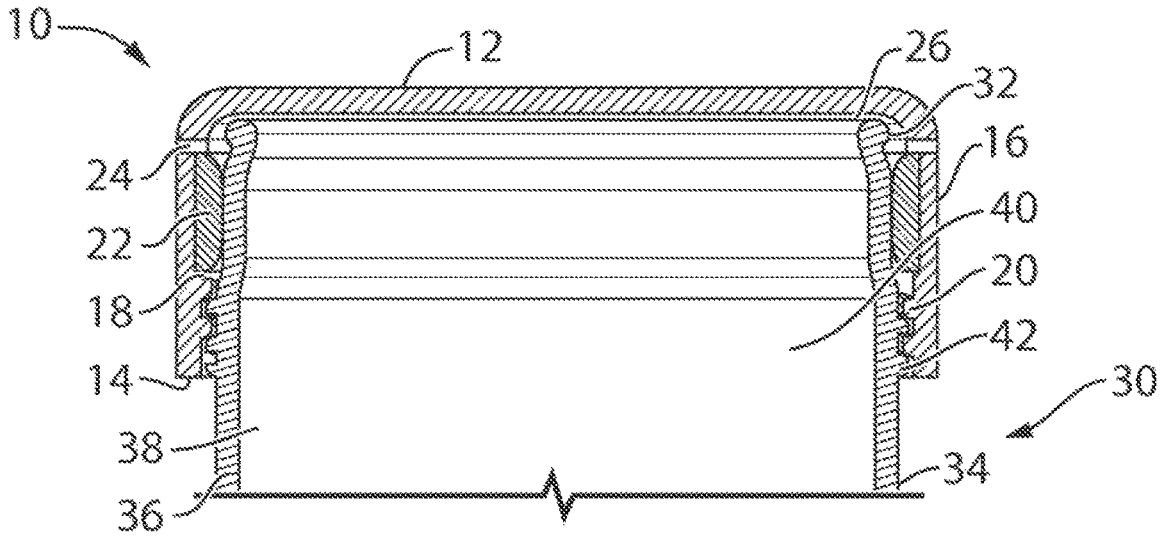
FIG. 3 is a vertical cross-section of the cap and container of the first embodiment illustrating how the dual cap-securing function is provided by the combination of an outside pressure grip and twist threads.
Figure 4:
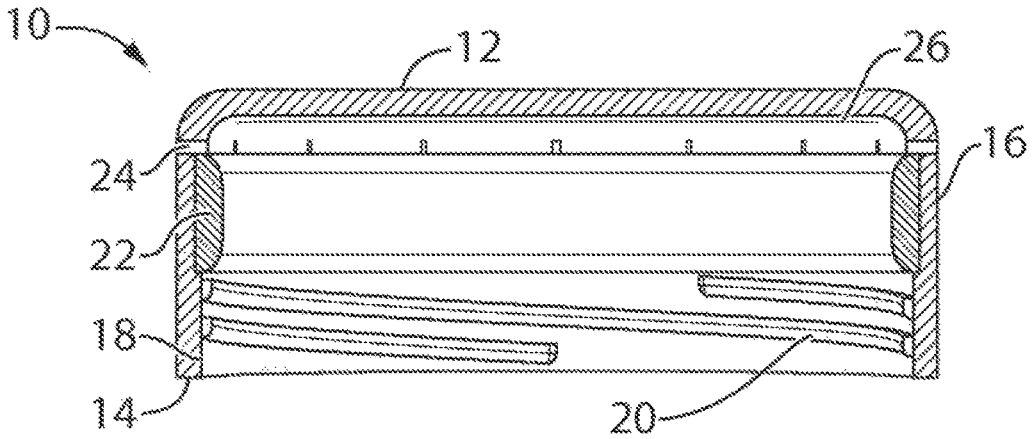
FIG. 4 is a vertical cross-section of just the cap of the first embodiment illustrating its outside pressure grip, twist threads, and release vents in the cap.

First through sixteenth embodiments of the invention are shown in FIGS. 1-8, 9-16, 17-24, 25-32, 33-40, 41-48,49-56, 57, 58, 59, 60, 61-65, 66-71, 72-76, 77-81, and 82-86, respectively. In the various views, elements having corresponding functions have the same reference numeral, even though the elements may have differing configurations.

Specifically, each embodiment comprises a container 30 and a closure, or cap, 10 for the container. In these embodiments the container is sized to be a consumer product containing a beverage that the consumer can either consume directly by drinking from the container or can pour out into a glass or other drinking vessel. The beverage (not shown in the FIGS.) is illustratively soda, beer, sparkling wine or some other beverage under gas pressure when sealed within the container.

The diameter of cap 10 is illustratively 66 mm in the depicted embodiments. The different FIGS. may not be drawn to the same scale as one another, but each FIG. within itself is drawn to scale. Therefore other dimensions of the caps and of the containers shown herein can be determined by determining the ratio between 66 mm and the cap diameter as measured on an individual one of the FIGS., and then multiplying that ratio by other measurements measured on that same FIG.

Given a particular container width or diameter, its height may be anything appropriate to accommodate a desired amount of beverage, such as the standard 12-16-24- and 40-oz sizes for beer and/or soda or the standard 3/16 L, 3/8 L, 3/4 L (or larger) sizes for sparkling (or still) wine.

The container of each embodiment has a top end, or rim, 32, a bottom end 34, at least one cylindrical sidewall 36 that forms a cavity 38 defined by the interior surface of the sidewall and bottom end 34, and twist threads 42 on sidewall 36 onto which twist threads 20 in the cap are twisted when the cap is affixed to the container. Additionally, the reference numeral 44 is used to designate gases releasing from the container at the moment when the cap begins to be twisted off.

The cap of each embodiment has a top end 12 that covers the rim of the container opening when the cap is in place on the container, and bottom end 14, at least one sidewall 16, an interior surface 18, twist threads 20 which thread onto twist threads 42 of the container when the cap is affixed thereto and a cap liner 26 against which the container rim 32 is urged when the cap is in the fully-twisted-on position. Cap liner 26 is illustratively a resilient member of conventional design affixed to the inside bottom of the cap.

Each cap also has a pressure grip 22, at least a portion of which is in contact with the sidewall of the container. In the first embodiment (FIGS. 1-8), the pressure grip is in the form of a ring disposed on the sidewall of the cap above the cap twist threads and grips, or binds to, the outside surface of the sidewall of the container and is referred to herein as an "outer pressure grip"). The outer pressure grip may be made, for example, from synthetic cork. In the remaining, second through sixteenth, embodiments, the pressure grip is spaced apart from the sidewall of the cap and grips, or binds to, the inside surface of the sidewall of the container and is referred to herein as an "inner pressure grip. The inner pressure grip might be a) a rigid or semi-rigid plastic ring (second, third, fourth, seventh, eighth, ninth, tenth, and sixteenth embodiments—FIGS. 9-16, 17-24, 25-32,49-56,57, 58, 59, and 82-86 respectively) or b) a rigid or semi-rigid plastic puck having a sidewall spaced apart from the sidewall of the cap with a solid bottom (fifth and sixth embodiments—FIGS. 33-40 and 41-48, respectively), or c) rigid or semi-rigid plastic geometric shapes (eleventh, twelfth, thirteenth, fourteenth, and fifteenth embodiments—FIGS. 60, 61-65, 66-71, 72-76, 77-81). Other materials and other configurations are possible for both the outer and inner pressure grips. For example, pressure grips in the form of a ring might be double-walled and filled with air or with some other gas whose presence might enhance the pressure grip's functionality. Also, in embodiments where the pressure grip is in the form of a puck, the puck may not have a solid bottom.

In each of the embodiments wherein the pressure grip is an inner pressure grip, cap liner 26 is integral with the pressure grip. It is possible, however, for cap liner 26 to be a physically separate element.

The pressure grip is in binding contact with the container—illustratively in contact with either the outside of the container near the container opening (in the case of an outside pressure grip) or in contact with the inside of the container near the container opening (in the case of an inside pressure grip)—so that the pressure grip presses against the container wall and, with the twist threads or other second cap-securing structure, keeps the cap in place and ensures that there is no leaking of liquid and/or gas between the cap liner 26 container rim 32. The twist threads and the pressure grip work interdependently to keep the cap held in place. A variation would be to combine the outer and inner grip into a dual-pressure grip system where the holding power is shared between them. In this configuration, the pressure grips grip the inner and outer container wall in addition to the threads. Moreover, the twist threads serve to aid the consumer in overcoming the resistance to removal engendered by the pressure grip. Without the threads, in particular, the pressure grip would have to be tugged on to be removed, which could be awkward and difficult to do.

A particular minimum amount of torque—referred to herein as the "dislodging torque"—is required to be applied to the cap for the cap to be twisted from its initial position on the sealed container. We anticipate that in various embodiments the maximum dislodging torque will be between about 2.0 and 3.5 newton-meters, which is within the capability of most adults. If torque in an amount less than the dislodging torque is applied to the cap, the cap is prevented from being twisted from its initial position by an opposing frictional torque which is a combination of a) a first frictional torque due to friction between the pressure grip and the container, and b) a second frictional torque due to friction between the twist threads of the cap and the twist threads of the container.

Rather than talking about a dislodging torque as a way of characterizing the minimum effort required to dislodge the cap from its initial position, one can equivalently talk about the required minimum amount of total forces applied at particular locations on the cap. In the case where the second cap-securing structure is twist threads, per the illustrative embodiments, and the particular locations on the cap are at its rim—which is the conventional way that untwisting forces are applied to a twist cap—then the amount of that total force is given by the dislodging torque divided by the radius of the cap.

In the case of a container with contents under relatively high pressure (e.g. Champagne and many sparkling wines), not only does the invention eliminate the need for the consumer to engage in the additional step of removing a wire cage or the like, but removal is safer in that, as will be seen, the invention allows for a design wherein the trapped gases can escape at a time when the closure is still somewhat engaged to the container (e.g. by the twist threads), making the removal safer than, for example, when a conventional cork is removed. Such release may well be achieved with the prior art hollow cork, as described above, but that approach, disadvantageously, may require a separate metal "cage" to hold the cork in place.

Each cap and/or cap-container combination in the disclosed embodiments is further configured to allow for safe release of pressurized gas at the moment when the cap is first begun to be twisted. This may be achieved by providing vent holes in the cap (first, fourth, fifth, sixth, seventh, tenth, eleventh, and sixteenth embodiments—FIGS. 1-8, 25-32, 33-40, 41-48, 49-56, 59, 60, and 82-86, respectively) similar to the prior art or in the case of embodiments having an inner pressure grip, it may be achieved by having some form of venting—including but not limited to vent holes or scallops, tubes, channels or the like—integral to the pressure grip, in which cases the gases ultimately vent out through, for example, the twist threads. All such vent holes or other passageways are designated in the FIGS., with the reference numeral 24.

Thus the embodiments share a number of common characteristics. In each of them, the beverage or other contents under pressure is sealed within the container when the cap is fully on—i.e. in an initial position that seals the contents in the container—by virtue of a tight engagement between rim 32 and cap liner 26. In accordance with the invention, the cap is, in turn, kept in place and leak-resistant by a combination of a) friction between a sidewall 36 surface and pressure grip 22, and b) the fact that the engagement between twist threads 42 on the container wall and twist threads 20 on the inner wall of the cap acts against forces that would tend to pull the cap upward. Another common characteristic is that each of the embodiments has an inner pressure grip 22 with an integral cap liner 26, except for the first, tenth, twelfth, thirteenth, fourteenth, and fifteenth embodiments (FIGS. 1-8, 59, 61-65, 66-71, 72-76, 77-81), which has a pressure grip 22 and a cap liner 26 that is separate therefrom.

In each of the embodiments, the seal, or engagement, between rim 32 and cap liner 26 is opened almost immediately after the cap begins to be twisted off and, as a consequence, begins to raise up. Venting of the pressurized gases then occurs in various ways in the various embodiments.

Figure 5:
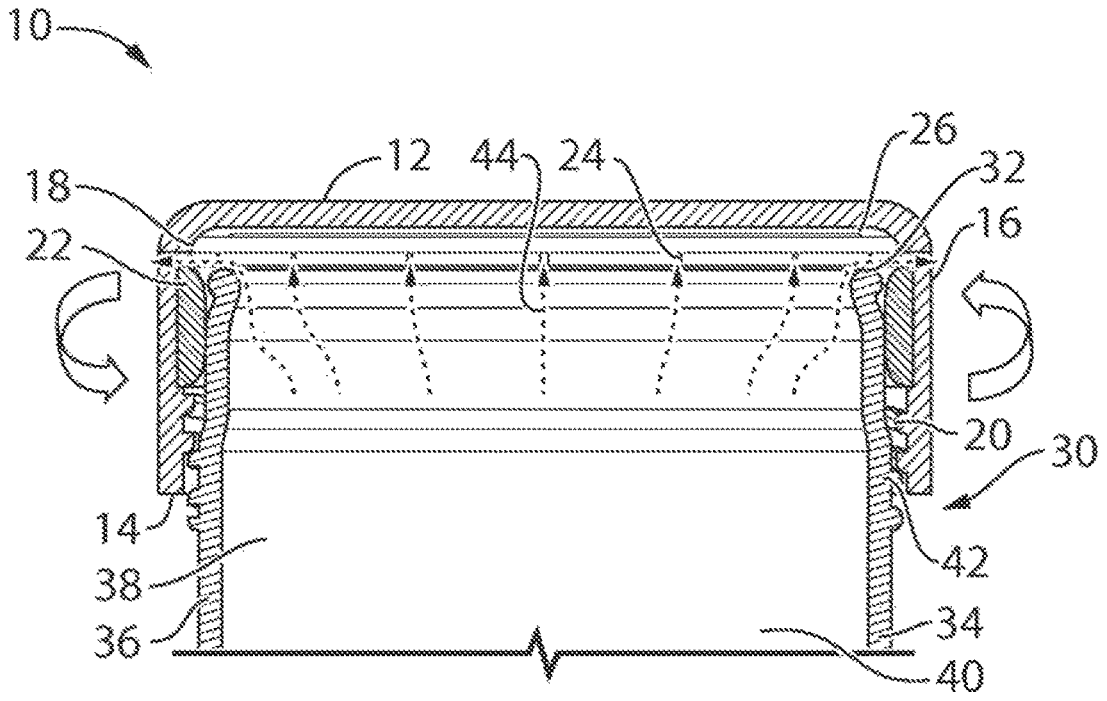
FIG. 5 is a vertical cross-section through the cap and container of the first embodiment, wherein the cap has just been somewhat twisted and gases are releasing through the vent holes in the cap.
Figure 6:
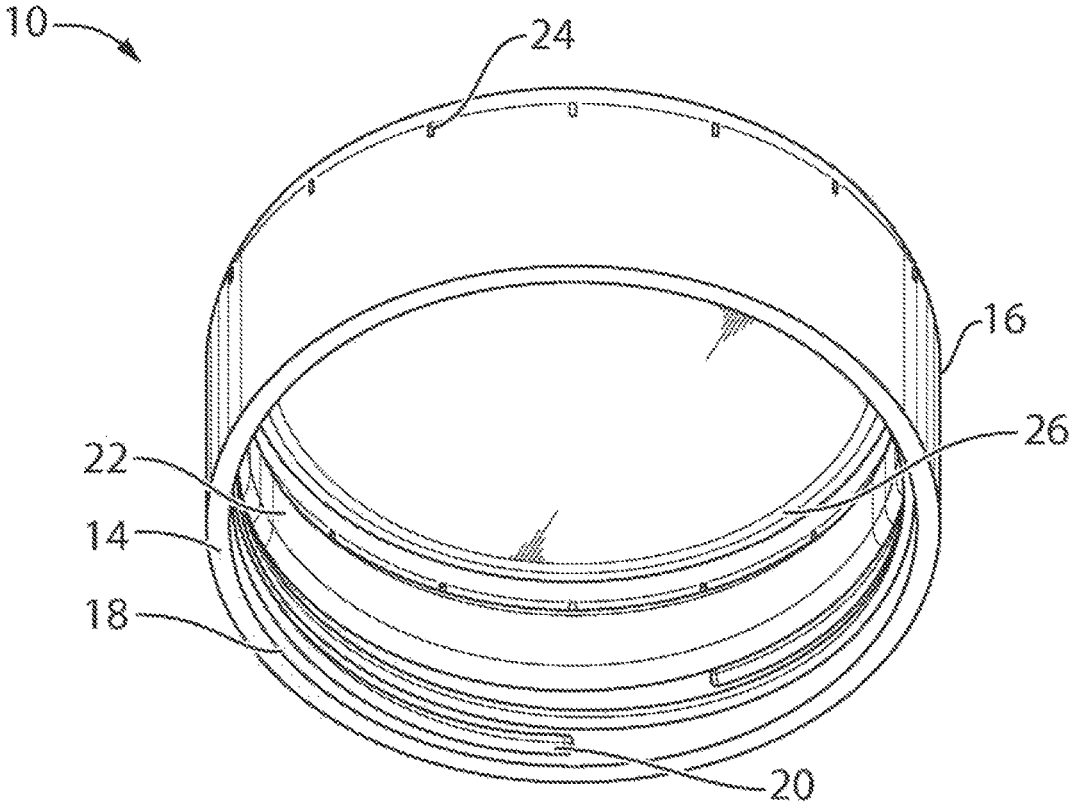
FIG. 6 is a bottom perspective view of the cap of the first embodiment.
Figure 7:
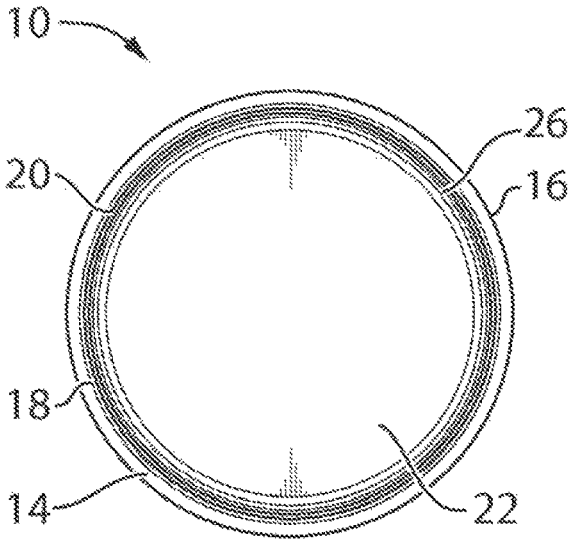
FIG. 7 is a bottom view of the cap of the first embodiment.
Figure 8:
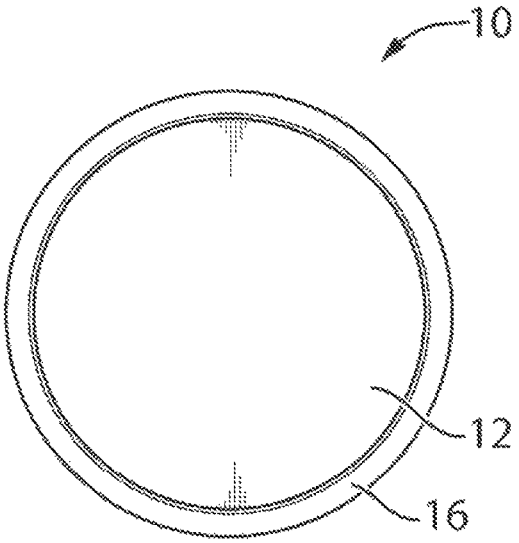
FIG. 8 is a top view of the cap of the first embodiment.
Figure 9:
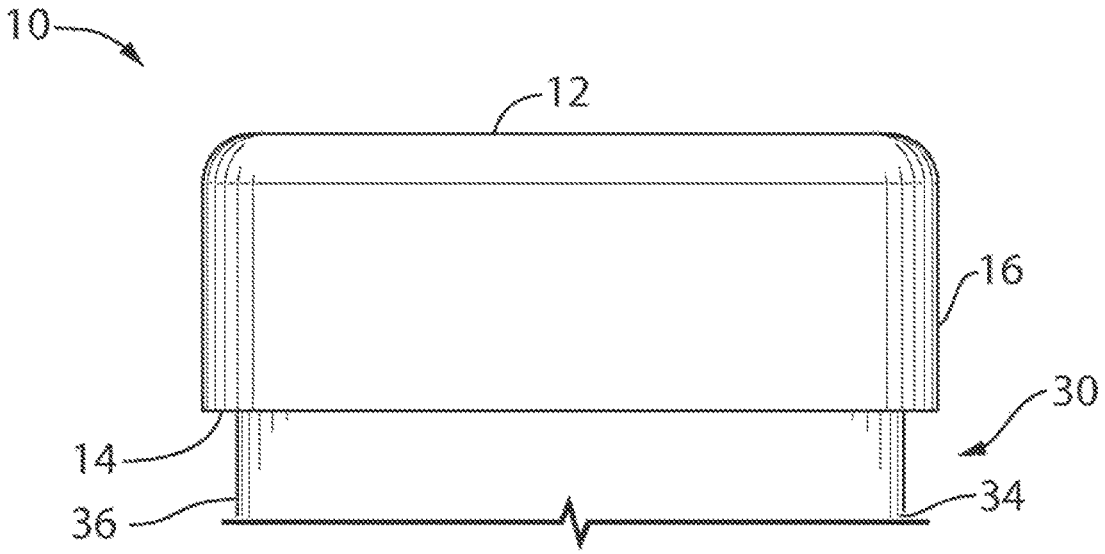
FIG. 9 is a perspective view of a second embodiment of a cap and container embodying the principles of the invention wherein the cap is affixed to the container.
Figure 10:
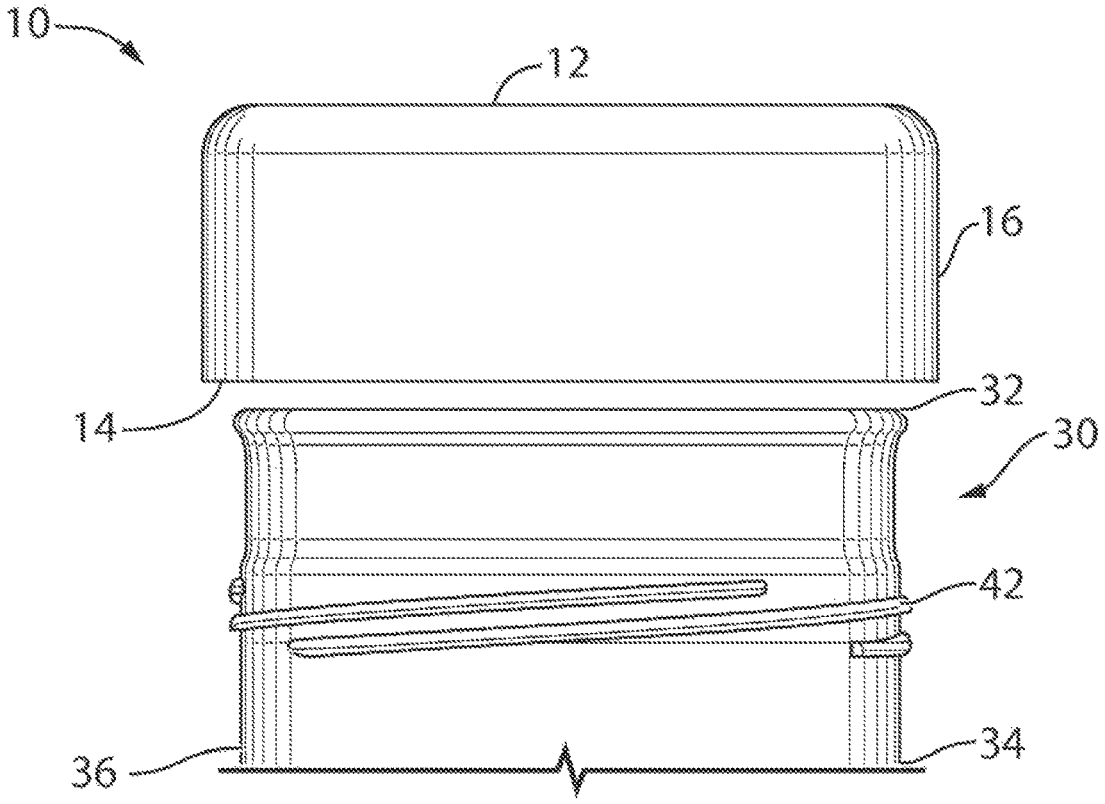
FIG. 10 is a perspective view of the cap and container of the second embodiment wherein the cap has been removed from the container.
Figure 11:
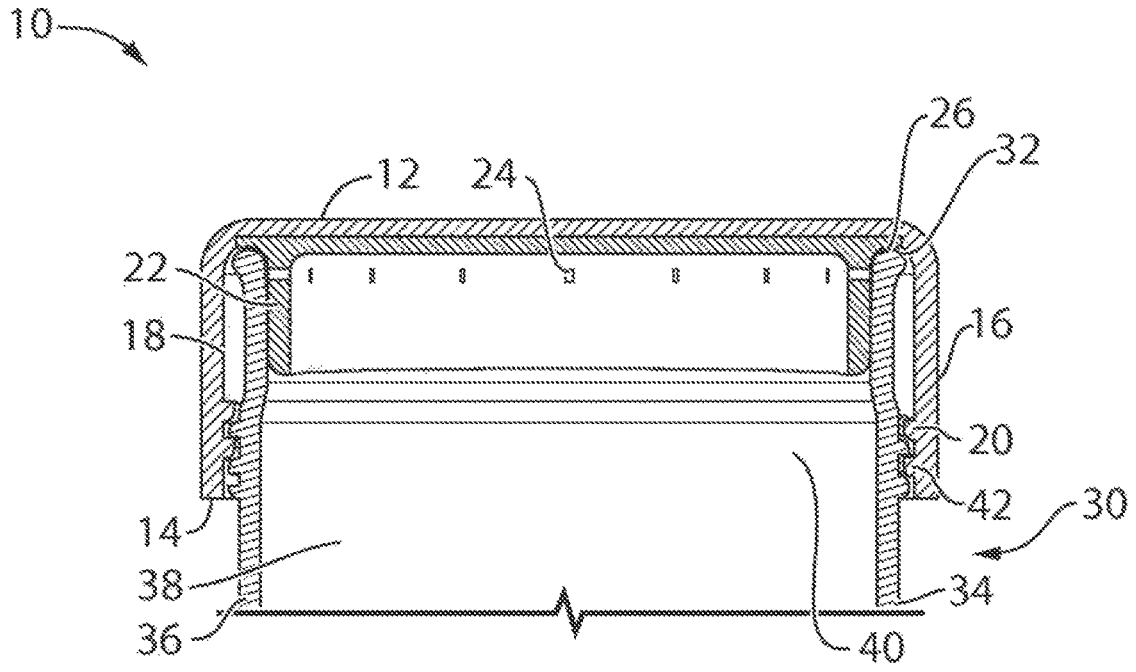
FIG. 11 is a vertical cross-section of the cap and container of the second embodiment illustrating how the dual cap-securing function is provided by the combination of an inside pressure grip and twist threads and shows vent holes in the pressure grip.
Figure 12:
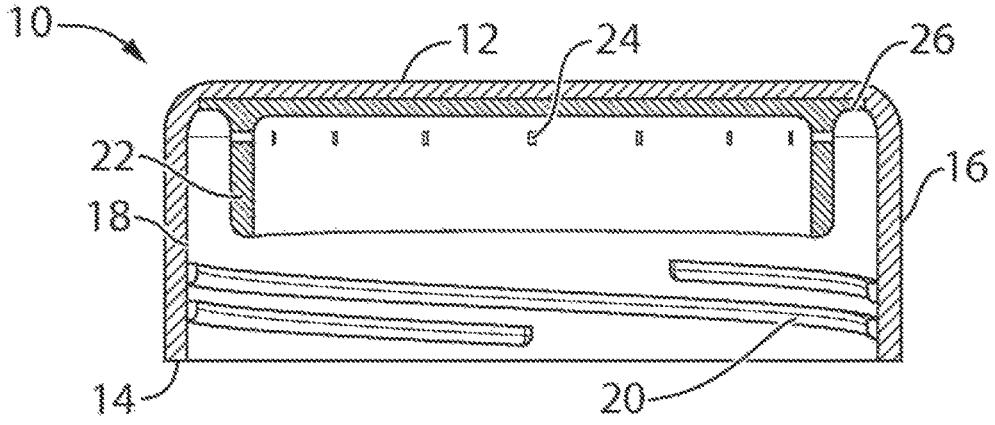
FIG. 12 is a vertical cross-section of just the cap of the second embodiment illustrating its inside pressure grip with its vent holes and the cap's twist threads.

In the first embodiment (FIGS. 1-8), in particular, vent holes 24 in the cap are raised to a level above rim 32 after about ¼ turn of the cap. This provides the pressurized gases with a path of exit through vent holes 24 as seen in FIG. 5. The size of the vent holes is selected such that no matter how quickly a person might twist off the cap, the pressure inside the container will become substantially the same as the atmospheric pressure outside of the container prior to the complete disengagement of the cap, thereby preventing the cap from flying off the container. Sizing of vent holes—or, in various other embodiments as described below—scallops, channels, tubes or tapers will be similarly selected to achieve the desired pressure equalization.

Figure 13:
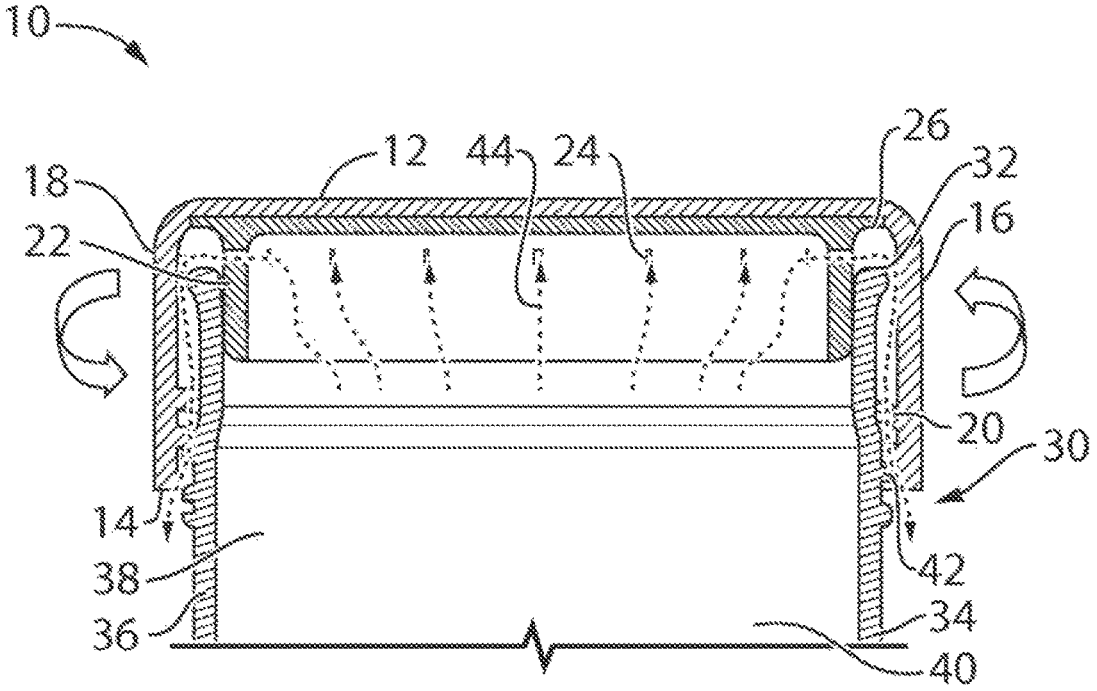
FIG. 13 is a vertical cross-section through the cap and container of the second embodiment wherein the cap has just been somewhat twisted and gases are releasing through vent holes in the inside pressure grip and thence to the atmosphere through the area of the twist threads.
Figure 14:
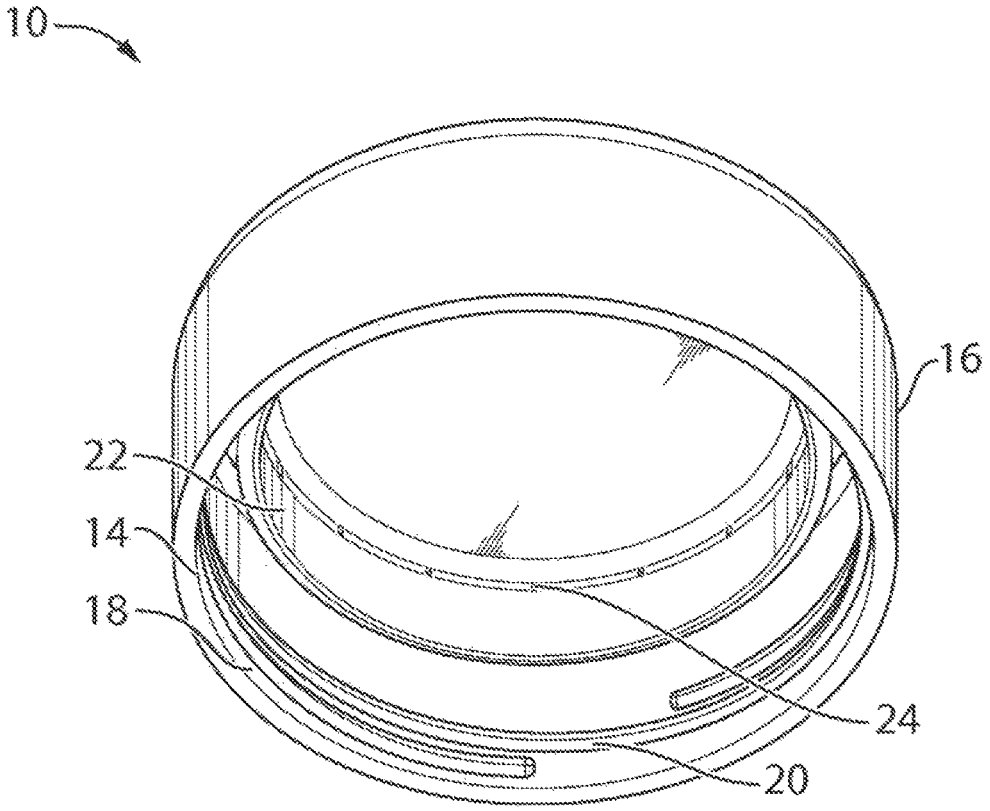
FIG. 14 is a bottom perspective view of the cap of the second embodiment.
Figure 15:
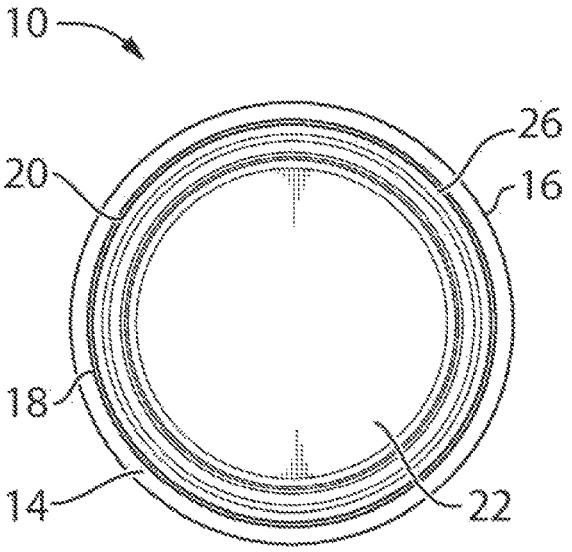
FIG. 15 is a bottom view of the cap of the second embodiment.
Figure 16:
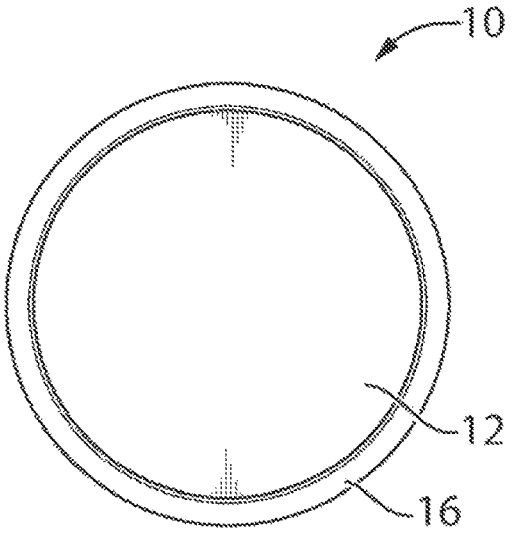
FIG. 16 is a top view of the cap of the second embodiment.
Figure 17:
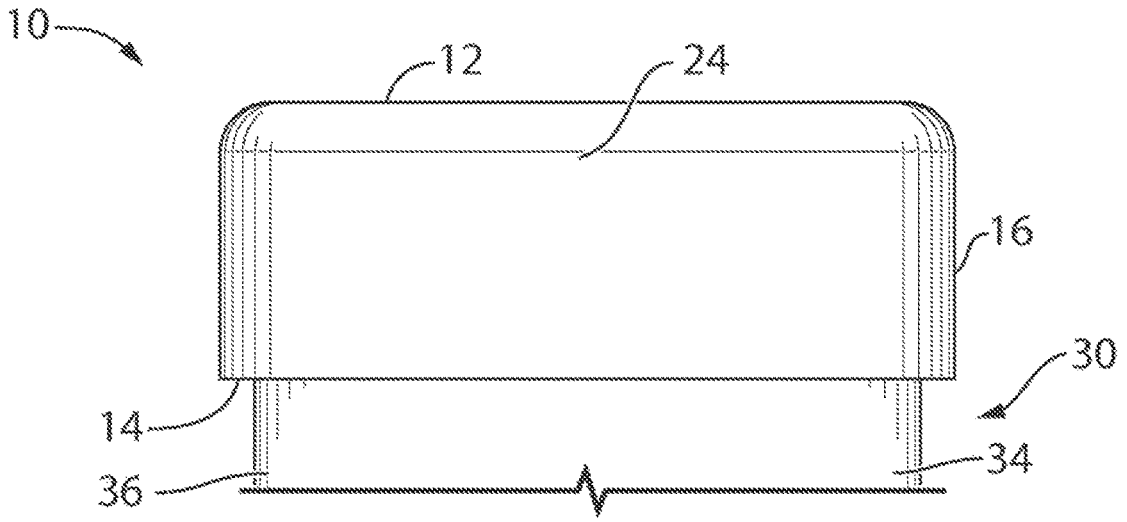
FIG. 17 is a perspective view of a third embodiment of a cap and container embodying the principles of the invention wherein the cap is affixed to the container.
Figure 18:
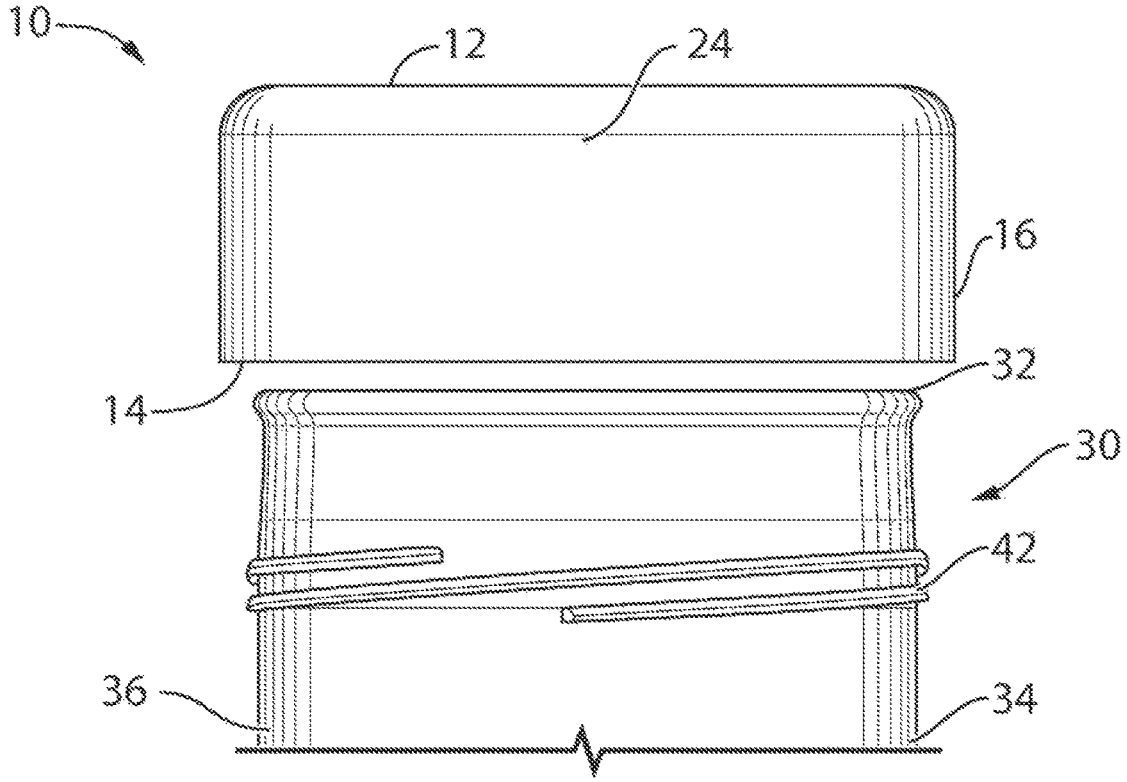
FIG. 18 is a perspective view of the cap and container of the third embodiment wherein the cap has been removed from the container.
Figure 19:
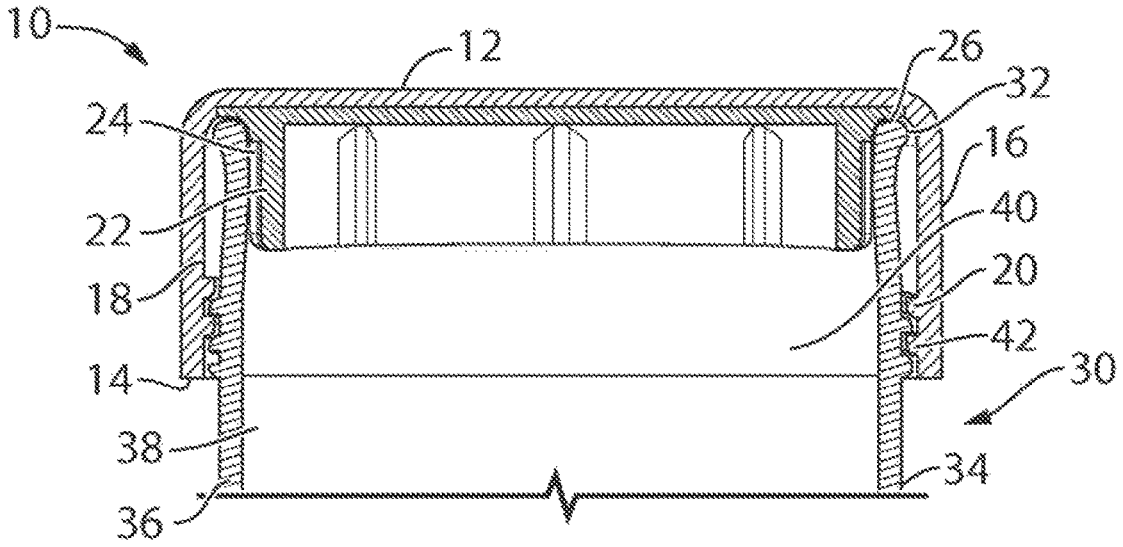
FIG. 19 is a vertical cross-section of the cap and container of the third embodiment illustrating how the dual cap-securing function is provided by the combination of an inside pressure grip and twist threads and shows scallops of the pressure grip which provide venting.

In the second embodiment (FIGS. 9-16) vent holes are provided not in the cap, but in pressure grip 22. Within a ¼ turn or so, the vent holes 24 in the pressure grip will become higher than the level of rim 32. A path of exit for the pressurized gases is thereby provided, as shown in FIG. 13, from inside the container, through the hollow middle of pressure grip 22, out through vent holes 24 in the pressure grip, radially outwards towards the inside sidewall of the cap into an annular space 31 between the inner surface of the cap and rim 32 and into space 33 between the outer surface of container wall 36 and the inside surface of the cap and then out to the atmosphere. Space 33 includes twist threads 42 and 20 which, because the cap has only been turned by about ¼ turn, are still engaged and thus prevent the cap from flying off the container. The twist threads are so configured—by, for example, being sufficiently spaced apart and/or by having cuts in them—that the gas is able to exit out the bottom of the cap. The vent holes in the pressure grip (or, indeed, in the cap for those embodiments having vent holes in the cap) may need to be in more than one line in order to provide a desired degree of venting. The number, size and placement of the vent holes can also be adjusted to this end. In other embodiments, the twist threads might be non-continuous, as is the case for some of the cap-engagement features disclosed in our co-pending patent application Ser. No. 13/240,194 filed Sep. 22, 2011 and Ser. No. 14/029,020, filed Sep. 17, 2013, hereby incorporated by reference. In those embodiments, one would preferably use versions of the engagement features that allow the cap to rise upward as the cap is first twisted in order to achieve the venting just described.

Figure 20:
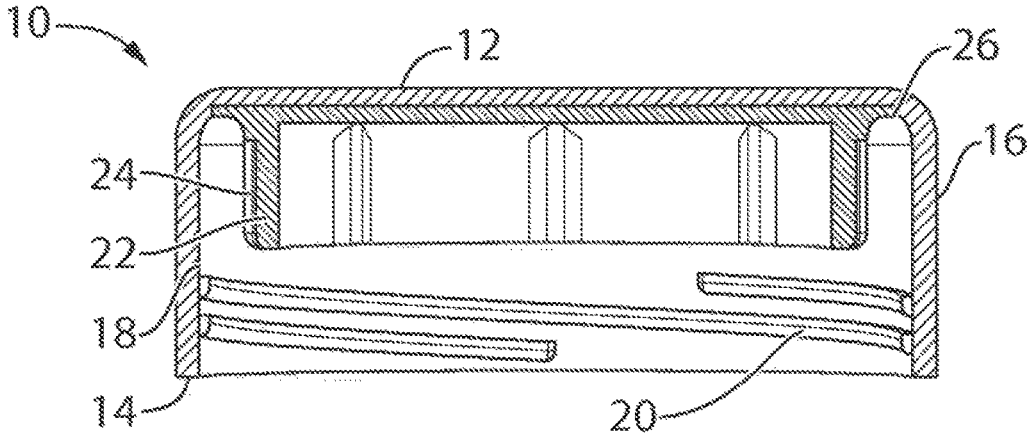
FIG. 20 is a vertical cross-section of just the cap of the third embodiment illustrating its inside pressure grip with its scallops and with the cap's twist threads.
Figure 21:
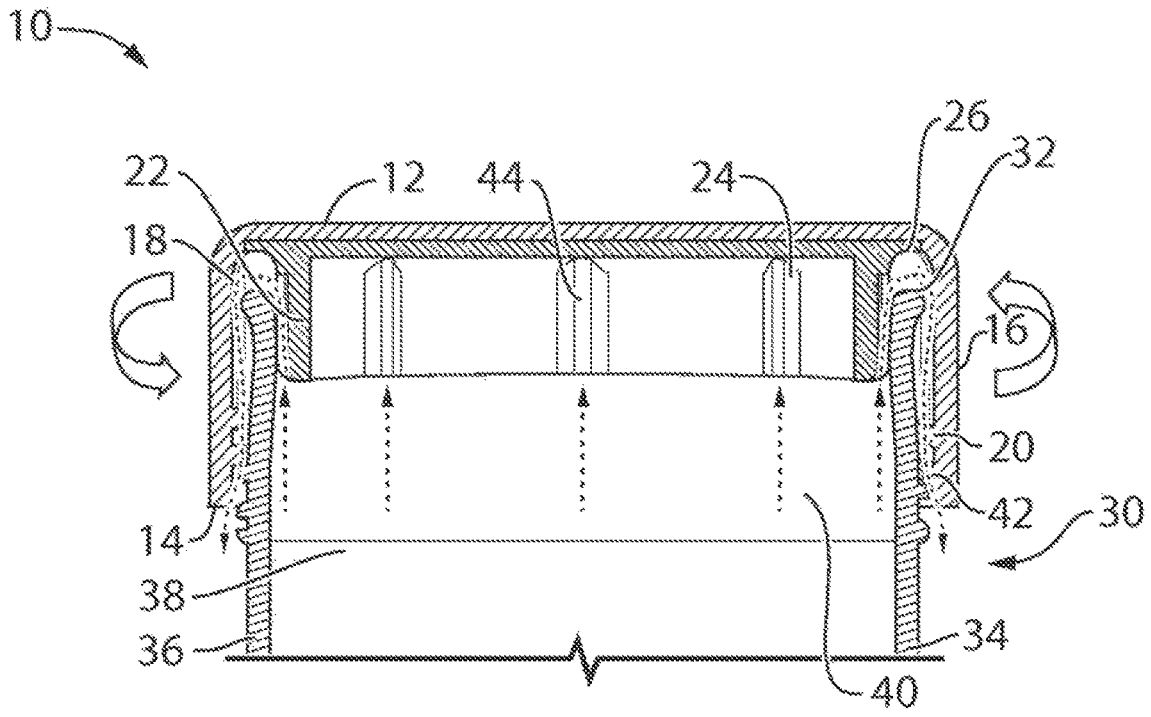
FIG. 21 is a vertical cross-section through the cap and container of the third embodiment, wherein the cap has just been somewhat twisted and gases are releasing through scallops formed in the pressure grip and thence to the atmosphere through the area of the twist threads.
Figure 22:
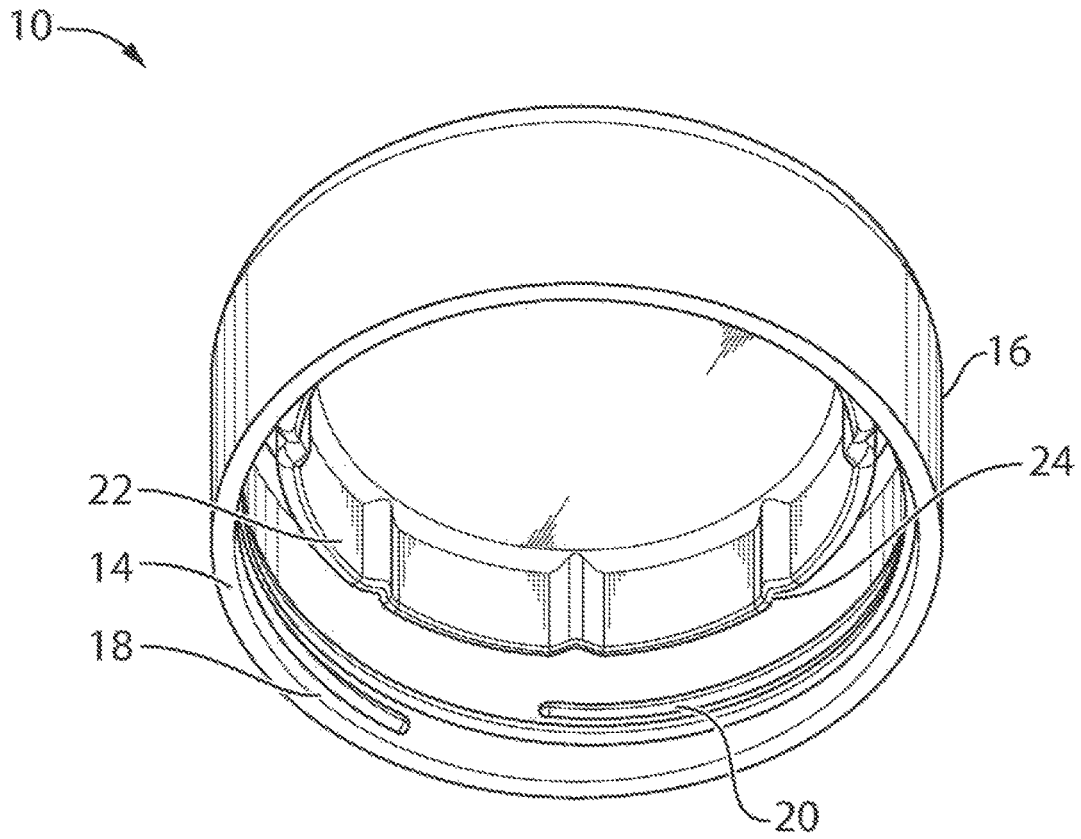
FIG. 22 is a bottom perspective view of the cap of the third embodiment.
Figure 23:
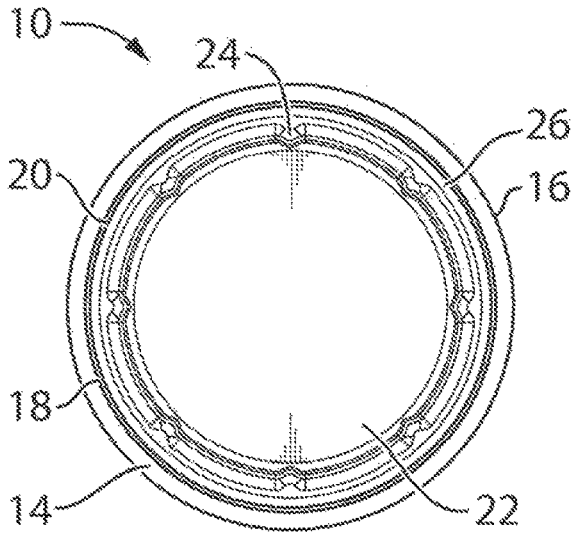
FIG. 23 is a bottom view of the cap of the third embodiment.
Figure 24:
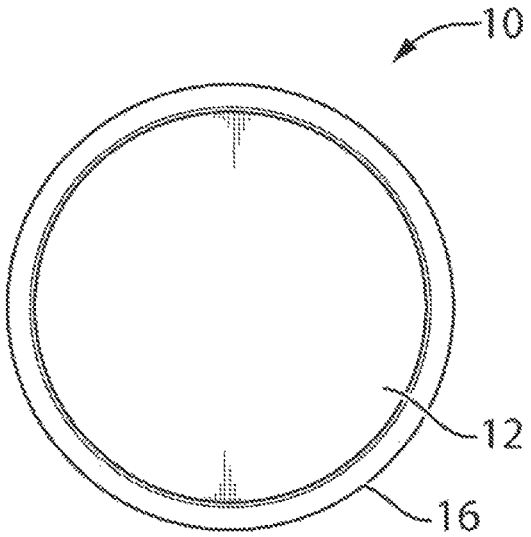
FIG. 24 is a top view of the cap of the third embodiment.
Figure 25:
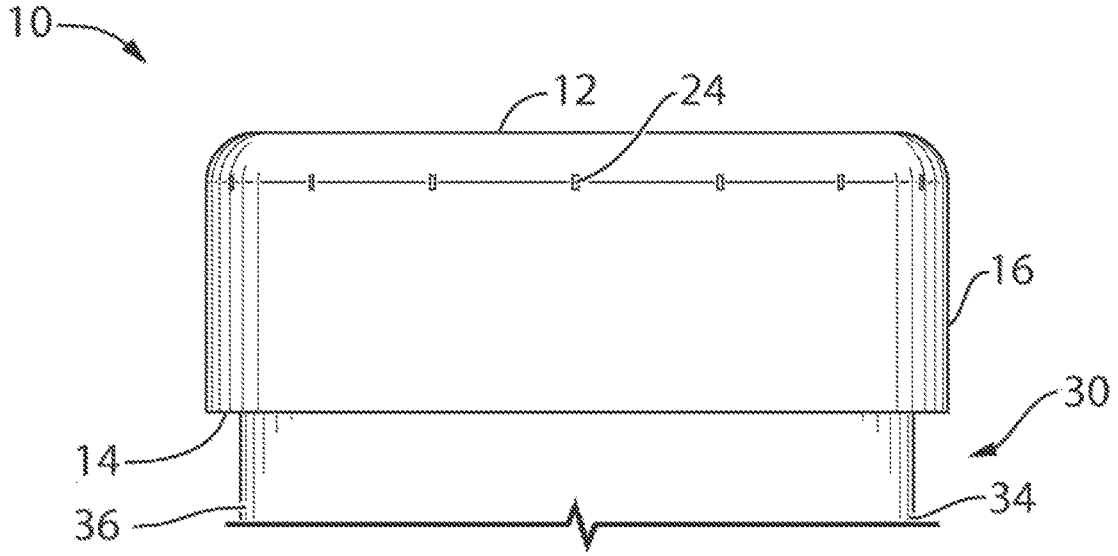
FIG. 25 is a perspective view of a fourth embodiment of a cap and container embodying the principles of the invention wherein the cap is affixed to the container.
Figure 26:
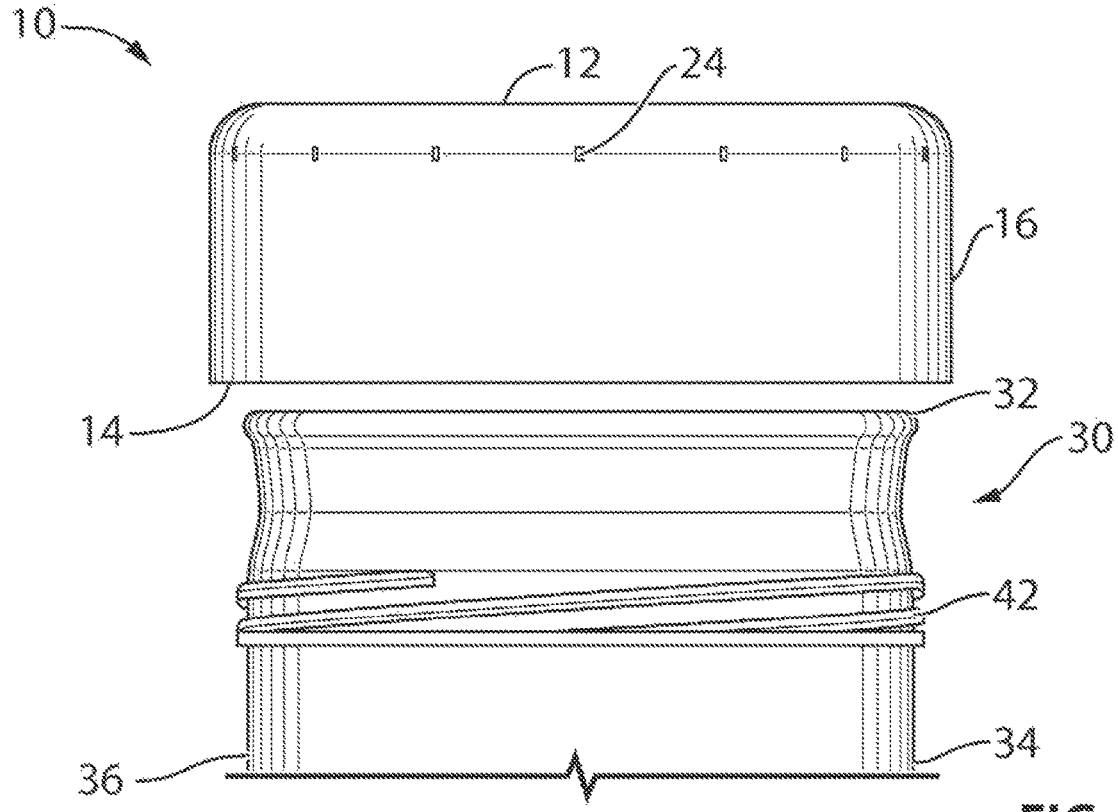
FIG. 26 is a perspective view of the cap and container of the fourth embodiment wherein the cap has been removed from the container.
Figure 27:
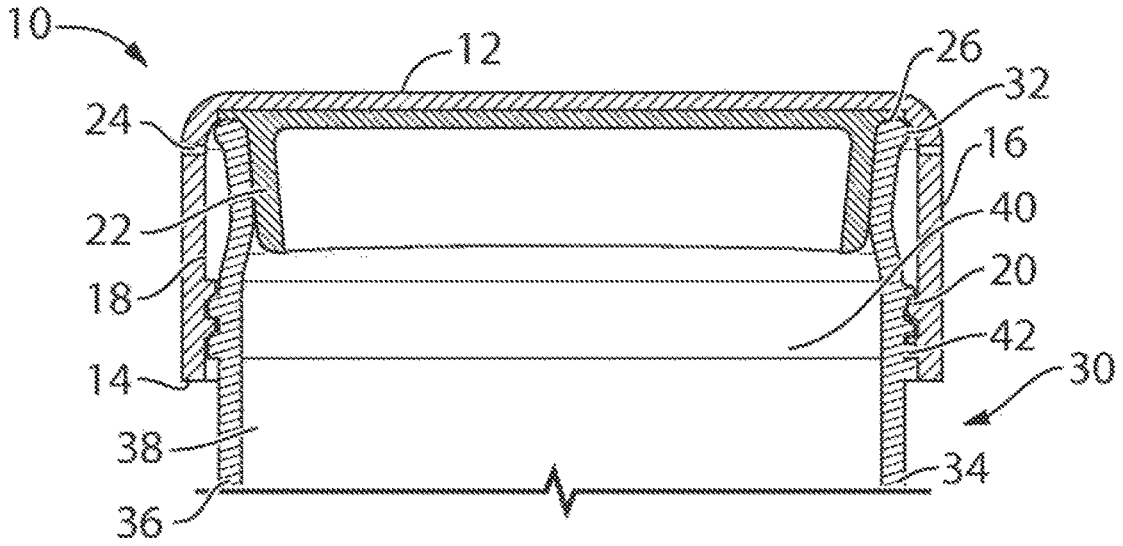
FIG. 27 is a vertical cross-section of the cap and container of the fourth embodiment illustrating how the dual cap-securing function is provided by the combination of an inside pressure grip and twist threads.
Figure 28:
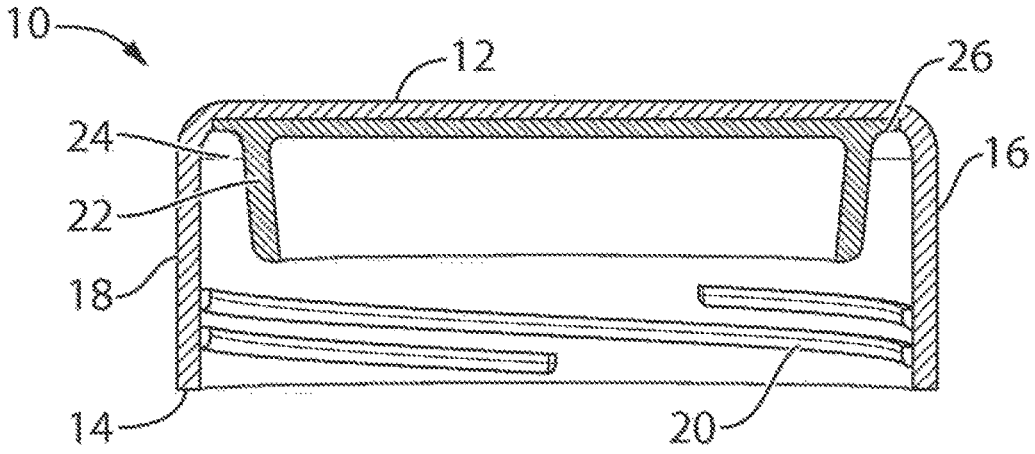
FIG. 28 is a vertical cross-section of just the cap of the fourth embodiment illustrating its pressure grip, twist threads, and release vents in the cap.

In the third embodiment (FIGS. 17-24), as in the second embodiment (FIGS. 9-16), venting is provided via the configuration of pressure grip 22 rather than via vent holes in the cap. Instead of the pressure grip having vent holes, however, as in the second embodiment, the pressure grip of this third embodiment has scallops around the pressure grip periphery which serve as conduits for the gas. The scallops have upper and lower ends in communication with the interior of the container. As the cap is untwisted, the top openings of the scallops are raised and when they reach a level above rim 32, as shown in FIG. 20, a path for gas to escape is provided from inside the container, up through the scallops, radially outwards towards the inside sidewall of the cap, into annular space 31 between the inner surface of the cap and rim 32, over the top of rim 32 and into space 33.

Figure 29:
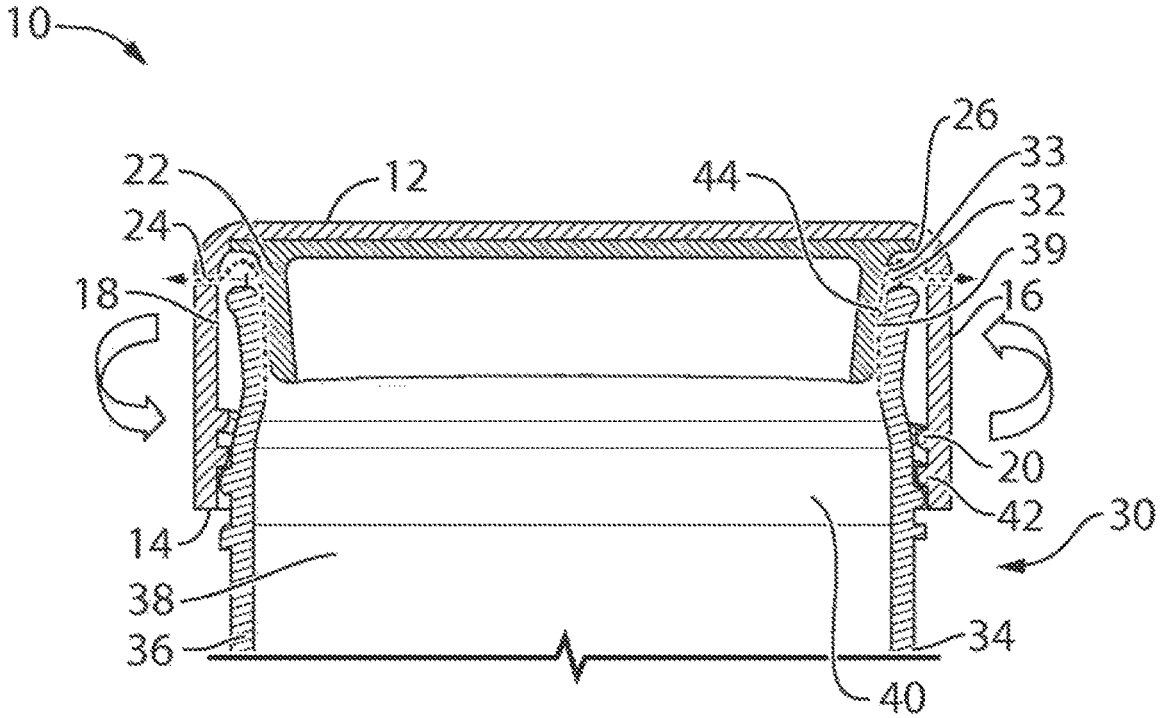
FIG. 29 is a vertical cross-section through the cap and container of the fourth embodiment, wherein the cap has just been somewhat twisted and gases are releasing through vent holes in the cap.
Figure 30:
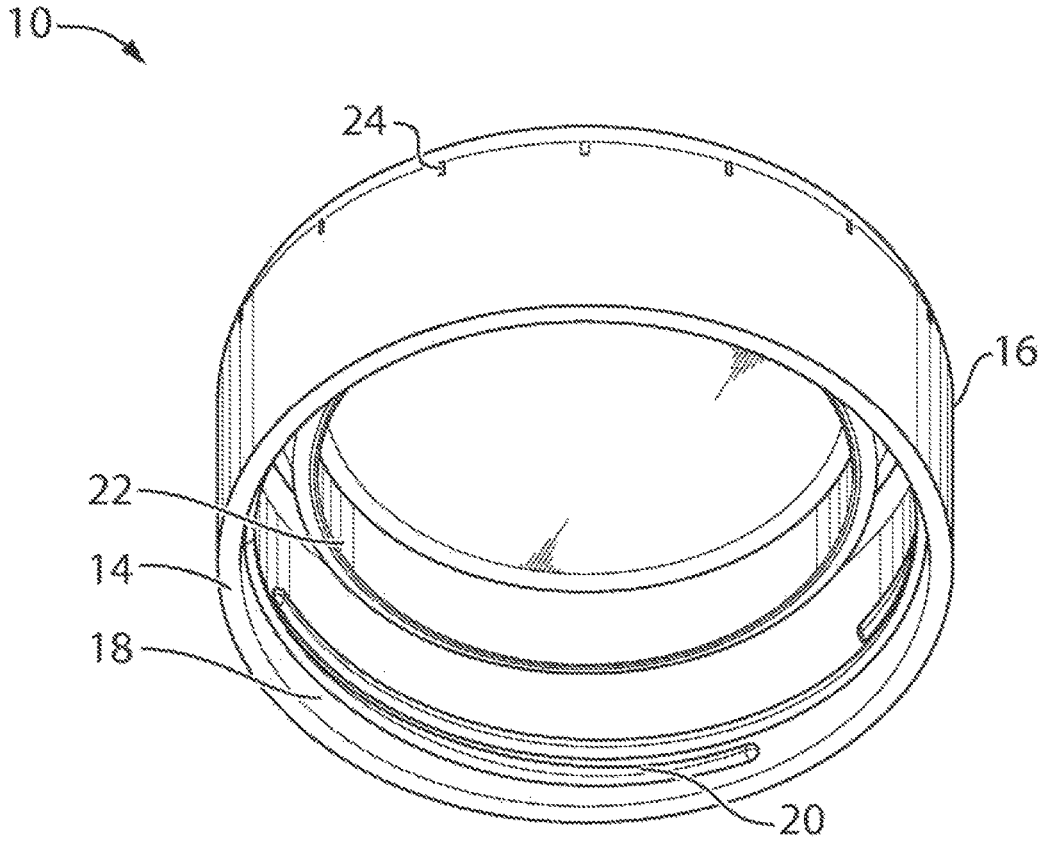
FIG. 30 is a bottom perspective view of the cap of the fourth embodiment.
Figure 31:
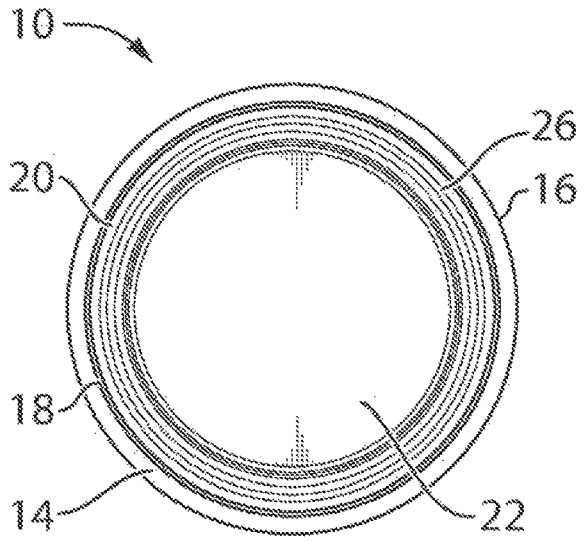
FIG. 31 is a bottom view of the cap of the fourth embodiment.
Figure 32:
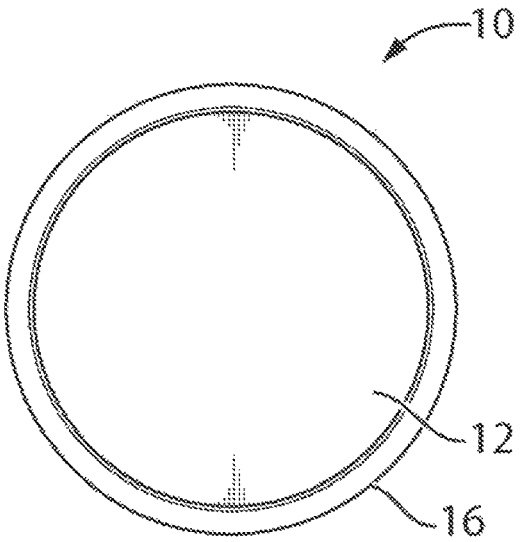
FIG. 32 is a top view of the cap of the fourth embodiment.
Figure 33:
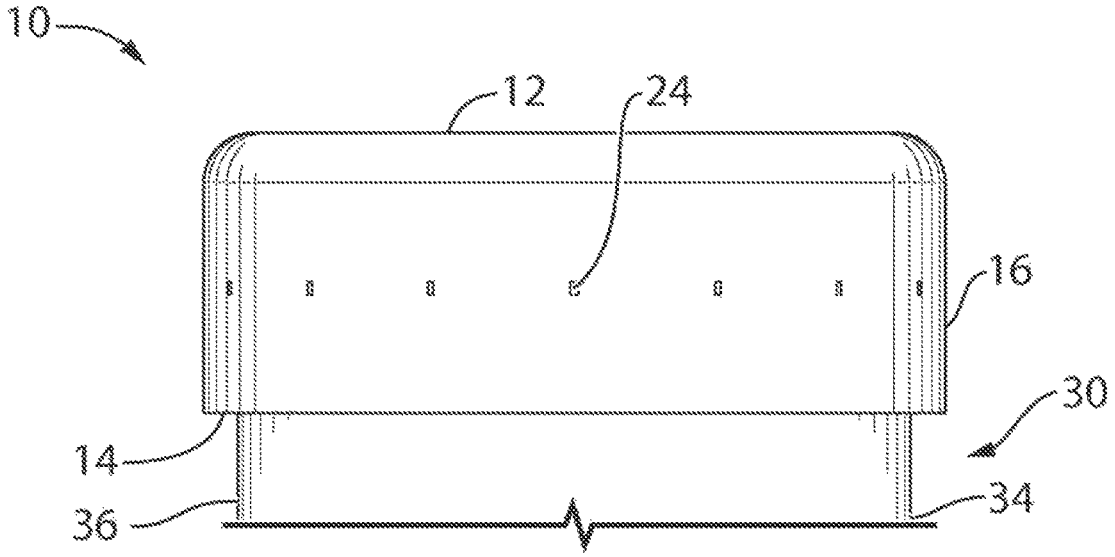
FIG. 33 is a perspective view of a fifth embodiment of a cap and container embodying the principles of the invention wherein the cap is affixed to the container.
Figure 34:
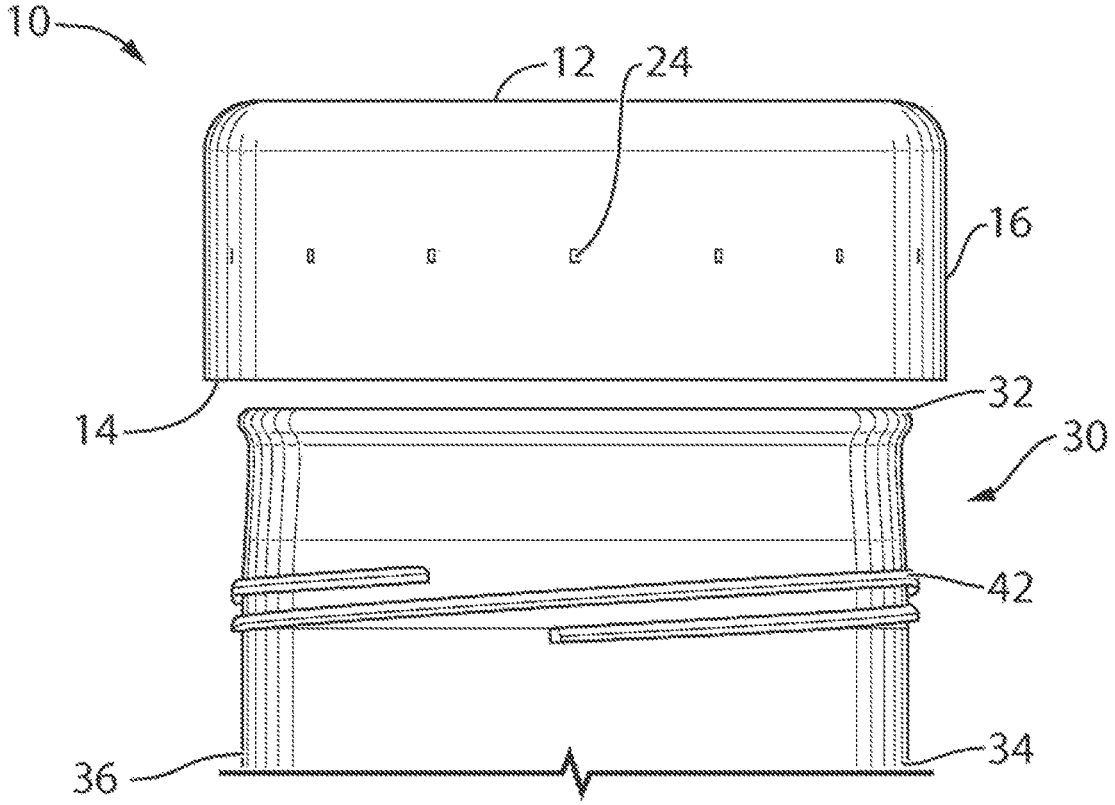
FIG. 34 is a perspective view of the cap and container of the fifth embodiment wherein the cap has been removed from the container.
Figure 35:
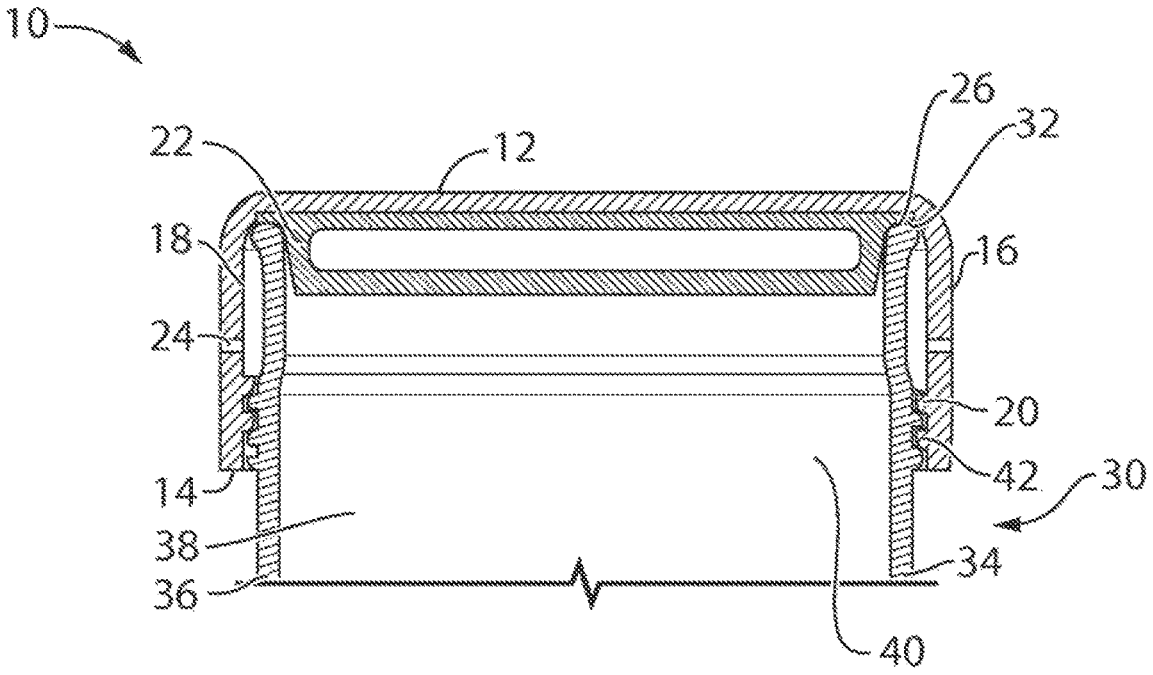
FIG. 35 is a vertical cross-section of the cap and container of the fifth embodiment illustrating how the dual cap-securing function is provided by the combination of an inside pressure grip and twist threads.
Figure 36:
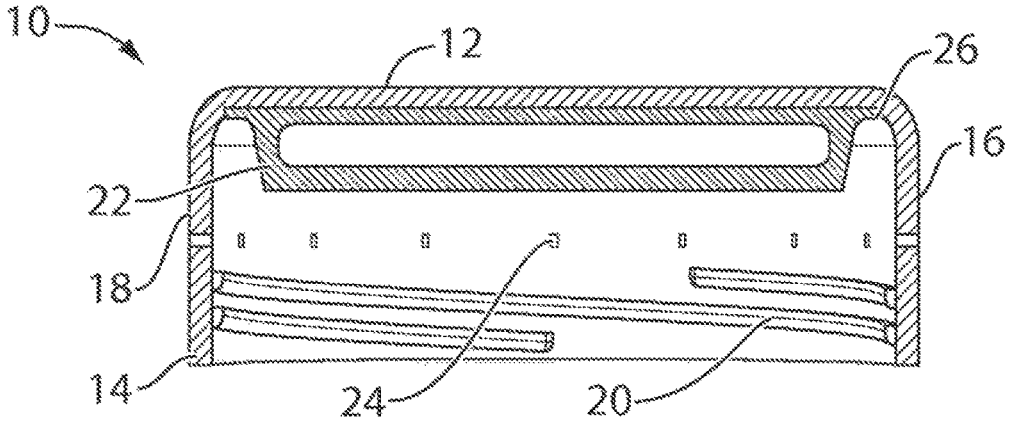
FIG. 36 is a vertical cross-section of just the cap of the fifth embodiment illustrating its pressure grip, twist threads, and release vents in the cap.

In the fourth embodiment (FIGS. 25-32), venting is again provided via the configuration of pressure grip 22 but here, it is provided in combination with vent holes in the cap. Specifically, what is relied on is a stepped or tapered shape for the pressure grip, wherein a lower portion of the pressure grip is spaced apart from the container inner wall. As the cap is untwisted, a space is created that includes a) annular space 31 between the inner surface of the cap and rim 32 and b) a generally ring-like space 39 between the outside surface of the pressure grip and the inner surface of the container sidewall, the latter space being due to the tapered or stepped nature of the pressure grip. A passageway for gas is thus created, as seen in FIG. 29, from within the container, into space 39, thence into space 31, then out the vent holes in the cap.

Figure 37:
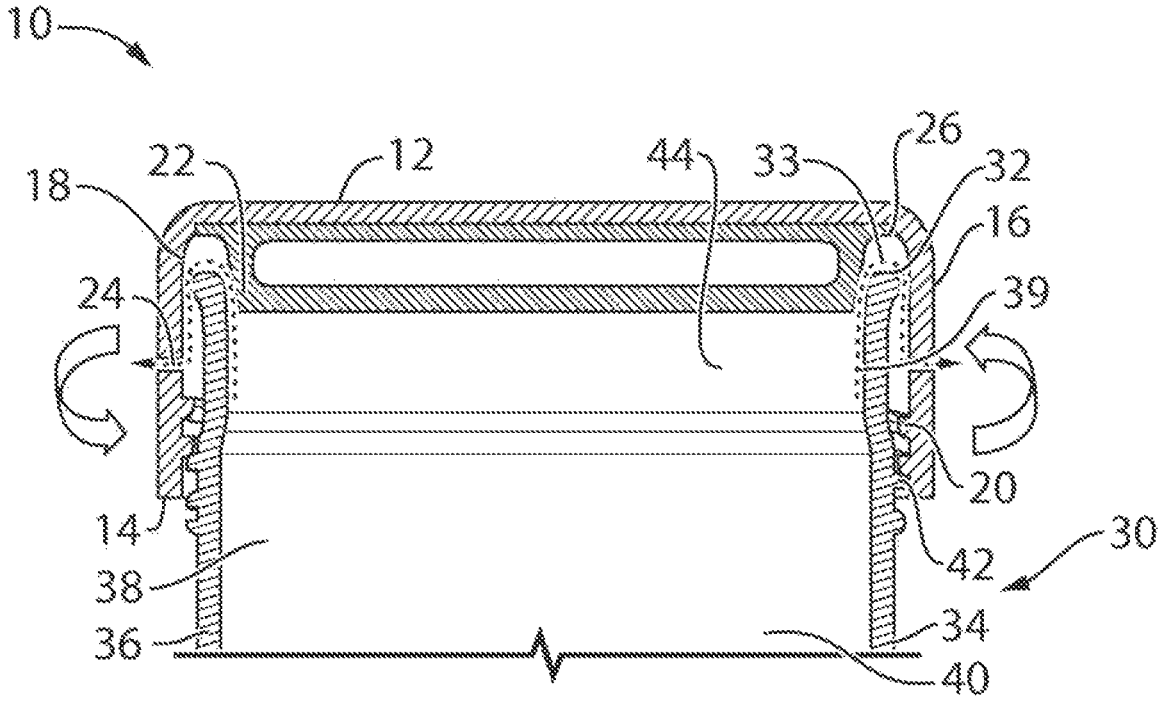
FIG. 37 is a vertical cross-section through the cap and container of the fifth embodiment, wherein the cap has just been somewhat twisted and gases are releasing through vent holes in the cap.
Figure 38:
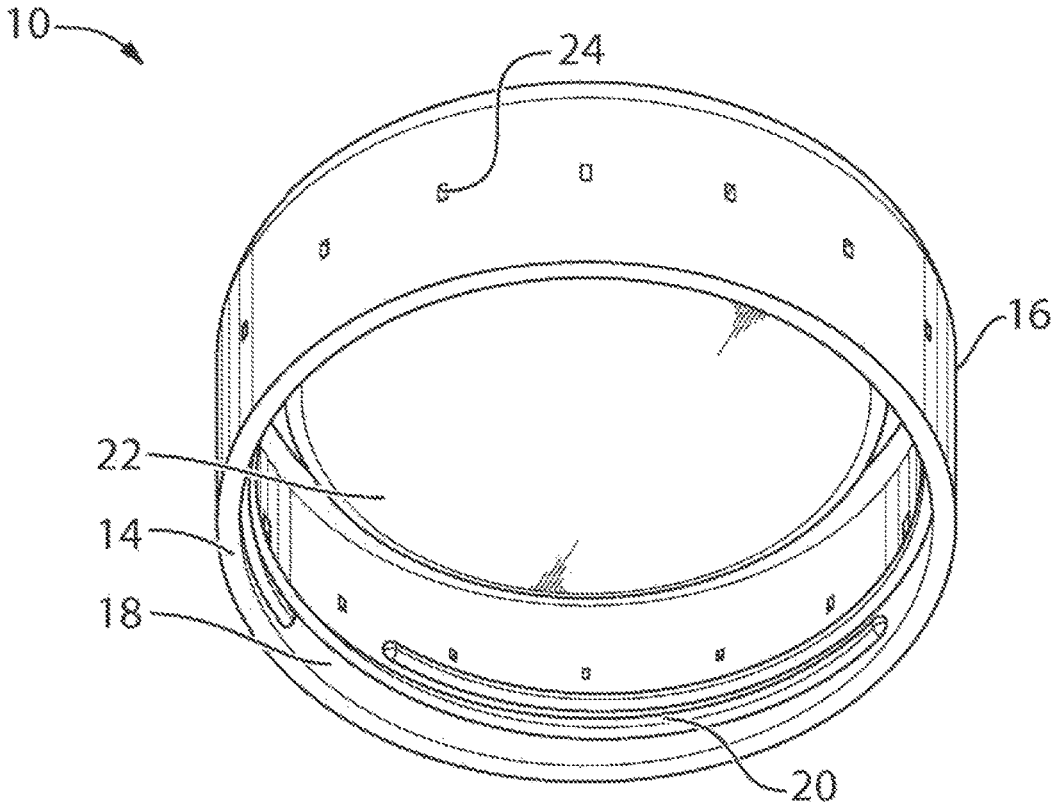
FIG. 38 is a bottom perspective view of the cap of the fifth embodiment.
Figure 39:
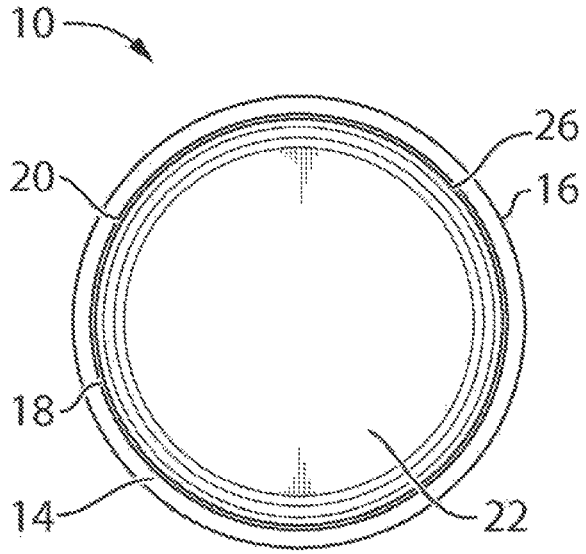
FIG. 39 is a bottom view of the cap of the fifth embodiment.
Figure 40:
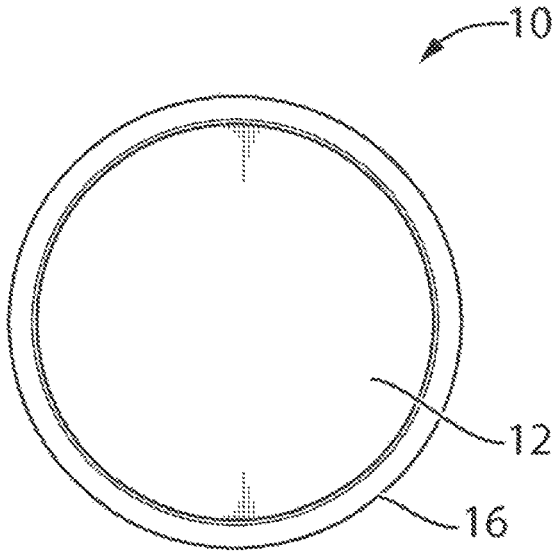
FIG. 40 is a top view of the cap of the fifth embodiment.
Figure 41:
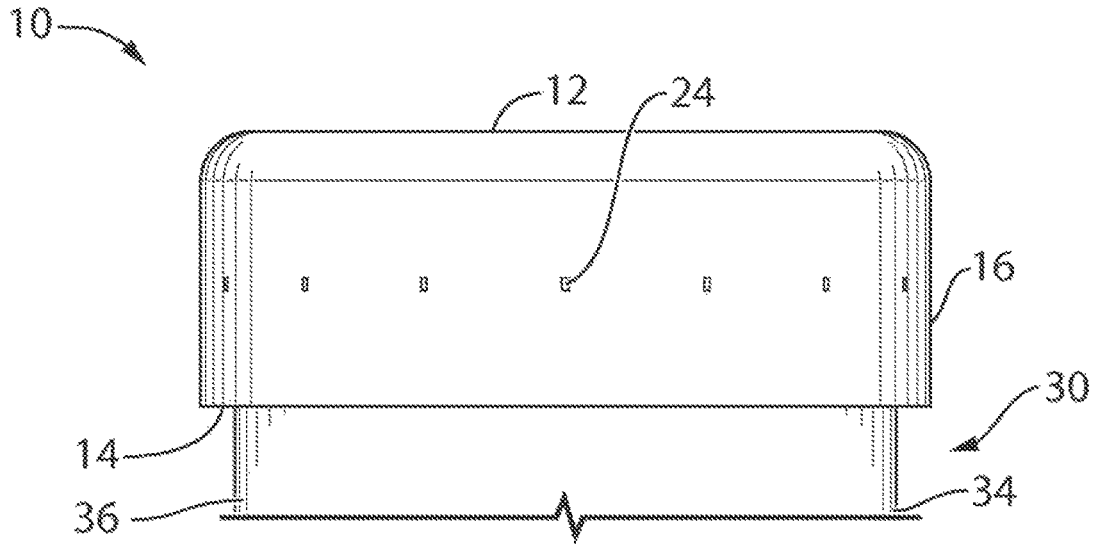
FIG. 41 is a perspective view of a sixth embodiment of a cap and container embodying the principles of the invention wherein the cap is affixed to the container.
Figure 42:
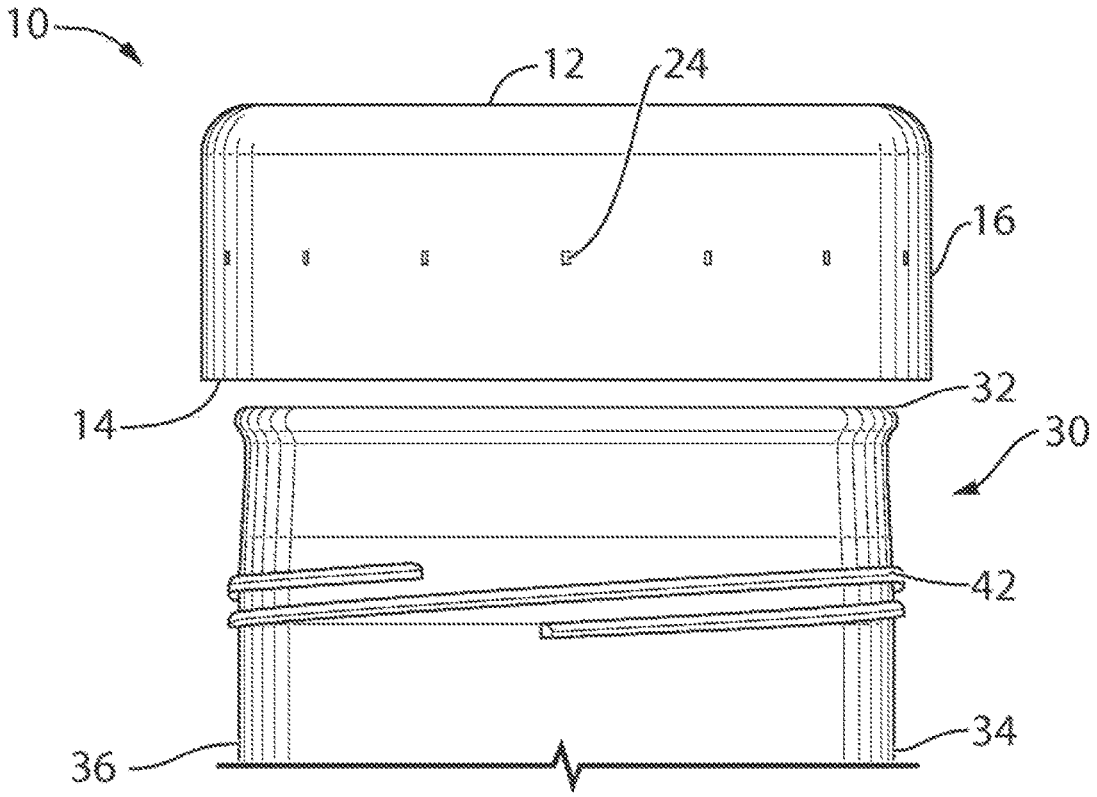
FIG. 42 is a perspective view of the cap and container of the sixth embodiment wherein the cap has been removed from the container.
Figure 43:
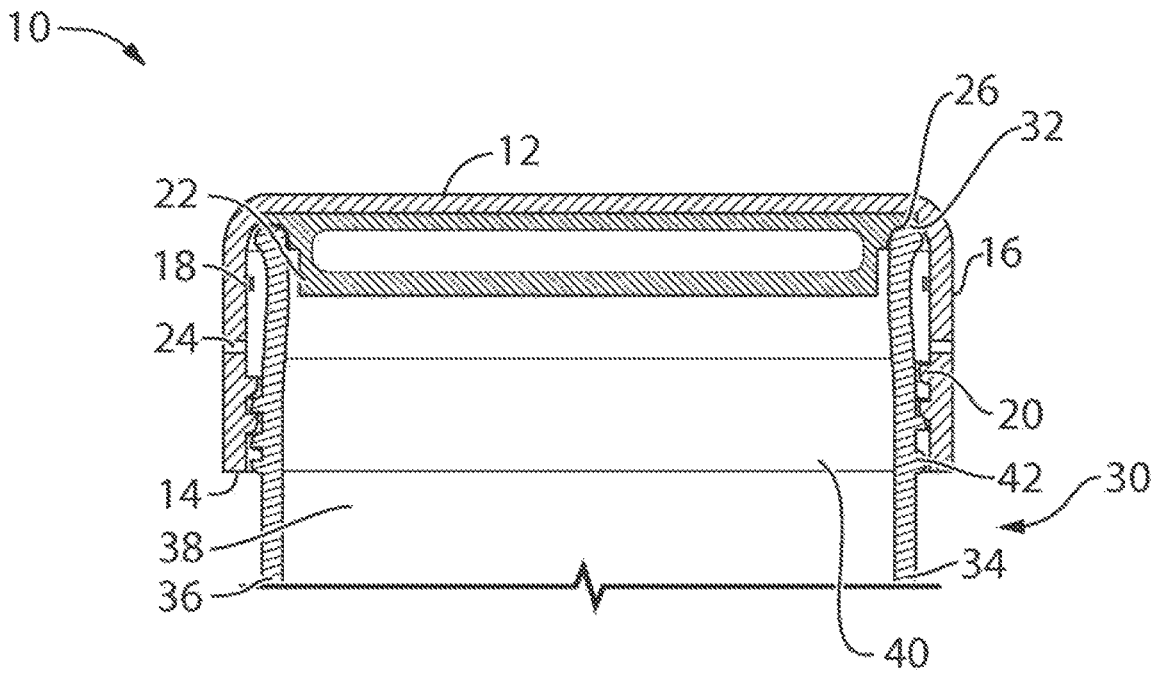
FIG. 43 is a vertical cross-section of the cap and container of the sixth embodiment illustrating how the dual cap-securing function is provided by the combination of an inside pressure grip and twist threads.
Figure 44:
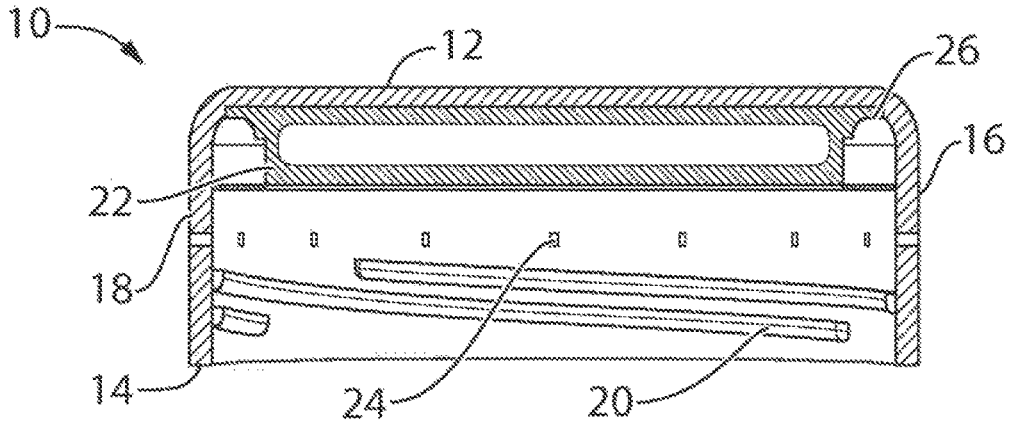
FIG. 44 is a vertical cross-section of just the cap of the sixth embodiment illustrating its pressure grip, twist threads, and release vents in the cap.

In the fifth embodiment (FIGS. 33-40), inner pressure grip 22 is in the form of a puck. Specifically, as shown in FIG. 37, the puck-type pressure grip is stepped or tapered and venting is provided similarly to the way in which it is provided in the fourth embodiment (FIGS. 25-32).

Figure 45:
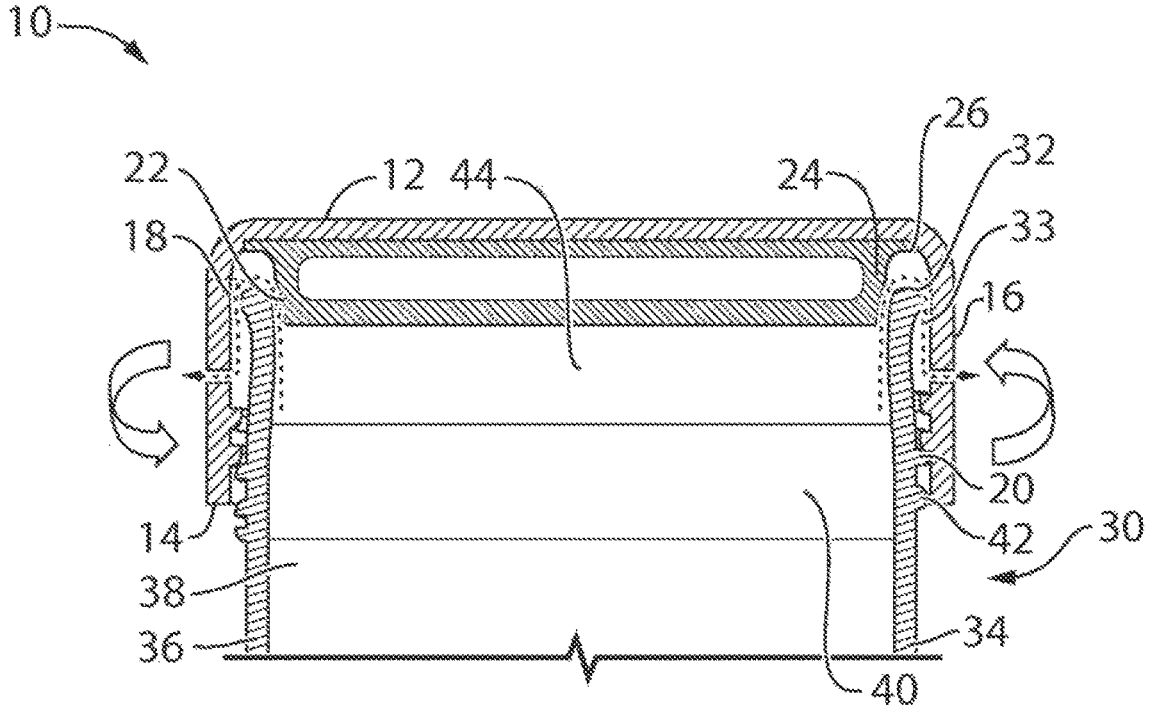
FIG. 45 is a vertical cross-section through the cap and container of the sixth embodiment, wherein the cap has just been somewhat twisted and gases are releasing through vent holes in the cap.
Figure 46:
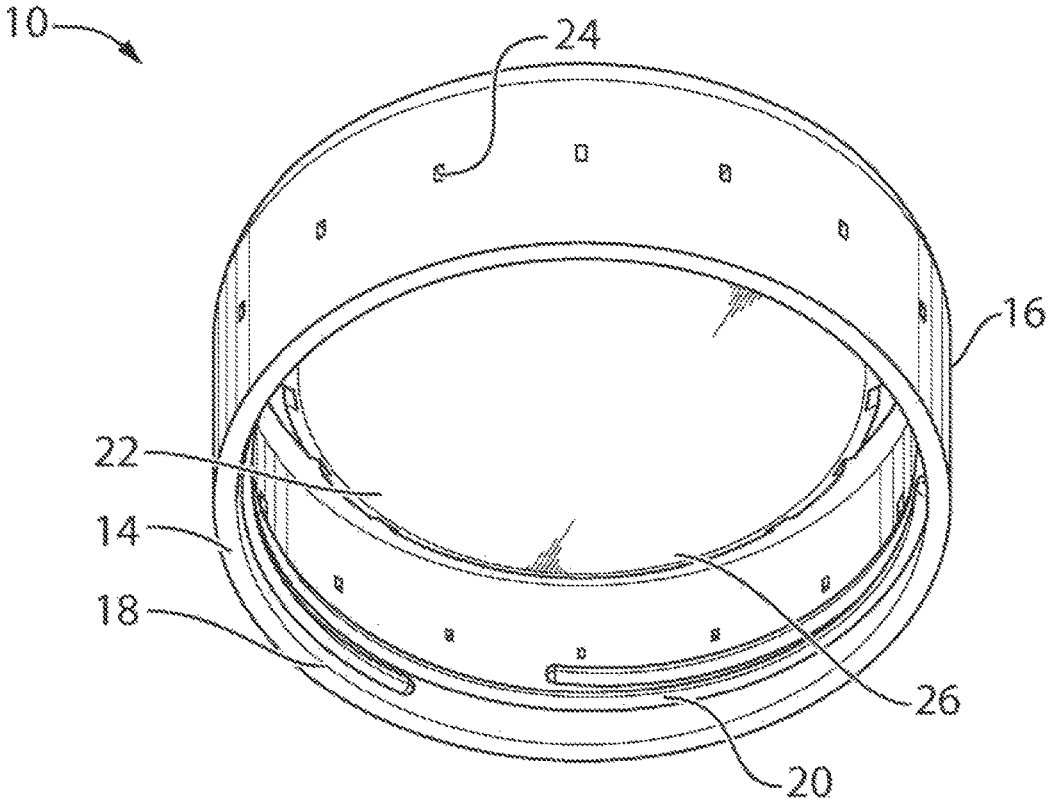
FIG. 46 is a bottom perspective view of the cap of the sixth embodiment.
Figure 47:
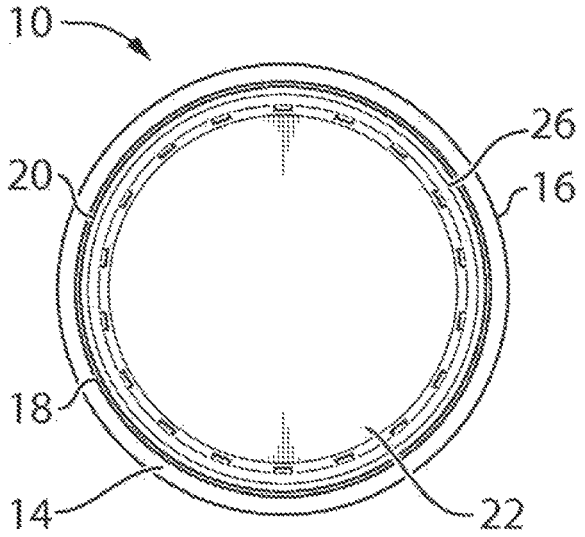
FIG. 47 is a bottom view of the cap of the sixth embodiment.
Figure 48:
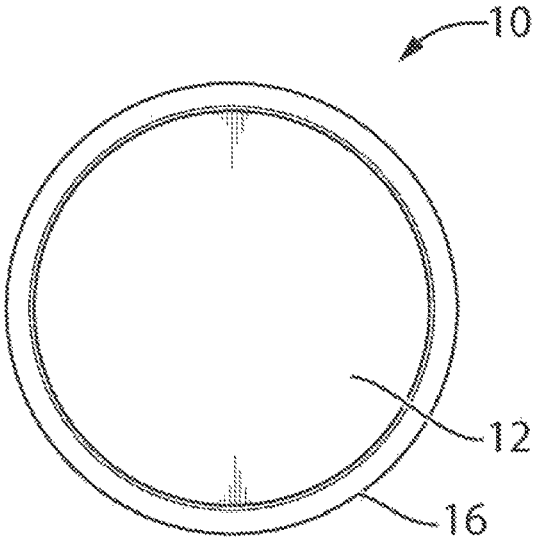
FIG. 48 is a top view of the cap of the sixth embodiment.
Figure 49:
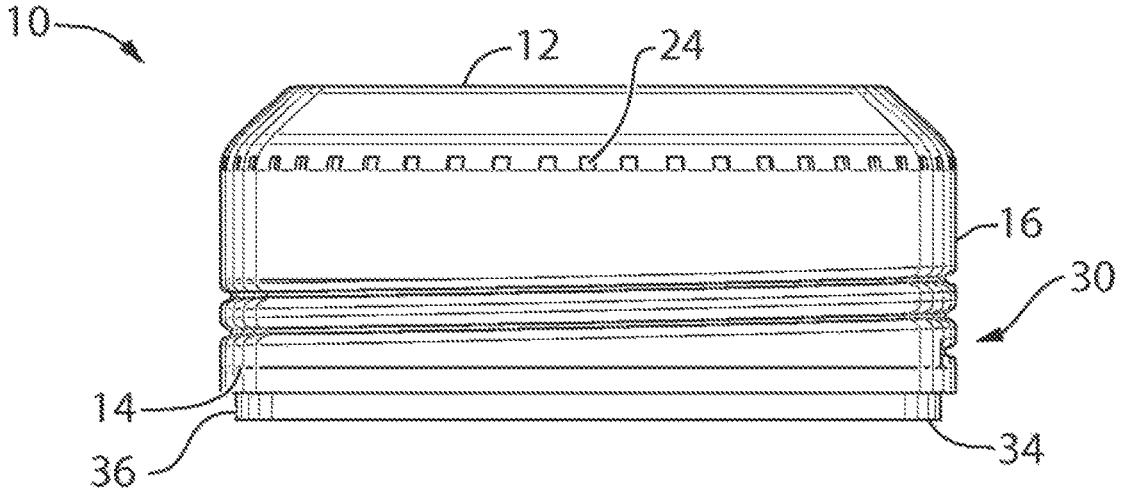
FIG. 49 is a perspective view of a seventh embodiment of a cap and container embodying the principles of the invention wherein the cap is affixed to the container.
Figure 50:
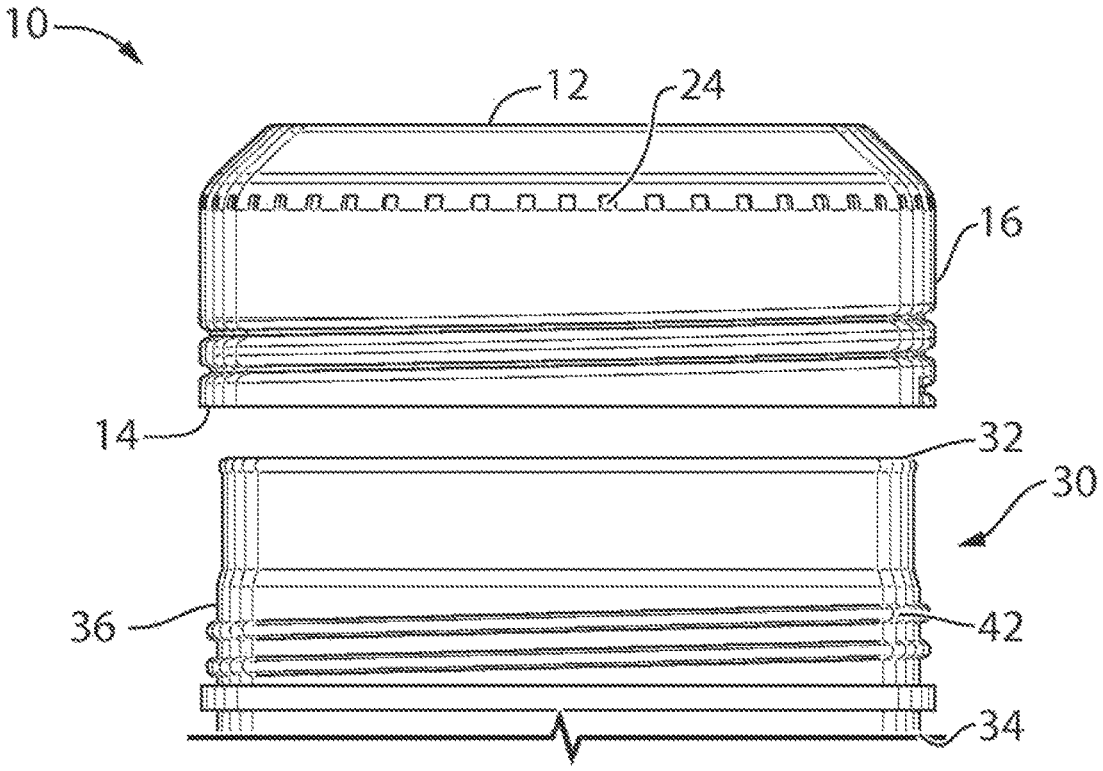
FIG. 50 is a perspective view of the cap and container of the seventh embodiment wherein the cap has been removed from the container.
Figure 51:
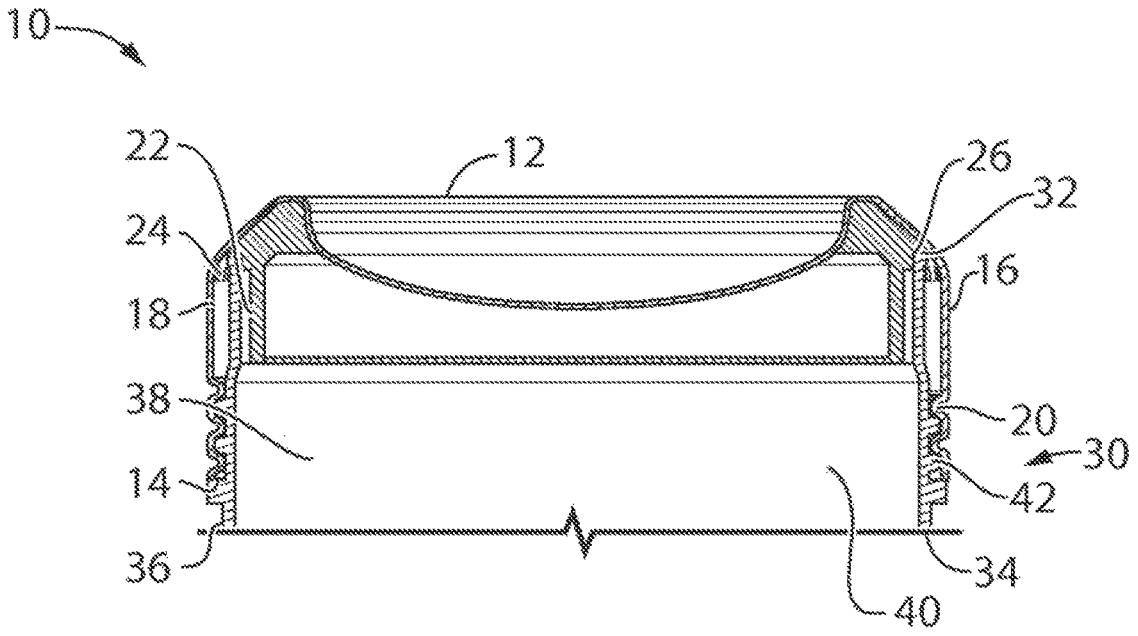
FIG. 51 is a vertical cross-section of the cap and container of the seventh embodiment illustrating how the dual cap-securing function is provided by the combination of an inside pressure grip and twist threads and further showing that the cap domes inward.
Figure 52:
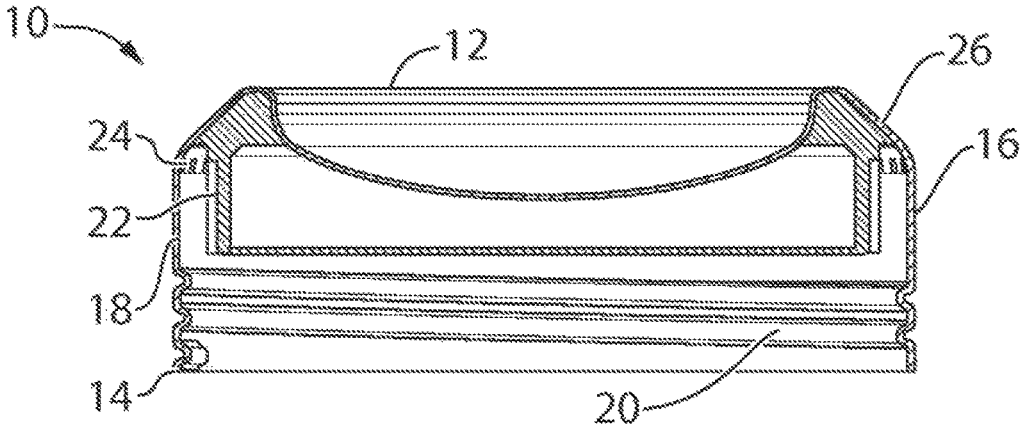
FIG. 52 is a vertical cross-section of just the cap of the seventh embodiment illustrating its inside pressure grip, twist threads and release vents in the inward-doming cap.
Figure 53:
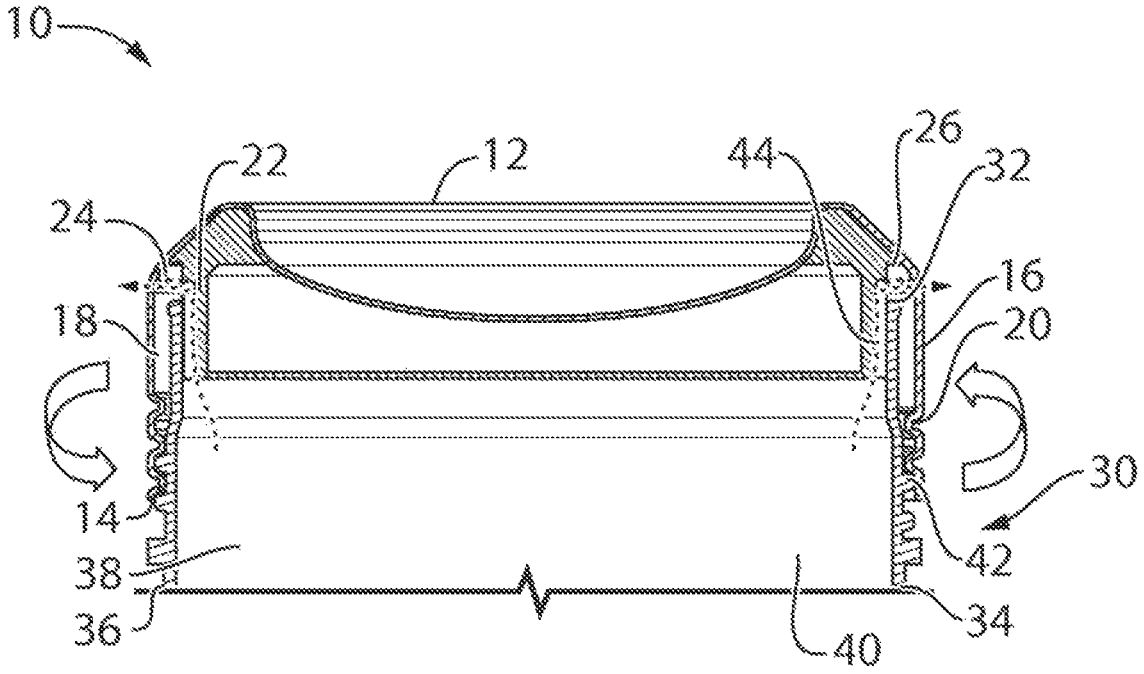
FIG. 53 is a vertical cross-section through the cap and container of the seventh embodiment, wherein the cap has just been somewhat twisted and gases are releasing through the vent holes in the cap.
Figure 54:
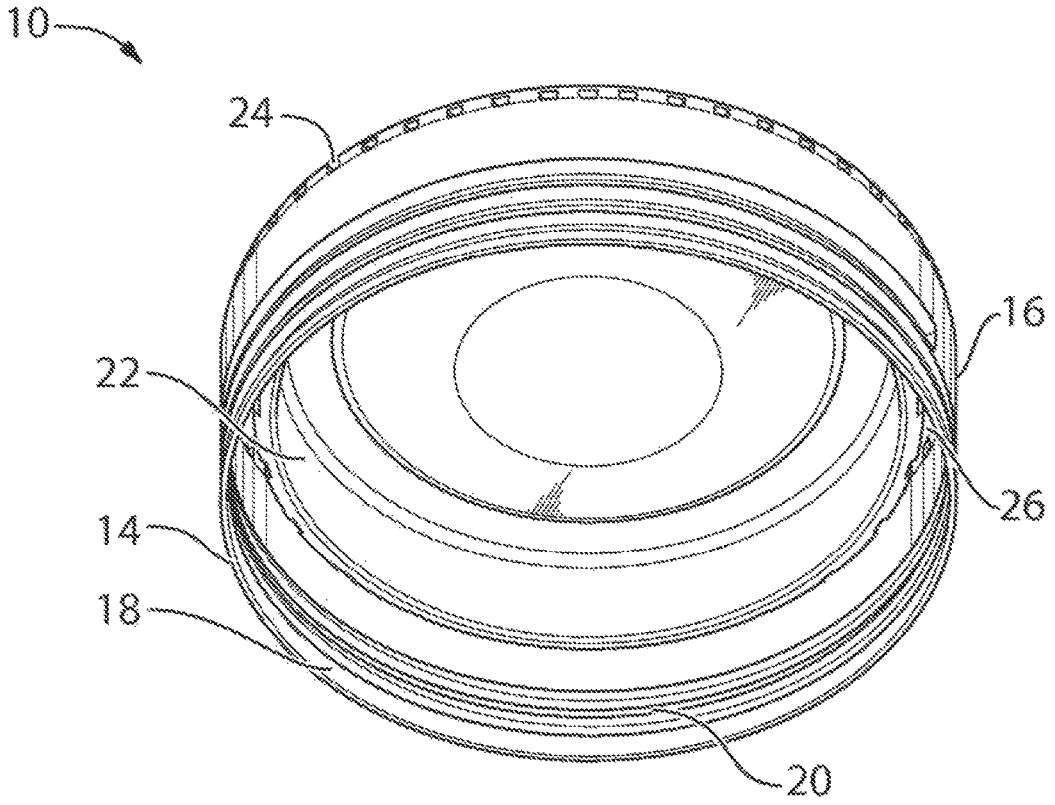
FIG. 54 is a bottom perspective view of the cap of the seventh embodiment.
Figure 55:
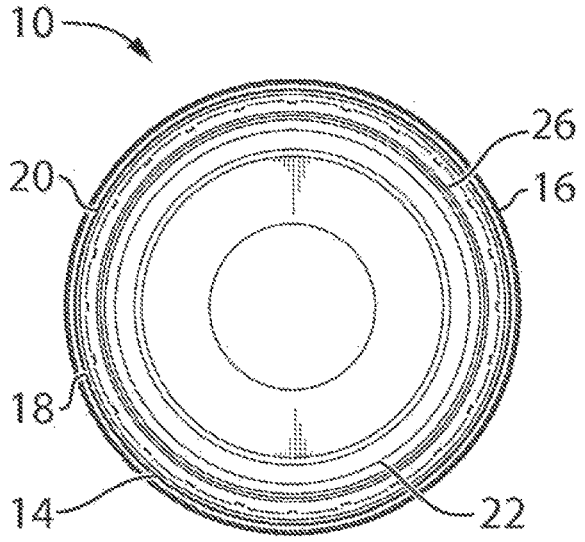
FIG. 55 is a bottom view of the cap of the seventh embodiment.
Figure 56:
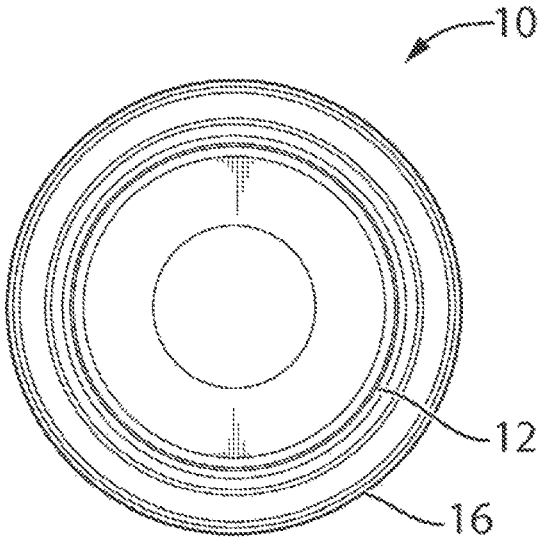
FIG. 56 is a top view of the cap of the seventh embodiment.

In the sixth embodiment (FIGS. 41-48), inner pressure grip 22 is again in the form of a puck. Here, however, the puck is not tapered and venting is provided similarly to the way in which it is provided in the third embodiment (FIGS. 17-24)—in the form of side vents, or channels 24. The path for gases is as shown in FIG. 45.

In either of the fifth and sixth embodiments (FIGS. 33-40 and 41-48), the puck may be gas-filled to achieve the desired level of pressure between the puck and the container wall. Moreover, the size and spacing of the puck side vents 24 can be chosen in such a way as to achieve a desirable level of pressure by the puck against the container sidewall. There needs to be enough pressure for the puck—in conjunction with the twist threads—to secure the cap while having that pressure be such that the torque required by the consumer to remove the cap is at a commercially acceptable level. The wider (narrower) the side vents, the less (more) friction is provided between the puck and the container wall and, thus, the lower (higher) the puck/container pressure.

There are a number of advantages to the venting-through-the-pressure-grip embodiments, i.e. the second, third, eighth, ninth, twelfth, thirteenth, fourteenth, and fifteenth embodiments—FIGS. 9-16, 17-24, 57, 58, 61-65, 66-71, 72-76, and 77-81, respectively. In those embodiments, gases hit a solid barrier—namely the inside of the cap—when the cap is first raised, which acts as a shield to the consumer. This can also diffuse the force of any spray continuing in a downward direction toward the consumer's hand out the bottom of the cap. With no spray coming out near the top of the cap, there may well be no need for a cloth or towel to protect the hand from spray. The absence of holes in the cap may, in addition, be an advantage in manufacturing.

In the seventh embodiment (FIGS. 49-56), venting is provided via the configuration of pressure grip 22 in combination with vent holes in the cap, as in the fourth embodiment (FIGS. 25-32). Here, however, the cap is manufactured with an inward dome (i.e. at least a portion of the top surface of the cap is concave as viewed from the cap top, like the bottom of an aluminum beer/soda can) in order to help prevent the cap top bulging out under pressure. Indeed, we envision that a cap of this type would be made of aluminum or some other metal. There would be a greater tendency toward such bulging if a cap top of similar thickness were to be a large flat area, which would lead to the need for a thicker cap which, of course, increases its cost and weight. Such bulging or other distortion of the cap could cause the twist threads to slip and become disengaged. Such doming could be manufactured into the caps of many of the other disclosed embodiments.

In embodiments where, it might be commercially impractical to dome the cap inward, we envision making the cap thick enough or of composite materials to prevent the cap from bulging.

Our venting arrangements wherein the pressure grip is configured to provide, or allow for, part of the venting, as just described, can be implemented without the pressure grip providing much, if any, friction against the container wall. This might be the case if it were found that—for a given container configuration and/or amount of pressure within the container—the cap could be satisfactorily held with just twist threads, for example. The pressure grip would, in such a case, not be a pressure grip, per se, but only a vehicle for venting.

Tables 1 through 4 provide some numerical illustrations. The computations shown are estimates based on information at hand, but well demonstrate the effectiveness of the present invention in permitting the containerization of soda, beer, sparkling wine or other contents under pressure for consumer sale in containers having significantly wider openings than has been achieved by the industry to this point.

Table 1, in particular, shows how much of a contribution to the holding force is needed to be provided by the pressure grip for various container opening sizes assuming an internal pressure of 30 psi—the typical pressure for beer.

TABLE 1

| BEER (twist cap) 30 PSI | | | | | | | | | | | | |
|---|---|---|---|---|---|---|---|---|---|---|---|---|
| Container | | | | | Cap | | | | Grip Holding Force | | | |
| Cap OD (mm) A | Opening Diameter (mm) B | Opening Radius ID (in) C | Opening Area (Sq. in) D | Opening Circum-ference (in) E | Threads Holding Force (lb) F | Internal Force on cap (lb) G | Force needed from grip (lb) H | Grip percentage I | Grip I (lb) J | Grip II (lb) K | Grip III (lb) L | Grip IV (lb) M |
| 38 | 30.5 | 0.60 | 1.13 | 3.77 | 34 | 34 | 0 | 0% | 40 | 20 | 60 | 30 |
| 39 | 31.5 | 0.62 | 1.21 | 3.90 | 35 | 36 | 1 | 3% | 41 | 21 | 62 | 31 |
| 40 | 32.5 | 0.64 | 1.29 | 4.02 | 36 | 39 | 2 | 6% | 43 | 21 | 64 | 32 |
| 41 | 33.5 | 0.66 | 1.37 | 4.14 | 37 | 41 | 4 | 9% | 44 | 22 | 66 | 33 |
| 42 | 34.5 | 0.68 | 1.45 | 4.27 | 38 | 43 | 5 | 12% | 45 | 23 | 68 | 34 |
| 43 | 35.5 | 0.70 | 1.53 | 4.39 | 40 | 46 | 6 | 14% | 47 | 23 | 70 | 35 |
| 44 | 36.5 | 0.72 | 1.62 | 4.51 | 41 | 49 | 8 | 16% | 48 | 24 | 72 | 36 |
| 45 | 37.5 | 0.74 | 1.71 | 4.64 | 42 | 51 | 10 | 19% | 49 | 25 | 74 | 37 |
| 46 | 38.5 | 0.76 | 1.80 | 4.76 | 43 | 54 | 11 | 21% | 51 | 25 | 76 | 38 |
| 47 | 39.5 | 0.78 | 1.90 | 4.89 | 44 | 57 | 13 | 23% | 52 | 26 | 78 | 39 |
| 48 | 40.5 | 0.80 | 2.00 | 5.01 | 45 | 60 | 15 | 25% | 53 | 27 | 80 | 40 |
| 49 | 41.5 | 0.82 | 2.10 | 5.13 | 46 | 63 | 17 | 27% | 55 | 27 | 82 | 41 |
| 50 | 42.5 | 0.84 | 2.20 | 5.26 | 47 | 66 | 19 | 28% | 56 | 28 | 84 | 42 |
| 51 | 43.5 | 0.86 | 2.30 | 5.38 | 48 | 69 | 21 | 30% | 57 | 29 | 86 | 43 |
| 52 | 44.5 | 0.88 | 2.41 | 5.50 | 50 | 72 | 23 | 31% | 59 | 29 | 88 | 44 |
| 53 | 45.5 | 0.90 | 2.52 | 5.63 | 51 | 76 | 25 | 33% | 60 | 30 | 90 | 45 |
| 54 | 46.5 | 0.92 | 2.63 | 5.75 | 52 | 79 | 27 | 34% | 61 | 31 | 92 | 46 |
| 55 | 47.5 | 0.94 | 2.75 | 5.88 | 53 | 82 | 29 | 36% | 62 | 31 | 94 | 47 |
| 56 | 48.5 | 0.95 | 2.86 | 6.00 | 54 | 86 | 32 | 37% | 64 | 32 | 96 | 48 |
| 57 | 49.5 | 0.97 | 2.98 | 6.12 | 55 | 89 | 34 | 38% | 65 | 33 | 98 | 49 |
| 58 | 50.5 | 0.99 | 3.10 | 6.25 | 56 | 93 | 37 | 40% | 66 | 33 | 100 | 50 |
| 59 | 51.5 | 1.01 | 3.23 | 6.37 | 57 | 97 | 39 | 41% | 68 | 34 | 102 | 51 |
| 60 | 52.5 | 1.03 | 3.36 | 6.49 | 58 | 101 | 42 | 42% | 69 | 35 | 104 | 52 |
| 61 | 53.5 | 1.05 | 3.48 | 6.62 | 60 | 105 | 45 | 43% | 70 | 35 | 106 | 53 |
| 62 | 54.5 | 1.07 | 3.62 | 6.74 | 61 | 108 | 48 | 44% | 72 | 36 | 107 | 54 |
| 63 | 55.5 | 1.09 | 3.75 | 6.86 | 62 | 112 | 51 | 45% | 73 | 36 | 109 | 55 |
| 64 | 56.5 | 1.11 | 3.89 | 6.99 | 63 | 117 | 54 | 46% | 74 | 37 | 111 | 56 |
| 65 | 57.5 | 1.13 | 4.02 | 7.11 | 64 | 121 | 57 | 47% | 76 | 38 | 113 | 57 |
| 66 | 58.5 | 1.15 | 4.17 | 7.24 | 65 | 125 | 60 | 48% | 77 | 38 | 115 | 58 |
| 67 | 59.5 | 1.17 | 4.31 | 7.36 | 66 | 129 | 63 | 49% | 78 | 39 | 117 | 59 |
| 68 | 60.5 | 1.19 | 4.46 | 7.48 | 67 | 134 | 66 | 50% | 80 | 40 | 119 | 60 |
| 69 | 61.5 | 1.21 | 4.60 | 7.61 | 69 | 138 | 70 | 50% | 81 | 40 | 121 | 61 |
| 70 | 62.5 | 1.23 | 4.76 | 7.73 | 70 | 143 | 73 | 51% | 82 | 41 | 123 | 62 |
| 71 | 63.5 | 1.25 | 4.91 | 7.85 | 71 | 147 | 77 | 52% | 83 | 42 | 125 | 63 |
| 72 | 64.5 | 1.27 | 5.06 | 7.98 | 72 | 152 | 80 | 53% | 85 | 42 | 127 | 64 |
| 73 | 65.5 | 1.29 | 5.22 | 8.10 | 73 | 157 | 84 | 53% | 86 | 43 | 129 | 65 |
| 74 | 66.5 | 1.31 | 5.38 | 8.23 | 74 | 162 | 87 | 54% | 87 | 44 | 131 | 66 |
| 75 | 67.5 | 1.33 | 5.55 | 8.35 | 75 | 166 | 91 | 55% | 89 | 44 | 133 | 67 |
| 76 | 68.5 | 1.35 | 5.71 | 8.47 | 76 | 171 | 95 | 55% | 90 | 45 | 135 | 68 |
| 77 | 69.5 | 1.37 | 5.88 | 8.60 | 77 | 176 | 99 | 56% | 91 | 46 | 137 | 69 |
| 78 | 70.5 | 1.39 | 6.05 | 8.72 | 79 | 182 | 103 | 57% | 93 | 46 | 139 | 70 |
| 79 | 71.5 | 1.41 | 6.22 | 8.84 | 80 | 187 | 107 | 57% | 94 | 47 | 141 | 71 |
| 80 | 72.5 | 1.43 | 6.40 | 8.97 | 81 | 192 | 111 | 58% | 95 | 48 | 143 | 71 |
| 81 | 73.5 | 1.45 | 6.58 | 9.09 | 82 | 197 | 115 | 59% | 97 | 48 | 145 | 72 |
| 82 | 74.5 | 1.47 | 6.76 | 9.21 | 83 | 203 | 120 | 59% | 98 | 49 | 147 | 73 |
| 83 | 75.5 | 1.49 | 6.94 | 9.34 | 84 | 208 | 124 | 60% | 99 | 50 | 149 | 74 |
| 84 | 76.5 | 1.51 | 7.12 | 9.46 | 85 | 214 | 129 | 60% | 101 | 50 | 151 | 75 |
| 85 | 77.5 | 1.53 | 7.31 | 9.59 | 86 | 219 | 133 | 61% | 102 | 51 | 153 | 76 |
| 86 | 78.5 | 1.55 | 7.50 | 9.71 | 87 | 225 | 138 | 61% | 103 | 52 | 155 | 77 |
| 87 | 79.5 | 1.56 | 7.69 | 9.83 | 89 | 231 | 142 | 62% | 105 | 52 | 157 | 78 |
| 88 | 80.5 | 1.58 | 7.89 | 9.96 | 90 | 237 | 147 | 62% | 106 | 53 | 159 | 79 |

TABLE 1-continued

| BEER (twist cap) 30 PSI | | | | | | | | | | | | |
|---|---|---|---|---|---|---|---|---|---|---|---|---|
| Container | | | | | Cap | | | | Grip Holding Force | | | |
| Cap OD (mm) A | Opening Diameter (mm) B | Opening Radius ID (in) C | Opening Area (Sq. in) D | Opening Circum-ference (in) E | Threads Holding Force (lb) F | Internal Force on cap (lb) G | Force needed from grip (lb) H | Grip percentage I | Grip I (lb) J | Grip II (lb) K | Grip III (lb) L | Grip IV (lb) M |
| 89 | 81.5 | 1.60 | 8.09 | 10.08 | 91 | 243 | 152 | 63% | 107 | 54 | 161 | 80 |
| 90 | 82.5 | 1.62 | 8.29 | 10.20 | 92 | 249 | 157 | 63% | 108 | 54 | 163 | 81 |
| 91 | 83.5 | 1.64 | 8.49 | 10.33 | 93 | 255 | 162 | 63% | 110 | 55 | 165 | 82 |
| 92 | 84.5 | 1.66 | 8.69 | 10.45 | 94 | 261 | 167 | 64% | 111 | 56 | 167 | 83 |
| 93 | 85.5 | 1.68 | 8.90 | 10.58 | 95 | 267 | 172 | 64% | 112 | 56 | 169 | 84 |
| 94 | 86.5 | 1.70 | 9.11 | 10.70 | 96 | 273 | 177 | 65% | 114 | 57 | 171 | 85 |
| 95 | 87.5 | 1.72 | 9.32 | 10.82 | 97 | 280 | 182 | 65% | 115 | 58 | 173 | 86 |

Columns A through E show various container opening dimensions measured either in millimeters (mm), inches (in) or square inches (sq. in), as indicated. In each case, and throughout this specification, any dimension related to an opening—radius, diameter, circumference, area, etc.—is the inside dimension rather than, for example, the dimension across the top of the container which would include the width of the container wall and would be regarded as an outside dimension. Column B shows the opening diameter for various container openings, while column A shows the corresponding cap outside diameter. Other than the commercially marketed 38 mm cap size, the other cap sizes are approximated likely sizes for the various listed container opening diameters. It is, of course, the latter that is more relevant to the computations shown since the container opening diameter determines the area to over which the internal force is applied. Column C shows the radius of the opening. Column D shows the area of the opening, based on the radius shown in column C. Column E shows the circumference of the container opening.

Columns F through H show various force calculations, measured in pounds (lb) and rounded off to an integer value. (Any apparent discrepancies in the computations are due to such round-off.)

In particular, Column F shows the minimum holding force that can be expected to be provided by the twist threads, calculated in the manner discussed below. Column G shows the total internal force on the cap, which is given by the internal pressure of 30 psi multiplied by the area of the opening, that area also being the area of the inside of the top of the cap that is impinged upon by the gas inside the container. Column H shows the minimum holding force required to be provided by the pressure grip, which is the difference between the total internal force (column G) and the twist thread holding force (column F). Column I shows the percentage contribution to the overall holding force that is provided by the pressure grip (column H divided by column G).

Consider the container opening of 30.5 mm shown in the first line of the table. This is the opening of the most common currently marketed aluminum screw top beer bottle (hereinafter referred to for convenience as the "standard aluminum beer bottle"). For this container opening and pressure, the internal force is 34 lb. Existing commercially acceptable threads provide at least that level of holding force and thus no contribution from any pressure grip is needed. By the same token, the present inventors have been informed by packaging engineers responsible for the design and manufacture of currently marketed aluminum screw top beer bottles that this is the maximum size that is commercially viable with threads alone.

The remaining lines of the table show computations for other container openings in increments of 1.0 mm. The amount of holding force provided by the twist threads for the various container openings has been approximated in Table 1 by recognizing that that holding force is proportional to the total length of the twist threads and thus is proportional to the circumference of the container at the location of its twist threads which is, in turn, proportional to the opening's diameter (or radius). Thus if we make the simplifying assumption that the threads of the standard aluminum beer bottle provide just enough holding force to withstand the 34 lb of internal force, we can compute the holding force provided by the twist threads for containers with larger openings, as shown in the rest of column F, by linearly scaling up from 34 lb by a factor given by the ratio of an opening's circumference to the 3.77 in circumference of the standard aluminum beer bottle's 30.5 mm opening.

The internal force increases, however, in portion to the square of the opening's radius. Thus the increase in thread holding force at larger container openings is outstripped by the increase in the internal force. As noted above, the necessary additional holding force supplied by the pressure grip is shown in column H, along with an indication of the pressure grip's percentage contribution to the overall holding force in column I.

Columns J through M show calculations related to holding forces that can be expected to be provided by various conformations of pressure grips. In particular, we have carried out calculations establishing the holding force provided by two plastic pressure grips (or "stoppers") currently in commercial use for sparkling wine bottles with an 18 mm opening—one in use for contents under 60 psi of pressure and one at 90 psi. These are referred to in Table 1 as Grip I and Grip III. In carrying out our computations, we computed the internal force on the sparkling wine bottle pressure grip and, further, recognized that the holding capability of the pressure grip is a function of the contact area between the pressure grip and the inside of the bottle opening. The computation shows that Grips I and III respectively provide a minimum of 10.63 and 15.94 lb of holding force per inch of bottle opening circumference. Multiplying 10.63 and 15.94 by the circumference shown in column E yields the minimum holding force that could be relied on to be provided by such pressure grips for the various openings, as shown in columns J and L. Since the holding force is proportional to the contact area between the pressure grip and the inside of the bottle opening, halving the depth of a pressure grip (i.e. its vertical dimension per the orientation in the FIGS.) would yield a pressure grip having approximately half as much holding force. The holding force that would be provided by pressure grips like Grips I and III but having half the depth of those grips is shown in columns K and M, respectively for pressure grips that referred to herein as Grips II and IV, respectively.

Many of the pressure grips that might be used in accordance with the present invention are configured differently from the plastic pressure grips (or "stoppers") that the computations of columns J through M are based on. Thus the holding forces provided by such other pressure grips would not necessarily be the same as those that Table 1 shows. But the computations shown in columns J through M establish that it is well within the capability of existing materials and technology for one to design pressure grips having the requisite pressure grip holding forces shown in column H. And the discussion hereinafter assumes the use of pressure grips capable of providing holding forces as shown in columns J through M.

What we can observe, then, by comparing columns J through M to the pressure grip requirement of column H, is that pressure grips with the holding capabilities of Grips II, IV, I and III would suffice for container openings up to 48.5 mm, 57.5, 66.5 mm and 84.5, respectively since the holding force provided by the grips for those or smaller openings is at least as great as the pressure-grip-required contribution shown in column H.

As noted above, the calculations shown in Table 1 make the simplifying assumption that the twist threads of the standard aluminum beer bottle provide only the minimum holding force required to counteract the assumed internal force of 34 lb. In reality, of course, container closures must be designed with enough of a "safety factor" to take into account any number of other factors including manufacturing variabilities and the fact that the internal pressure will rise with temperature. As a result, the actual holding force that can be provided by the twist threads of the standard aluminum beer bottle is some designed-in multiple of the nominal internal force of 34 lb. Thus the twist thread holding forces shown for not only the 30.5 mm opening, but also twist thread holding forces for the other containers in Table 1—which are scaled up from that of the container having a 30.5 mm opening—would be greater than that shown in the table by the aforesaid designed-in multiple. If the safety factor were to be 2.5, for example, then the actual holding force provided by the twist threads for containers having 30.5, 31.5 and 32.5 mm openings would be 85, 87.5 and 90 lb, respectively.

Similar considerations apply to the holding forces that Table 1 lists for the various possible pressure grips. Meaning that the actual holding force that can be provided by the 60 psi and 90 psi pressure grips that form the basis of the computations shown in columns J through M is actually some designed-in multiple of the 10.63 and 15.94 lb per circumferential inch holding force that we computed for Grips I and III.

Assuming that the same safety factor were used for both the twist threads and pressure grips, the pressure grip's percentage contribution to holding force would still be as shown in the table and the same pressure grips that we found to be appropriate for a given container opening per the analysis of Table 1 would still apply.

Thus by way of example, assume a safety factor of 2.5 for the twist threads and consider the container opening of 48.5 mm., the internal force that we would be designing for would be 215 lb (=2.5×86 lb). The twist threads should be capable of providing 135 lb (=2.5×54 lb) of holding force, leaving 80 lb of holding force needing to be provided by the pressure grip. The percentage of holding force provided by the pressure grip is still 37% (=80/215). Moreover, assuming that the pressure grips were also designed with a safety factor 2.5, we would still be able to use a pressure grip with the capabilities of Grip II because its actual holding force would meet the needed 80 lb (=2.5×32 lb).

This "safety factor" discussion also applies to the computations presented in Tables II, III and IV discussed below.

The data in Table 2 is similar to that of Table 1 but now assumes an internal pressure of 50 psi—the typical pressure for soda. A container opening of 22.5 mm is the industry standard for plastic soda bottles and the calculations of Table 2 assume that the twist threads provide 31 lb of holding force—just enough to counteract the 31 lb of internal pressure on a cap for an opening of that size with 50 psi of internal pressure. The calculations otherwise follow the same algorithms as in Table 1 and the pressure grip capabilities are the same as assumed for Table 1. It may thus be noted that at this internal pressure level, pressure grips having the holding capabilities of Grips II, IV, I and III, could be used with up to 32.5 mm, 38.5 mm, 43.5 mm and 54.5 mm openings, respectively.

TABLE 2

| SODA (twist cap) 50 PSI | | | | | | | | | | | | |
|---|---|---|---|---|---|---|---|---|---|---|---|---|
| Container | | | | | Cap | | | | Grip Holding Force | | | |
| Cap OD (mm) A | Opening Diameter (mm) B | Opening Radius ID (in) C | Opening Area (Sq. in) D | Opening Circum-ference (in) E | Threads Holding Force (lb) F | Internal Force on cap (lb) G | Force needed from grip (lb) H | Grip percentage I | Grip I (lb) J | Grip II (lb) K | Grip III (lb) L | Grip IV (lb) M |
| 29 | 22.5 | 0.44 | 0.62 | 2.78 | 31 | 31 | 0 | 0% | 30 | 15 | 44 | 22 |
| 30 | 23.5 | 0.46 | 0.67 | 2.91 | 32 | 34 | 1 | 4% | 31 | 15 | 46 | 23 |
| 31 | 24.5 | 0.48 | 0.73 | 3.03 | 34 | 37 | 3 | 8% | 32 | 16 | 48 | 24 |
| 32 | 25.5 | 0.50 | 0.79 | 3.15 | 35 | 40 | 5 | 12% | 34 | 17 | 50 | 25 |
| 33 | 26.5 | 0.52 | 0.85 | 3.28 | 36 | 43 | 6 | 15% | 35 | 17 | 52 | 26 |
| 34 | 27.5 | 0.54 | 0.92 | 3.40 | 38 | 46 | 8 | 18% | 36 | 18 | 54 | 27 |
| 35 | 28.5 | 0.56 | 0.99 | 3.53 | 39 | 49 | 10 | 21% | 37 | 19 | 56 | 28 |
| 36 | 29.5 | 0.58 | 1.06 | 3.65 | 40 | 53 | 13 | 24% | 39 | 19 | 58 | 29 |
| 37 | 30.5 | 0.60 | 1.13 | 3.77 | 42 | 57 | 15 | 26% | 40 | 20 | 60 | 30 |

TABLE 2-continued

| SODA (twist cap) 50 PSI | | | | | | | | | | | | |
|---|---|---|---|---|---|---|---|---|---|---|---|---|
| Container | | | | | Cap | | | | Grip Holding Force | | | |
| Cap OD (mm) A | Opening Diameter (mm) B | Opening Radius ID (in) C | Opening Area (Sq. in) D | Opening Circum-ference (in) E | Threads Holding Force (lb) F | Internal Force on cap (lb) G | Force needed from grip (lb) H | Grip percentage I | Grip I (lb) J | Grip II (lb) K | Grip III (lb) L | Grip IV (lb) M |
| 38 | 31.5 | 0.62 | 1.21 | 3.90 | 43 | 60 | 17 | 29% | 41 | 21 | 62 | 31 |
| 39 | 32.5 | 0.64 | 1.29 | 4.02 | 45 | 64 | 20 | 31% | 43 | 21 | 64 | 32 |
| 40 | 33.5 | 0.66 | 1.37 | 4.14 | 46 | 68 | 22 | 33% | 44 | 22 | 66 | 33 |
| 41 | 34.5 | 0.68 | 1.45 | 4.27 | 47 | 72 | 25 | 35% | 45 | 23 | 68 | 34 |
| 42 | 35.5 | 0.70 | 1.53 | 4.39 | 49 | 77 | 28 | 37% | 47 | 23 | 70 | 35 |
| 43 | 36.5 | 0.72 | 1.62 | 4.51 | 50 | 81 | 31 | 38% | 48 | 24 | 72 | 36 |
| 44 | 37.5 | 0.74 | 1.71 | 4.64 | 51 | 86 | 34 | 40% | 49 | 25 | 74 | 37 |
| 45 | 38.5 | 0.76 | 1.80 | 4.76 | 53 | 90 | 37 | 42% | 51 | 25 | 76 | 38 |
| 46 | 39.5 | 0.78 | 1.90 | 4.89 | 54 | 95 | 41 | 43% | 52 | 26 | 78 | 39 |
| 47 | 40.5 | 0.80 | 2.00 | 5.01 | 55 | 100 | 44 | 44% | 53 | 27 | 80 | 40 |
| 48 | 41.5 | 0.82 | 2.10 | 5.13 | 57 | 105 | 48 | 46% | 55 | 27 | 82 | 41 |
| 49 | 42.5 | 0.84 | 2.20 | 5.26 | 58 | 110 | 52 | 47% | 56 | 28 | 84 | 42 |
| 50 | 43.5 | 0.86 | 2.30 | 5.38 | 60 | 115 | 56 | 48% | 57 | 29 | 86 | 43 |
| 51 | 44.5 | 0.88 | 2.41 | 5.50 | 61 | 121 | 60 | 49% | 59 | 29 | 88 | 44 |
| 52 | 45.5 | 0.90 | 2.52 | 5.63 | 62 | 126 | 64 | 51% | 60 | 30 | 90 | 45 |
| 53 | 46.5 | 0.92 | 2.63 | 5.75 | 64 | 132 | 68 | 52% | 61 | 31 | 92 | 46 |
| 54 | 47.5 | 0.94 | 2.75 | 5.88 | 65 | 137 | 72 | 53% | 62 | 31 | 94 | 47 |
| 55 | 48.5 | 0.95 | 2.86 | 6.00 | 66 | 143 | 77 | 54% | 64 | 32 | 96 | 48 |
| 56 | 49.5 | 0.97 | 2.98 | 6.12 | 68 | 149 | 81 | 55% | 65 | 33 | 98 | 49 |
| 57 | 50.5 | 0.99 | 3.10 | 6.25 | 69 | 155 | 86 | 55% | 66 | 33 | 100 | 50 |
| 58 | 51.5 | 1.01 | 3.23 | 6.37 | 71 | 161 | 91 | 56% | 68 | 34 | 102 | 51 |
| 59 | 52.5 | 1.03 | 3.36 | 6.49 | 72 | 168 | 96 | 57% | 69 | 35 | 104 | 52 |
| 60 | 53.5 | 1.05 | 3.48 | 6.62 | 73 | 174 | 101 | 58% | 70 | 35 | 106 | 53 |
| 61 | 54.5 | 1.07 | 3.62 | 6.74 | 75 | 181 | 106 | 59% | 72 | 36 | 107 | 54 |
| 62 | 55.5 | 1.09 | 3.75 | 6.86 | 76 | 187 | 111 | 59% | 73 | 36 | 109 | 55 |
| 63 | 56.5 | 1.11 | 3.89 | 6.99 | 77 | 194 | 117 | 60% | 74 | 37 | 111 | 56 |
| 64 | 57.5 | 1.13 | 4.02 | 7.11 | 79 | 201 | 122 | 61% | 76 | 38 | 113 | 57 |
| 65 | 58.5 | 1.15 | 4.17 | 7.24 | 80 | 208 | 128 | 62% | 77 | 38 | 115 | 58 |
| 66 | 59.5 | 1.17 | 4.31 | 7.36 | 81 | 215 | 134 | 62% | 78 | 39 | 117 | 59 |

Table 3 shows the same kind of data but illustrating a design approach wherein the amount of holding force supplied by the pressure grip is taken as the starting point and it is then determined how much additional holding force would be needed to be supplied by twist threads. In particular, the container opening of 18 mm—shown in the first line of Table 3—is the size for currently marketed bottles of Champagne and other sparkling wines. For this size of opening and an assumed pressure of 60 psi, the internal force is 24 lb. (Also, the cap outside diameter is larger than for a beer or soda container for a given opening diameter because the walls of the container are larger for Champagne and many sparkling wines than for beer or soda.) Thus a holding force of at least 24 lb would need to be supplied from the pressure grip. Existing commercially plastic stoppers are capable of providing at least that level of holding force and thus no threads are needed.

TABLE 3

| SPARKLING WINE (plastic stopper) 60 PSI | | | | | | | | | | | | |
|---|---|---|---|---|---|---|---|---|---|---|---|---|
| Container | | | | | Cap | | | | Threads Holding Force | | | |
| Cap OD (mm) A | Opening Diameter (mm) B | Opening Radius ID (in) C | Opening Area (Sq. in) D | Opening Circum-ference (in) E | Grip Holding Force (lb) F | Internal Force on cap (lb) G | Force needed from threads (lb) H | Thread percentage I | Thread I (lb) J | Thread II (lb) K | Thread III (lb) L | Thread IV (lb) M |
| 33 | 18 | 0.35 | 0.39 | 2.23 | 24 | 24 | 0 | 0% | 20 | 10 | 25 | 12 |
| 34 | 19 | 0.37 | 0.44 | 2.35 | 25 | 26 | 1 | 5% | 21 | 11 | 26 | 13 |
| 35 | 20 | 0.39 | 0.49 | 2.47 | 26 | 29 | 3 | 10% | 22 | 11 | 27 | 14 |
| 36 | 21 | 0.41 | 0.54 | 2.60 | 28 | 32 | 5 | 14% | 23 | 12 | 29 | 14 |
| 37 | 22 | 0.43 | 0.59 | 2.72 | 29 | 35 | 6 | 18% | 25 | 12 | 30 | 15 |
| 38 | 23 | 0.45 | 0.64 | 2.84 | 30 | 39 | 8 | 22% | 26 | 13 | 31 | 16 |
| 39 | 24 | 0.47 | 0.70 | 2.97 | 32 | 42 | 11 | 25% | 27 | 13 | 33 | 16 |
| 40 | 25 | 0.49 | 0.76 | 3.09 | 33 | 46 | 13 | 28% | 28 | 14 | 34 | 17 |
| 41 | 26 | 0.51 | 0.82 | 3.22 | 34 | 49 | 15 | 31% | 29 | 14 | 36 | 18 |
| 42 | 27 | 0.53 | 0.89 | 3.34 | 35 | 53 | 18 | 33% | 30 | 15 | 37 | 18 |
| 43 | 28 | 0.55 | 0.95 | 3.46 | 37 | 57 | 20 | 36% | 31 | 16 | 38 | 19 |

TABLE 3-continued

| SPARKLING WINE (plastic stopper) 60 PSI | | | | | | | | | | | | |
|---|---|---|---|---|---|---|---|---|---|---|---|---|
| Container | | | | | Cap | | | | Threads Holding Force | | | |
| Cap OD (mm) A | Opening Diameter (mm) B | Opening Radius ID (in) C | Opening Area (Sq. in) D | Opening Circum-ference (in) E | Grip Holding Force (lb) F | Internal Force on cap (lb) G | Force needed from threads (lb) H | Thread percentage I | Thread I (lb) J | Thread II (lb) K | Thread III (lb) L | Thread IV (lb) M |
| 44 | 29 | 0.57 | 1.02 | 3.59 | 38 | 61 | 23 | 38% | 32 | 16 | 40 | 20 |
| 45 | 30 | 0.59 | 1.10 | 3.71 | 39 | 66 | 26 | 40% | 33 | 17 | 41 | 21 |
| 46 | 31 | 0.61 | 1.17 | 3.83 | 41 | 70 | 29 | 42% | 35 | 17 | 42 | 21 |
| 47 | 32 | 0.63 | 1.25 | 3.96 | 42 | 75 | 33 | 44% | 36 | 18 | 44 | 22 |
| 48 | 33 | 0.65 | 1.33 | 4.08 | 43 | 80 | 36 | 45% | 37 | 18 | 45 | 23 |
| 49 | 34 | 0.67 | 1.41 | 4.21 | 45 | 84 | 40 | 47% | 38 | 19 | 47 | 23 |
| 50 | 35 | 0.69 | 1.49 | 4.33 | 46 | 89 | 43 | 49% | 39 | 19 | 48 | 24 |
| 51 | 36 | 0.71 | 1.58 | 4.45 | 47 | 95 | 47 | 50% | 40 | 20 | 49 | 25 |
| 52 | 37 | 0.73 | 1.67 | 4.58 | 49 | 100 | 51 | 51% | 41 | 21 | 51 | 25 |
| 53 | 38 | 0.75 | 1.76 | 4.70 | 50 | 105 | 56 | 53% | 42 | 21 | 52 | 26 |
| 54 | 39 | 0.77 | 1.85 | 4.82 | 51 | 111 | 60 | 54% | 43 | 22 | 53 | 27 |
| 55 | 40 | 0.79 | 1.95 | 4.95 | 53 | 117 | 64 | 55% | 45 | 22 | 55 | 27 |

For larger container openings, the amount of holding force provided by the pressure grip increases in linear proportion to the increase of the opening's circumference. The rest of the holding force is provided by twist threads. Analogously to the way in which we considered the capabilities of existing plastic pressure grips ("stoppers") in the computations of Tables 1 and 2, we here have considered the capabilities of the twist threads of the standard aluminum beer bottle and the standard plastic soda bottle—referred to in Table 3 as Thread Styles I and III—and calculated that those threads can be relied on to provide a minimum of 9.01 lb and 11.07 lb of holding force per inch of opening circumference respectively, resulting in the computations shown in columns J and L, respectively. If we assume that halving the depth of a set of threads halves the threads' holding force, then such halved-in-depth threads as are used in the standard aluminum beer bottle and standard plastic soda bottle would have the holding force capabilities shown in columns K and M, respectively for what we refer to as Thread Styles II and IV, respectively. We thus see from Table 3 that that at this internal pressure level, thread styles II, IV, I and III could be used with up to 25 mm, 27 mm, 33 mm and 36 mm openings, respectively.

Table 4 shows similar data for an assumed pressure of 90 psi. Here we can see that at this level of pressure, thread styles II, IV, I and III could be used with up to 23 mm, 24 mm, 28 mm and 30 mm openings, respectively,

TABLE 4

| SPARKLING WINE (plastic stopper) 90 PSI | | | | | | | | | | | | |
|---|---|---|---|---|---|---|---|---|---|---|---|---|
| Container | | | | | Cap | | | | Threads Holding Force | | | |
| Cap OD (mm) A | Opening Diameter (mm) B | Opening Radius ID (in) C | Opening Area (Sq. in) D | Opening Circum-ference (in) E | Grip Holding Force (lb) F | Internal Force on cap (lb) G | Force needed from threads (lb) H | Thread percentage I | Thread I (lb) J | Thread II (lb) K | Thread III (lb) L | Thread IV (lb) M |
| 33 | 18 | 0.35 | 0.39 | 2.23 | 35 | 35 | 0 | 0% | 20 | 10 | 25 | 12 |
| 34 | 19 | 0.37 | 0.44 | 2.35 | 37 | 40 | 2 | 5% | 21 | 11 | 26 | 13 |
| 35 | 20 | 0.39 | 0.49 | 2.47 | 39 | 44 | 4 | 10% | 22 | 11 | 27 | 14 |
| 36 | 21 | 0.41 | 0.54 | 2.60 | 41 | 48 | 7 | 14% | 23 | 12 | 29 | 14 |
| 37 | 22 | 0.43 | 0.59 | 2.72 | 43 | 53 | 10 | 18% | 25 | 12 | 30 | 15 |
| 38 | 23 | 0.45 | 0.64 | 2.84 | 45 | 58 | 13 | 22% | 26 | 13 | 31 | 16 |
| 39 | 24 | 0.47 | 0.70 | 2.97 | 47 | 63 | 16 | 25% | 27 | 13 | 33 | 16 |
| 40 | 25 | 0.49 | 0.76 | 3.09 | 49 | 68 | 19 | 28% | 28 | 14 | 34 | 17 |
| 41 | 26 | 0.51 | 0.82 | 3.22 | 51 | 74 | 23 | 31% | 29 | 14 | 36 | 18 |
| 42 | 27 | 0.53 | 0.89 | 3.34 | 53 | 80 | 27 | 33% | 30 | 15 | 37 | 18 |
| 43 | 28 | 0.55 | 0.95 | 3.46 | 55 | 86 | 31 | 36% | 31 | 16 | 38 | 19 |
| 44 | 29 | 0.57 | 1.02 | 3.59 | 57 | 92 | 35 | 38% | 32 | 16 | 40 | 20 |
| 45 | 30 | 0.59 | 1.10 | 3.71 | 59 | 99 | 39 | 40% | 33 | 17 | 41 | 21 |
| 46 | 31 | 0.61 | 1.17 | 3.83 | 61 | 105 | 44 | 42% | 35 | 17 | 42 | 21 |
| 47 | 32 | 0.63 | 1.25 | 3.96 | 63 | 112 | 49 | 44% | 36 | 18 | 44 | 22 |
| 48 | 33 | 0.65 | 1.33 | 4.08 | 65 | 119 | 54 | 45% | 37 | 18 | 45 | 23 |
| 49 | 34 | 0.67 | 1.41 | 4.21 | 67 | 127 | 60 | 47% | 38 | 19 | 47 | 23 |
| 50 | 35 | 0.69 | 1.49 | 4.33 | 69 | 134 | 65 | 49% | 39 | 19 | 48 | 24 |
| 51 | 36 | 0.71 | 1.58 | 4.45 | 71 | 142 | 71 | 50% | 40 | 20 | 49 | 25 |

TABLE 4-continued

| SPARKLING WINE (plastic stopper) 90 PSI | | | | | | | | | | | | |
|---|---|---|---|---|---|---|---|---|---|---|---|---|
| Container | | | | | Cap | | | | Threads Holding Force | | | |
| Cap OD (mm) A | Opening Diameter (mm) B | Opening Radius ID (in) C | Opening Area (Sq. in) D | Opening Circum-ference (in) E | Grip Holding Force (lb) F | Internal Force on cap (lb) G | Force needed from threads (lb) H | Thread percentage I | Thread I (lb) J | Thread II (lb) K | Thread III (lb) L | Thread IV (lb) M |
| 52 | 37 | 0.73 | 1.67 | 4.58 | 73 | 150 | 77 | 51% | 41 | 21 | 51 | 25 |
| 53 | 38 | 0.75 | 1.76 | 4.70 | 75 | 158 | 83 | 53% | 42 | 21 | 52 | 26 |
| 54 | 39 | 0.77 | 1.85 | 4.82 | 77 | 167 | 90 | 54% | 43 | 22 | 53 | 27 |
| 55 | 40 | 0.79 | 1.95 | 4.95 | 79 | 175 | 96 | 55% | 45 | 22 | 55 | 27 |

For any of these scenarios, other combinations of twist thread and pressure grip capabilities are possible. For example, returning to Table 1, if we used pressure grip I rather than pressure grip II for the 48.5 mm opening—even though the latter would be adequate—we would have a design in which 64 lb of the total required minimum holding force of 86 lb could be relied on as being provided by the pressure grip, so that only 22 lb would have to be provided by the twist threads. This would allow an aluminum beer bottle to have a smaller thread profile (depth) than currently which might enhance the attractiveness of the bottle and/or might be advantageous from a manufacturing standpoint. (By the same token, providing a pressure grip in the cap of a pre-filled wine glass product of the type disclosed in our co-pending patent application Ser. No. 13/240,194 filed Sep. 22, 2011 and Ser. No. 14/029,020 filed Sep. 17, 2013, the contents of which are hereby incorporated by reference as thoughtfully set forth herein, could allow the threads or other "engagement features" on the glass to be made smaller than otherwise.)

Figure 57:
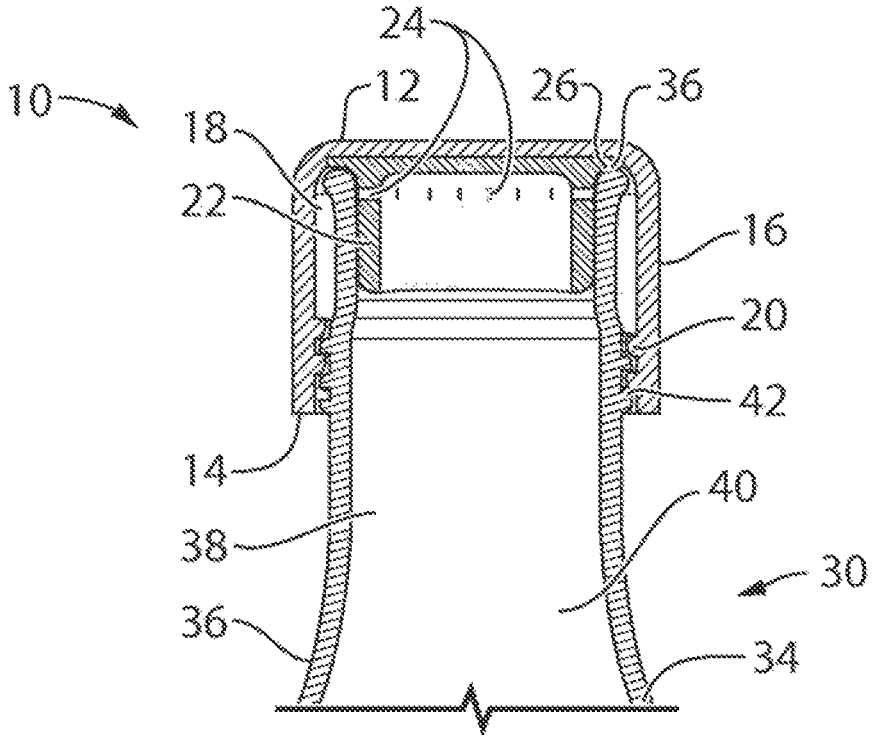
FIGS. 57 and 58 are vertical cross-sections of the cap and container of eighth and ninth embodiments, which are similar to the second embodiment, but having different assumed container openings.
Figure 58:
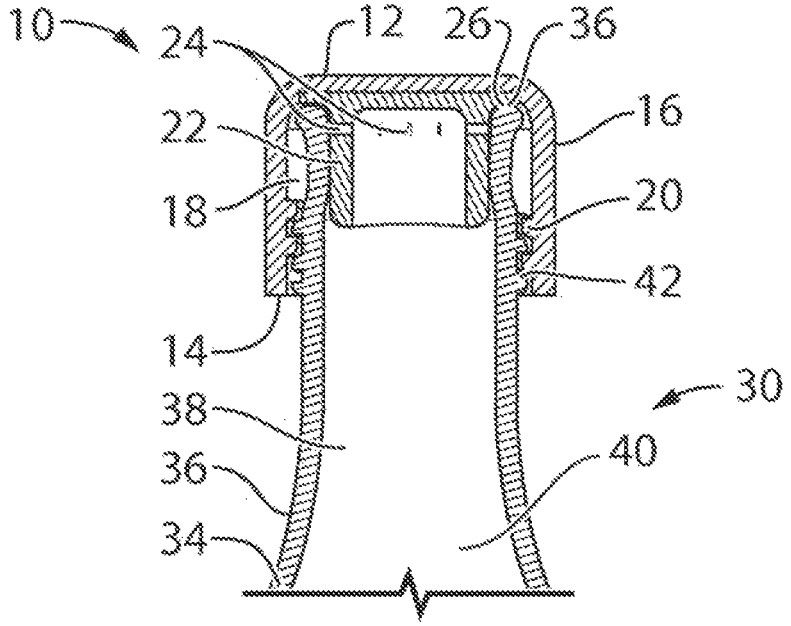

FIGS. 57 and 58 are vertical cross-sections of the cap and container of eighth and ninth embodiments which are similar to the second embodiment and which might be used for sparkling wine. In FIG. 57 the container opening is illustratively 28 mm whereas in FIG. 58 the container opening is the 18 mm, common in the marketplace today. Note that the contribution to the holding force provided by the twist threads in the embodiment of FIG. 58 means that the pressure grip of the embodiment of FIG. 58 can be of lesser depth (measured in the vertical direction of the FIGS.) than is the case for the stopper used in currently marketed sparkling wine bottles with an 18 mm ID, while the overall cap structure continues to provide the requisite total holding force. The resulting smaller area of contact between the pressure grip and the inside of the bottle (as compared to the current market offerings) should make the bottle easier to open.

The foregoing merely illustrates the principles of the invention and many variations are possible.

Figure 59:
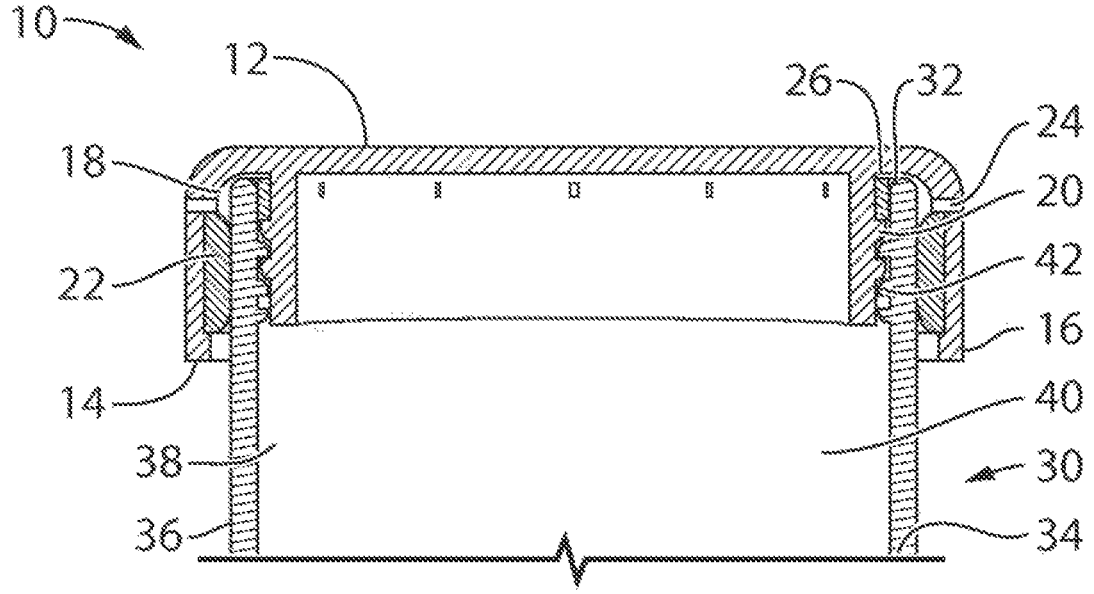
FIG. 59 is a vertical cross-section of the cap and container of a tenth embodiment, wherein the container twist threads are on the inner surface of the container wall.

For example, although all of the embodiments discussed to this point have the twist threads on the outside surface of the container, it is possible for the container's twist threads to be on the inside surface of the container. Such an embodiment is shown in FIG. 59, which has an outside pressure grip 22 as in the first embodiment. Here the twist threads 41, on the inside wall of the container, mate with twist threads 47 on a solid ring 49 that is a part of the cap and that extends downward from the underside of the cap. When the cap is twisted and lifted up, a path for gas to escape is provided via vents 24 formed in ring 49 and then to the outside via vents 24*a* formed in the outer wall of the cap. While manufacturing threads on the inside of the container is more difficult and expensive than when formed on the outside, doing so allows for a clean drinking area on the outside of the container, thereby providing the container with an increased aesthetic value and differentiation from other containers that have threads on the outside.

The pressure grip can take on a variety of geometric shapes. The key is that contact points on the shape would come into contact with the container wall in such a way as to provide holding power. We envision that for the most part the contact points of said geometric shapes will be arcs that correspond to segments of the container wall.

Figure 60:
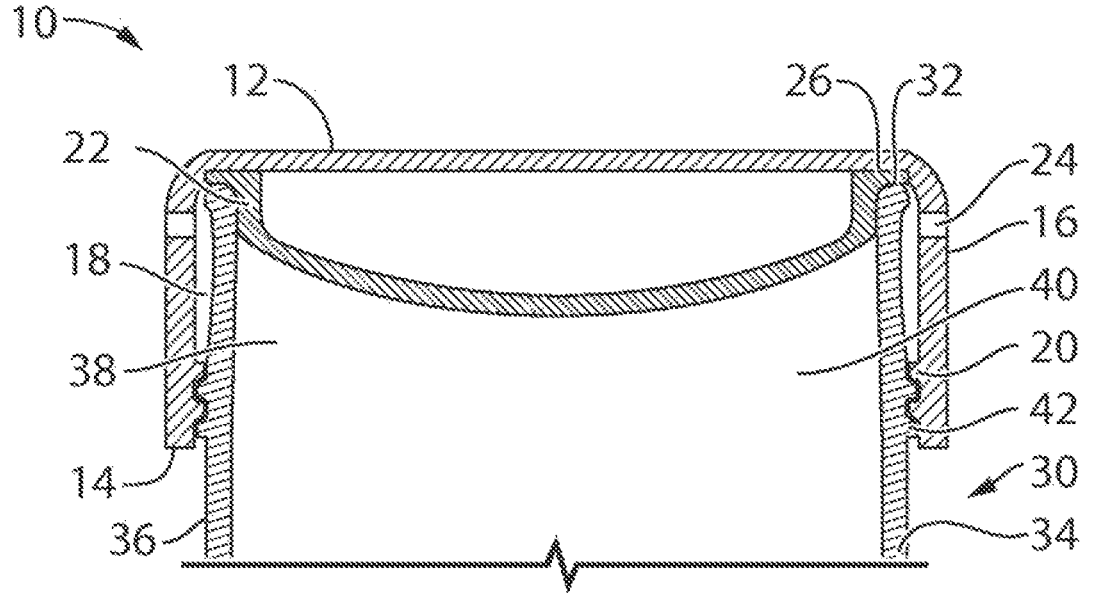
FIG. 60 is a vertical cross-section of the cap and container of an eleventh embodiment, wherein the pressure grip is in the shape of a half-sphere.
Figure 61:
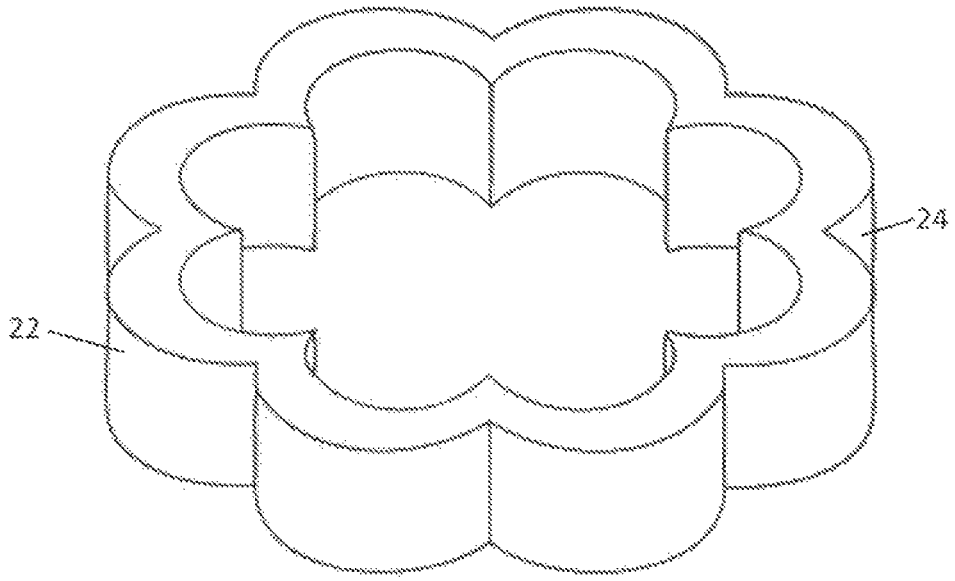
FIG. 61 is a top perspective view of the pressure grip of a twelfth embodiment.
Figure 62:
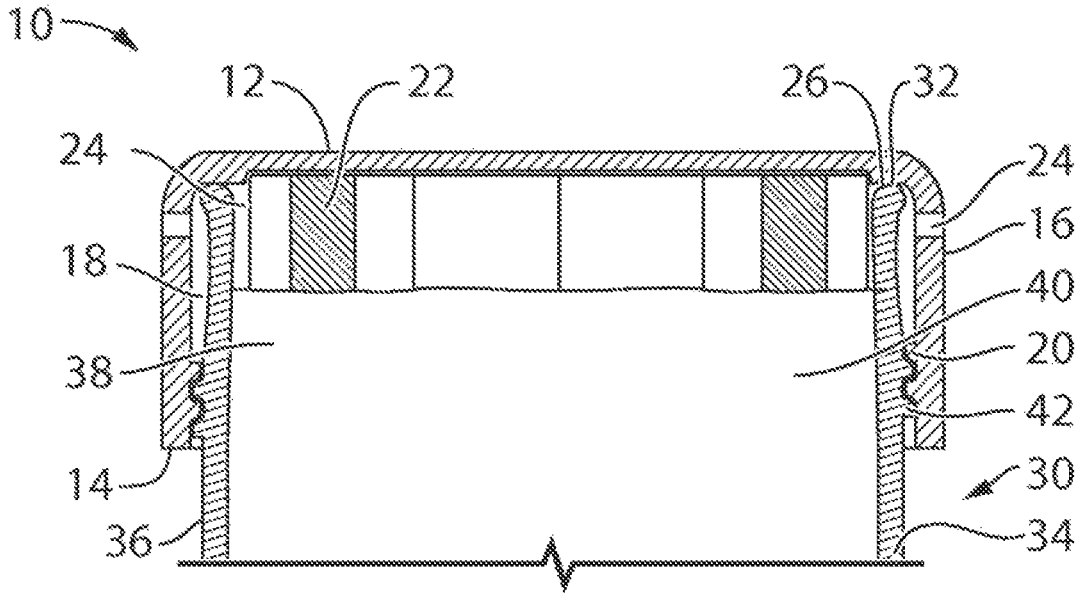
FIG. 62 is a vertical cross-section of the cap and container of the twelfth embodiment.
Figure 63:
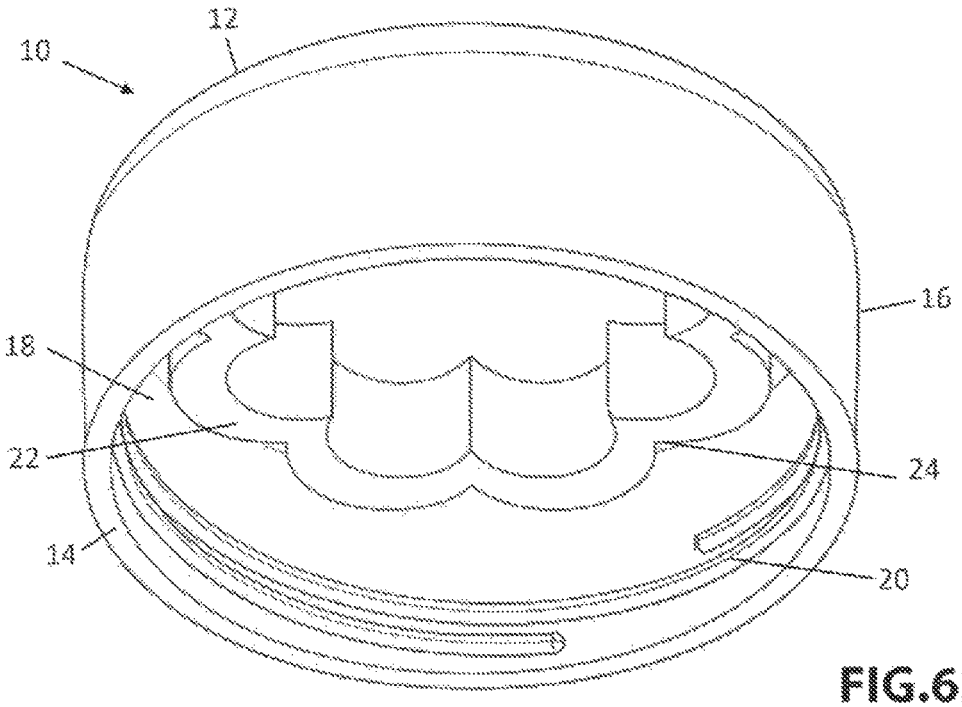
FIG. 63 is a bottom perspective view of the cap of the twelfth embodiment.
Figure 64:
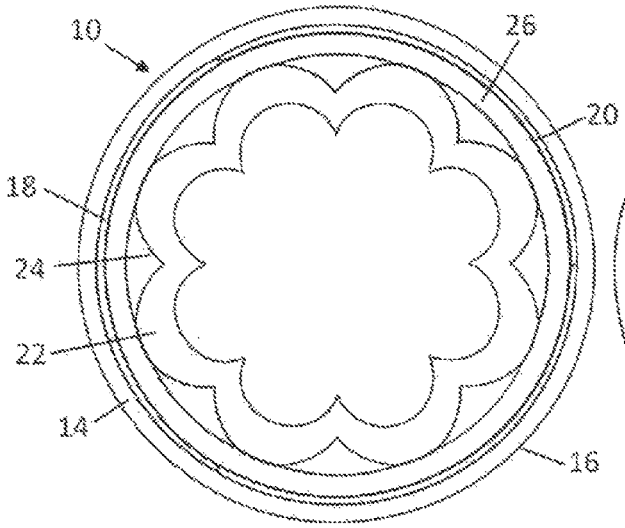
FIG. 64 is a bottom view of the cap of the twelfth embodiment.
Figure 65:
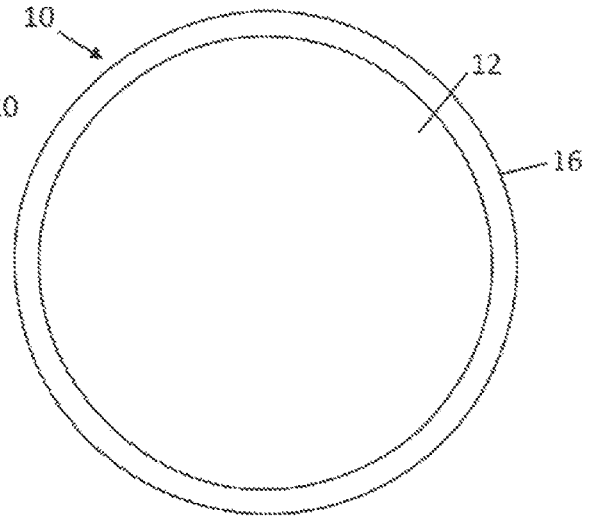
FIG. 65 is a top view of the cap of the twelfth embodiment.
Figure 66:
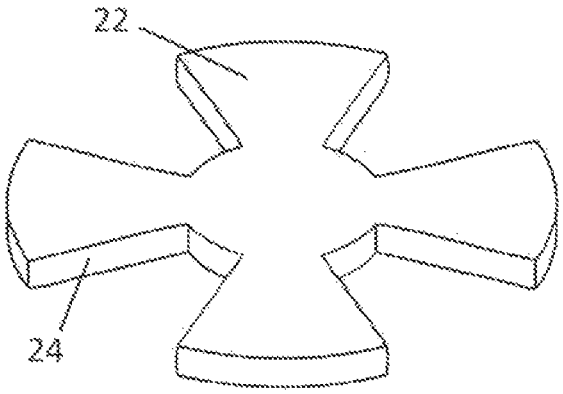
FIG. 66 is a top perspective view of one unit of a pressure grip of a thirteenth embodiment.
Figure 67:
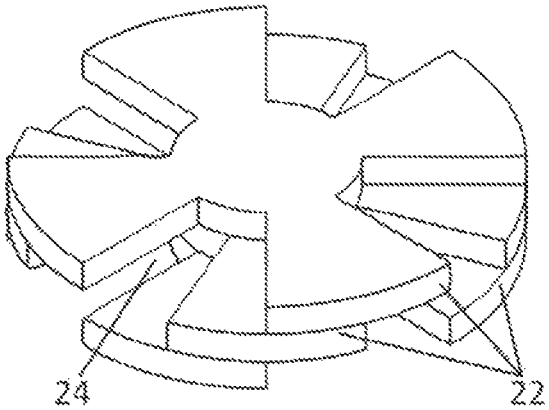
FIG. 67 is a top perspective view of an assembly of units for the pressure grip of the thirteenth embodiment.
Figure 68:
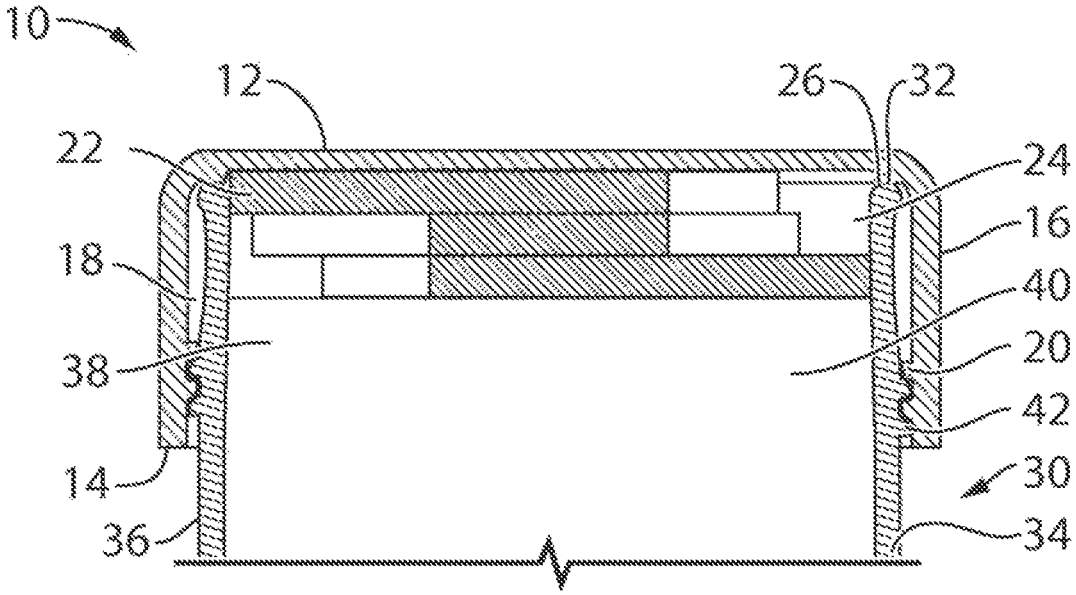
FIG. 68 is a vertical cross-section of the cap and container of the thirteenth embodiment.
Figure 69:
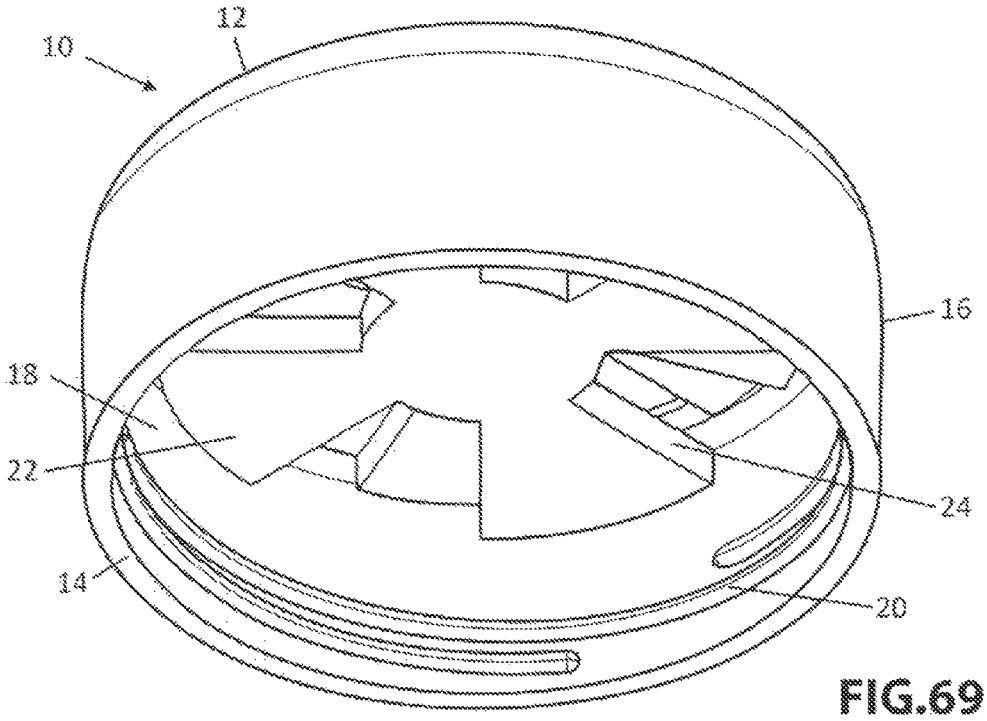
FIG. 69 is a bottom perspective view of the cap of the thirteenth embodiment.
Figure 70:
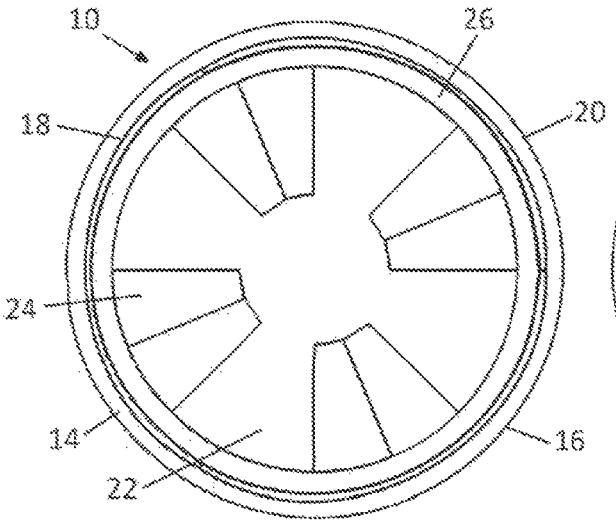
FIG. 70 is a bottom view of the cap of the thirteenth embodiment.
Figure 71:
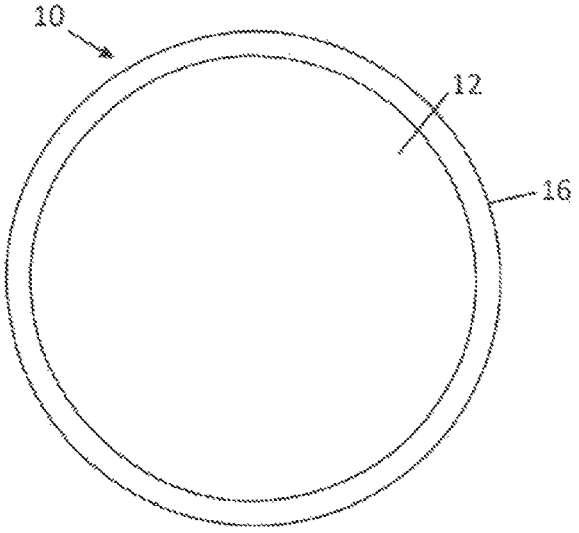
FIG. 71 is a top view of the cap of the thirteenth embodiment.
Figure 72:
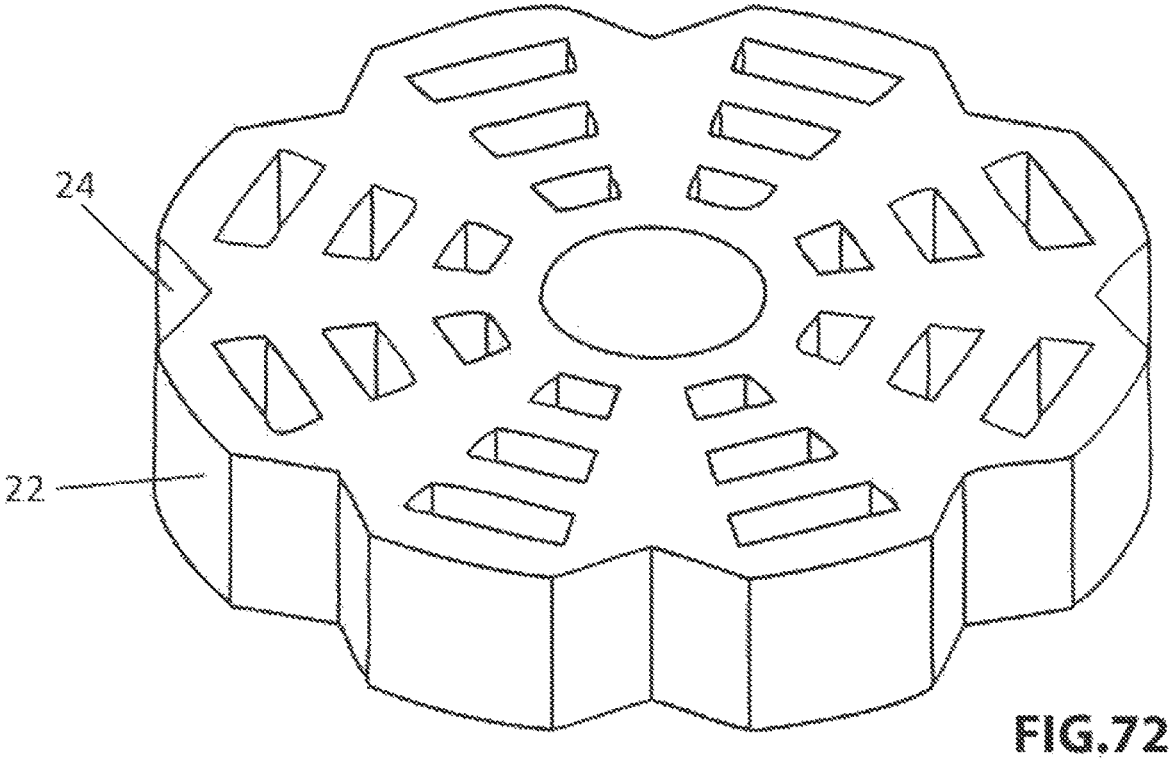
FIG. 72 is a top perspective view of the pressure grip of a fourteenth embodiment.
Figure 73:
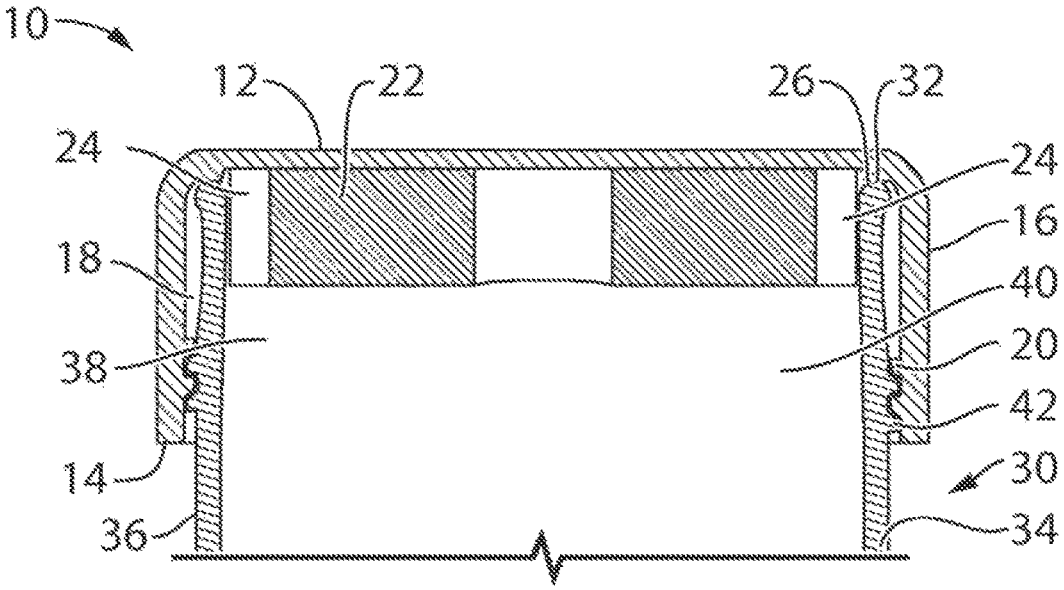
FIG. 73 is a vertical cross-section of the cap and container of the fourteenth embodiment.
Figure 74:
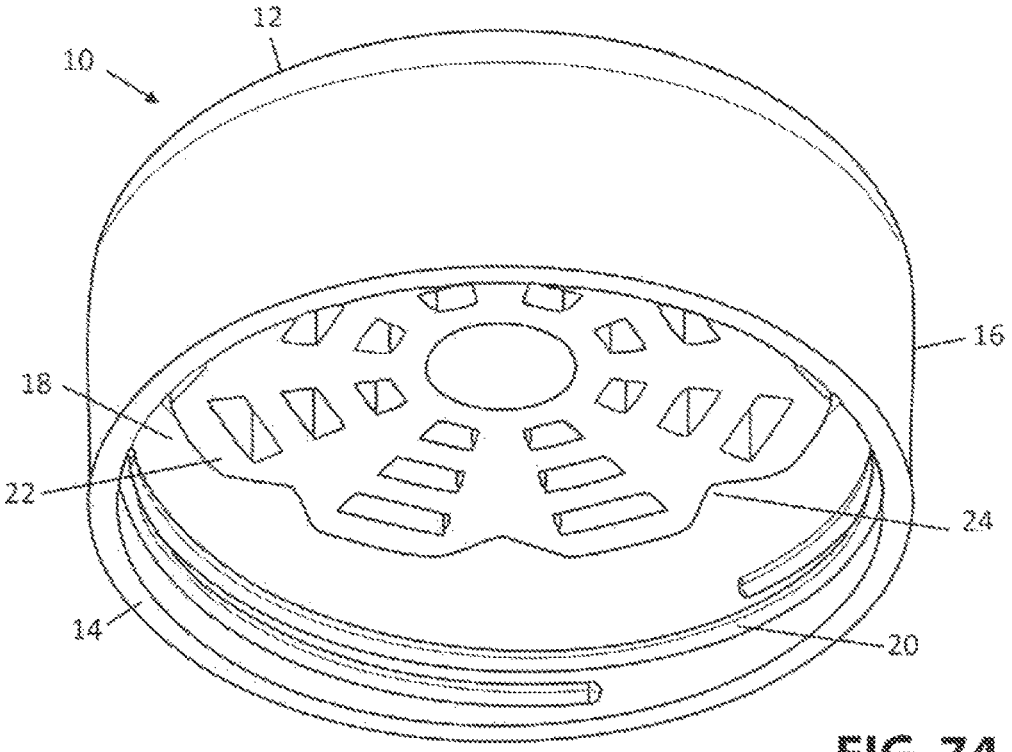
FIG. 74 is a bottom perspective view of the cap of the fourteenth embodiment.
Figure 75:
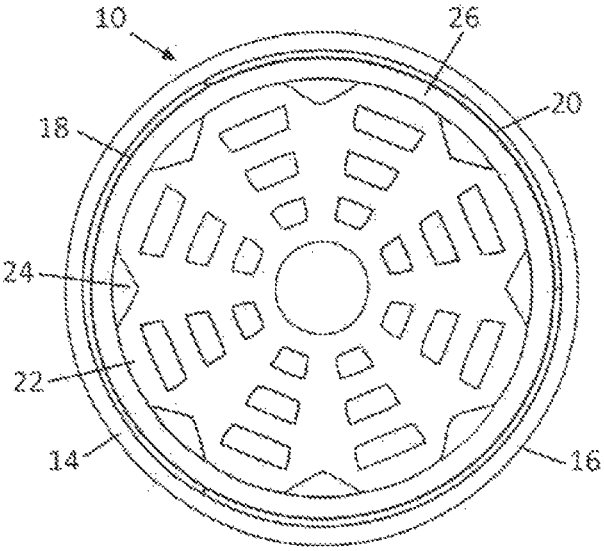
FIG. 75 is a bottom view of the cap of the fourteenth embodiment.
Figure 76:
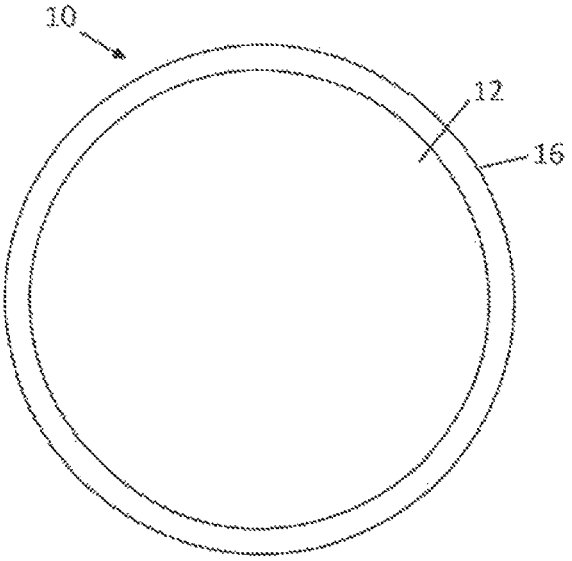
FIG. 76 is a top view of the cap of the fourteenth embodiment.
Figure 77:
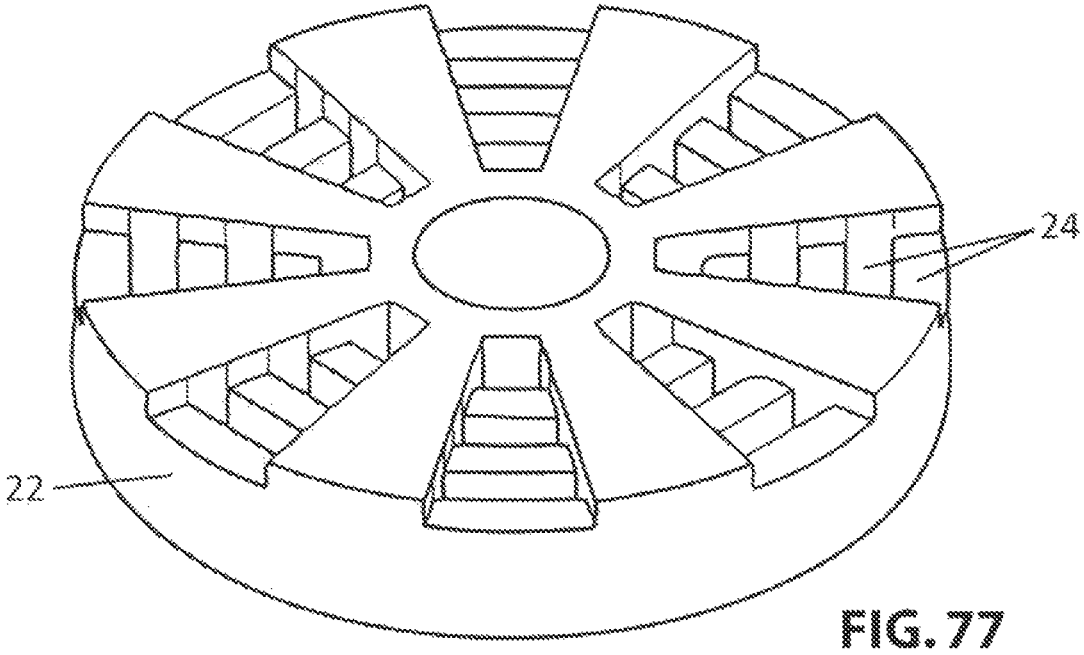
FIG. 77 is a top perspective view of the pressure grip of a fifteenth embodiment.
Figure 78:
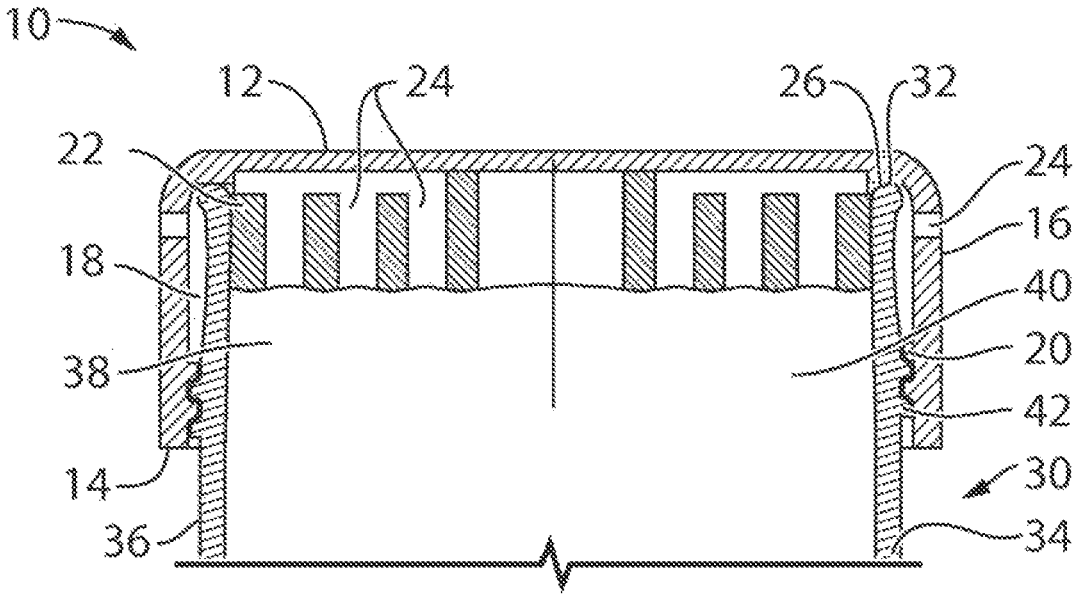
FIG. 78 is a vertical cross-section of the cap and container of the fifteenth embodiment.
Figure 79:
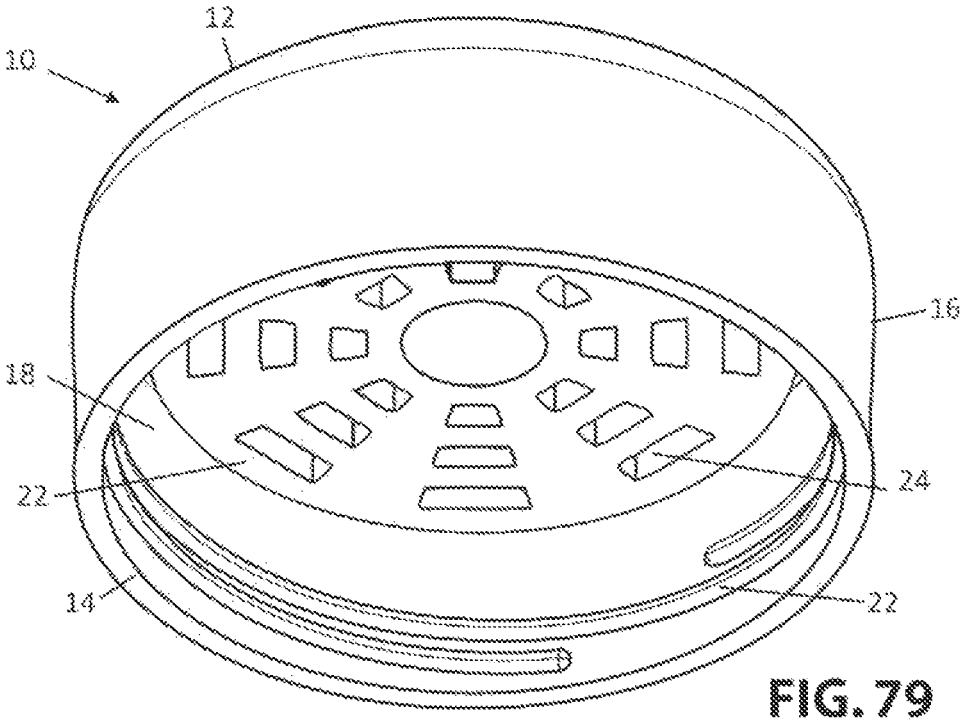
FIG. 79 is a bottom perspective view of the cap of the fifteenth embodiment.
Figure 80:
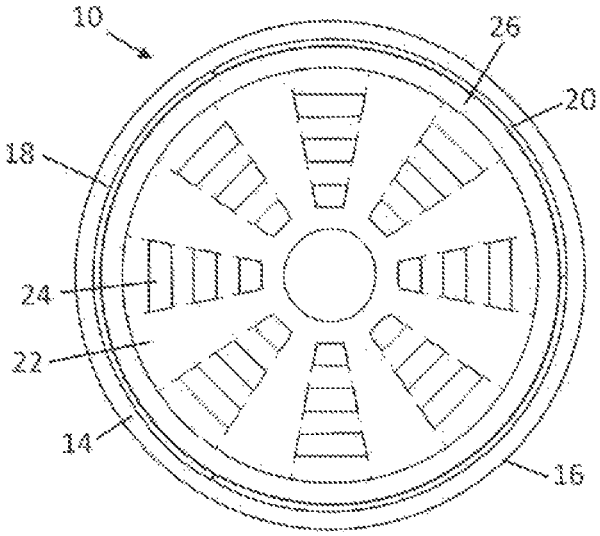
FIG. 80 is a bottom view of the cap of the fifteenth embodiment.
Figure 81:
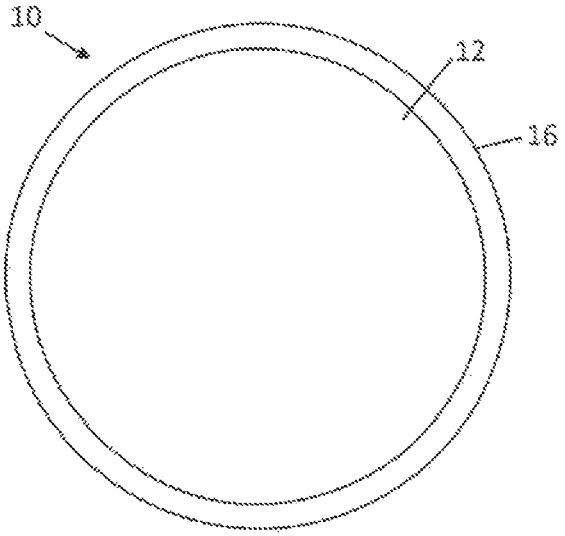
FIG. 81 is a top view of the cap of the fifteenth embodiment.
Figure 82:
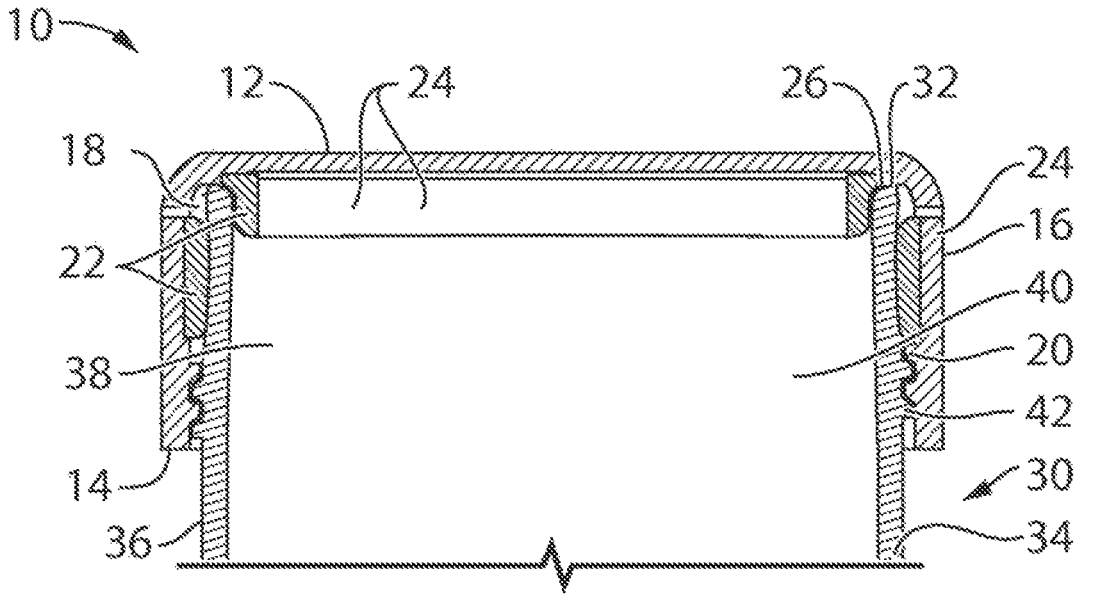
FIG. 82 is a vertical cross-section of the cap and container of a sixteenth embodiment illustrating inside and outside pressure grips working in tandem with twist threads.
Figure 83:
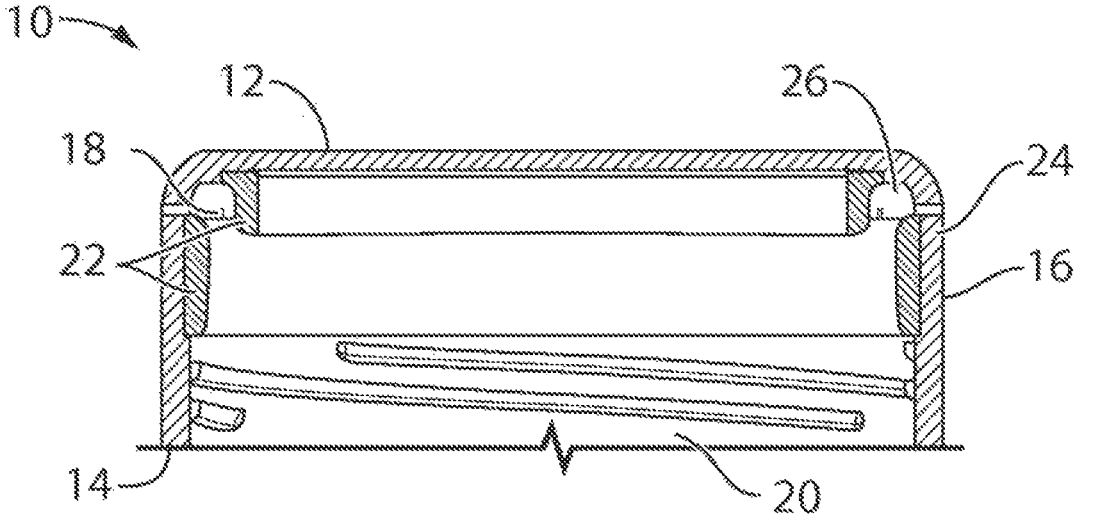
FIG. 83 is a vertical cross-section of the cap of the sixteenth embodiment illustrating inside and outside pressure grips working in tandem with twist threads.
Figure 84:
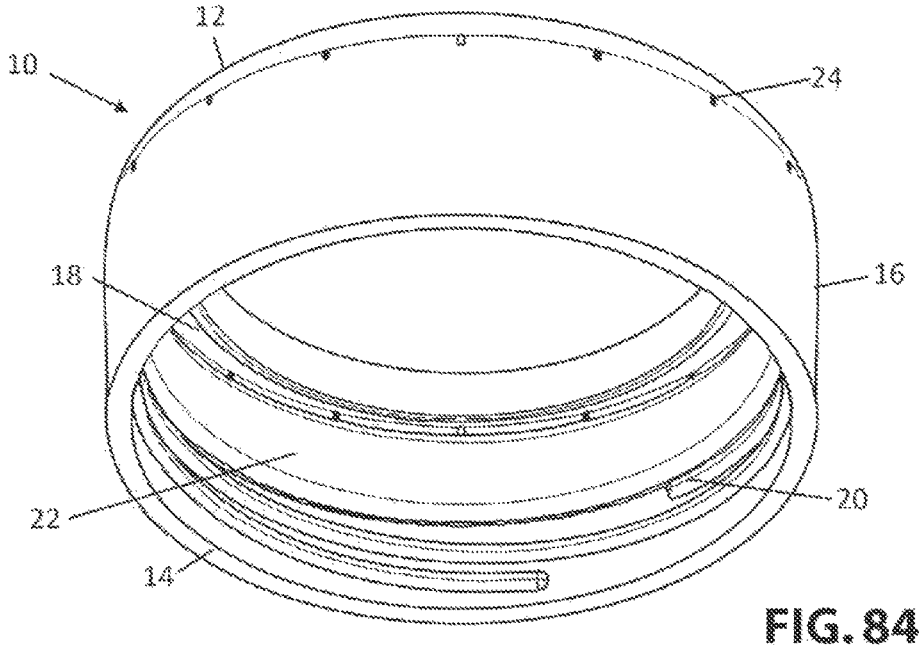
FIG. 84 is a bottom perspective view of the cap of the sixteenth embodiment.
Figure 85:
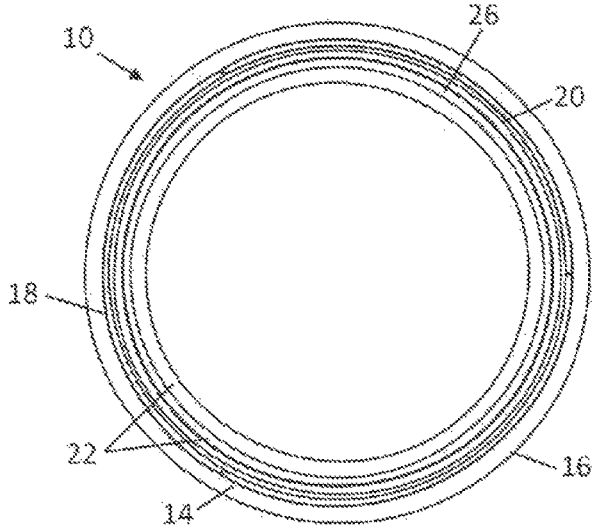
FIG. 85 is a bottom view of the cap of the sixteenth embodiment.
Figure 86:
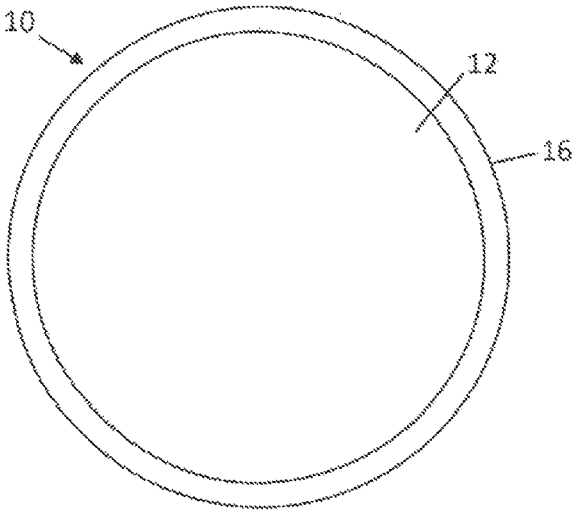
FIG. 86 is a top view of the cap of the sixteenth embodiment.

For example, FIG. 60 shows a pressure grip in the form of a half-sphere. In FIGS. 61-65, the pressure grip is formed by connecting repeating arcs. FIG. 61 shows the perspective view of the pressure grip apart from the cap. FIGS. 66-71 is an example of how the pressure grip can be made of multiple parts that are assembled. Uniquely, venting is provided for by the gaps between the individual grips, instead of a venting pathway that is part of the grip's structure. In this example, the grips may be stamped from flat material and bound together. This opens the door for manufacturers to create pressure grips from stock material without incurring the expense of custom injection molds. The possibilities are myriad: for example, the pressure grip could be multiple rings notched to provide venting and fastened together. Illustratively, our second, third, and seventh embodiments previously shown could be formed using this technique. This could be further developed with layers of different materials with different holding properties. In some ways, this kind of pressure grip might emulate the puck grip described in our fifth and sixth embodiments. FIGS. 72-76 shows a "snowflake" grip with multiple contact points. This design has the potential to provide strength to the lid to prevent doming in a cap. FIGS. 77-81 shows a variant of the snowflake grip with a top trough to assist with venting. In this case, the outer edge of the snowflake is likely to be formed as a circle as the side vents may well be superfluous.

Another variation would be for the pressure grip to be in two parts comprising an outer grip portion and an inner grip portion with the required holding force being shared between them. In addition to the threads, the pressure grip portions would grip the inner and outer container wall in tandem. FIGS. 82-86 show views of a sixteenth embodiment that utilizes such a two-part pressure grip in conjunction with twist threads.

Figure 87:
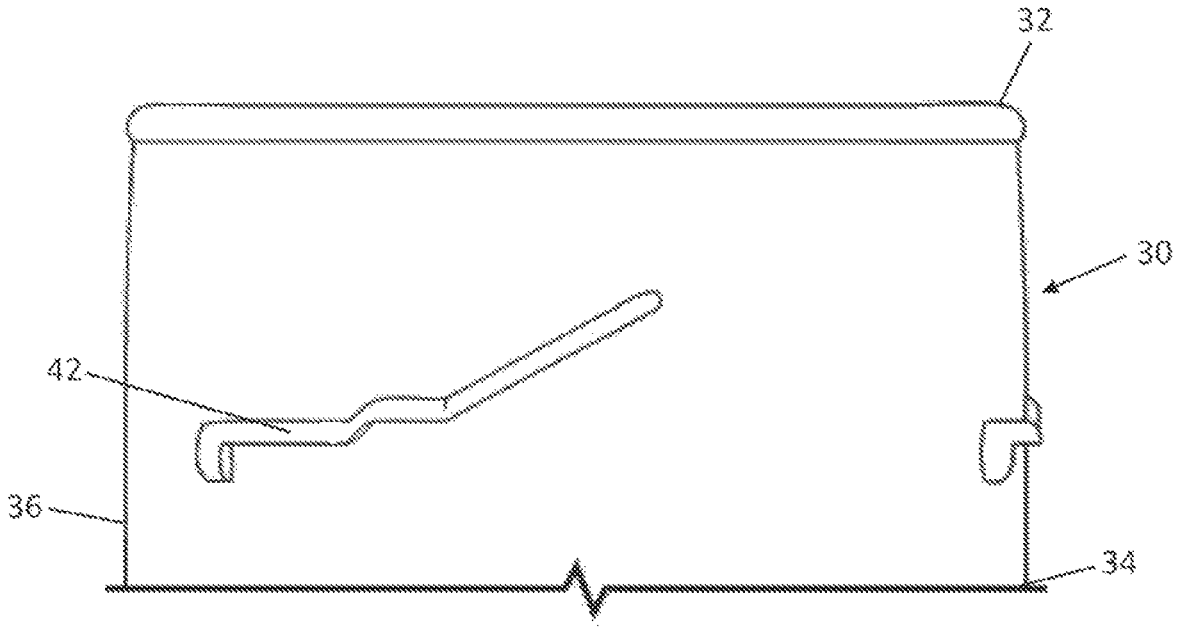
FIG. 87 is a front view of the seventeenth embodiment illustrating a lug with a twist arc extension.

Moreover, lugs could be used as the second cap-securing structure to assist the pressure grip in holding the cap in place. FIG. 87 shows a seventeenth embodiment that has a lug with twist arc. In this case, the lug provides two functions: a) to secure the cap in the initial position, and b) to restrain the cap while the contents are degassed. A partial twist thread ("twist arc") assists with the lifting of the cap with pressure grip. Moreover, snaps might be used as the second cap-securing structure to assist the pressure grip in holding the cap in place. We envision, however, that commercially desirable embodiments that have snaps or possibly some other second cap-securing structure will have twist threads or lugs accompanied by twist arcs because they provide the cap-lifting and ease-of-pressure-grip-removal functions that snaps or such other second cap-securing structure would not typically provide. The portion of the container on which the twist threads are formed is shown in the embodiments as essentially simply the upper portion of a continuous sidewalk In other embodiments, however, the portion of the container on which the twist threads are formed could be, for example, a neck or a collar having an inner or outer diameter different from those at other parts of the container. We intend for references herein to the container sidewall to encompass such a neck, collar or other geometrically distinguishable portions of the container body.

It is thus anticipated that those skilled in the art will be able to devise various alternative arrangements which, although not shown or described herein, embody the principles of the invention and thus are within its spirit and scope.

The invention claimed is:

1. A manufactured product comprising:

a container having a substantially cylindrical sidewall defining a rimmed circular opening and having twist threads on the sidewall, a cap including a top end covering a rim of the opening, a sidewall, twist threads on the sidewall that are engaged with the twist threads of the container, and an annular pressure grip, the annular pressure grip being affixed to the sidewall of the cap so that the annular pressure grip rotates along with rotation of the sidewall of the cap as the twist threads of the cap are rotatably engaged with or disengaged from the twist threads of the container, the annular pressure grip being in binding contact with the sidewall of the container, and pressurized contents within the container that exert a gas-induced internal force on an underside of the cap's top end, wherein the cap is in an initial position that seals the contents in the container.

2. The manufactured product of claim 1, wherein the annular pressure grip, the twist threads of the container and the twist threads of the cap are configured in such a way that they each contribute to a holding force applied to said cap which opposes said gas-induced internal force and holds said cap onto said container as to prevent at least a) dislodgement of said cap and b) substantial escape of contents from said container.

3. The manufactured product of claim 2, wherein the annular pressure grip provides at least 10% of the holding force at least at one stage from when the container is completely sealed to when the container is completely opened.

4. The manufactured product of claim 1, wherein the annular pressure grip is in binding contact with an outer surface of the sidewall of the container.

5. The manufactured product of claim 4, wherein the annular pressure grip is affixed to an inner surface of the sidewall of the cap.

6. The manufactured product of claim 1, wherein the annular pressure grip is in binding contact with a portion of the sidewall of the container above the twist threads of the container.

7. The manufactured product of claim 6, wherein the annular pressure grip is affixed to a portion of the sidewall of the cap above the twist threads of the cap.

8. The manufactured product of claim 1, wherein the annular pressure grip is in binding contact with an outer surface of the sidewall of the container above the twist threads of the container.

9. The manufactured product of claim 8, wherein the annular pressure grip is affixed to an inner surface of the sidewall of the cap above the twist threads of the cap.

10. The manufactured product of claim 1, wherein the annular pressure grip is affixed to an inner surface of the sidewall of the cap.

11. The manufactured product of claim 1, wherein the annular pressure grip is affixed to a portion of the sidewall of the cap above the twist threads of the cap.

12. The manufactured product of claim 1, wherein the annular pressure grip is affixed to an inner surface of the sidewall of the cap above the twist threads of the cap.

13. The manufactured product of claim 1, wherein the annular pressure grip is formed in such a way that gas can enter a space that is formed between the top end of the cap and the rim of the container upon the cap being untwisted to a position at which the gas is no longer sealed within the container by the cap.

14. The manufactured product of claim 13, wherein the cap includes cap vents through which gas in said space between the top end of the cap and the rim of the container can escape to atmosphere.

15. The manufactured product of claim 1, wherein the maximum amount of opening torque required to twist the cap from the initial position is about 2.0 to 3.5 newton-meters.

16. The manufactured product of claim 1, wherein the container opening (inner dimension) is 30.5 mm or greater.

17. The manufactured product of claim 1, wherein the force on the cap is 34 lb or greater.

18. A twist cap configured to seal pressurized contents within a container when the twist cap has been twisted to a sealing position onto the container, the container being of a type that has a substantially cylindrical sidewall defining a rimmed circular opening and twist threads on the sidewall, the twist cap including a top end that covers the rim of the opening when the twist cap is twisted onto the container, a sidewall, twist threads on the sidewall that are engageable with the twist threads of the container when the twist cap is twisted onto the container, and an annular pressure grip affixed to the sidewall of the twist cap so that the annular pressure grip rotates along with rotation of the sidewall of the twist cap as the twist threads of the twist cap are rotatably engaged with or disengaged from the twist threads of the container, the annular pressure grip being configured in such a way that the annular pressure grip is in binding contact with the sidewall of the container when the twist cap has been twisted onto the container.

19. The twist cap of claim 18, wherein the annular pressure grip is affixed to an inner surface of the sidewall of the twist cap.

20. The twist cap of claim 18, wherein the annular pressure grip is affixed to a portion of the sidewall of the twist cap above the twist threads of the twist cap.

21. The twist cap of claim 18, wherein the annular pressure grip is affixed to an inner surface of the sidewall of the twist cap above the twist threads of the twist cap.

22. The twist cap of claim 18, wherein the cap includes cap vents through which gas in a space between the top end of the cap and the rim of the container can escape to atmosphere.

23. The twist cap of claim 18, wherein the cap has no vents through which gas can escape to atmosphere because pressure is released through gaps in the threads.

24. The twist cap of claim 18, wherein the cap size is 38 mm or greater.

25. The twist cap of claim 18, wherein the radius of the cap (inner dimension) is 0.6 inches or greater.

26. The twist cap of claim 18, wherein the force on the cap is 34 lb or greater.

* * * * *